US011008131B2

(12) United States Patent
Herman et al.

(10) Patent No.: US 11,008,131 B2
(45) Date of Patent: May 18, 2021

(54) VESSEL WITH FOLDED DAM

(71) Applicant: COMPLEAT LLC, Boston, MA (US)

(72) Inventors: Peter Herman, Jamaica Plain, MA (US); Robert J. D'Amato, Lexington, MA (US)

(73) Assignee: COMPLEAT LLC, Boston, MA (US)

( * ) Notice: Subject to any disclaimer, the term of this patent is extended or adjusted under 35 U.S.C. 154(b) by 0 days.

(21) Appl. No.: 15/906,501

(22) Filed: Feb. 27, 2018

(65) Prior Publication Data

US 2018/0186502 A1 Jul. 5, 2018

Related U.S. Application Data

(63) Continuation of application No. 15/691,251, filed on Aug. 30, 2017, now abandoned, which is a (Continued)

(51) Int. Cl.

| | |
|---|---|
| ***B65D 5/02*** | (2006.01) |
| ***B65D 3/06*** | (2006.01) |
| ***B65D 3/20*** | (2006.01) |

(52) U.S. Cl.

CPC ..... *B65D 5/0209* (2013.01); *B65D 3/06* (2013.01); *B65D 3/20* (2013.01); *B65D 2231/022* (2013.01)

(58) Field of Classification Search

CPC ..... B65D 5/02; B65D 5/0209; B65D 3/06; B65D 5/0218; B65D 5/0227; (Continued)

(56) References Cited

U.S. PATENT DOCUMENTS 359,435 A 3/1887 Elliott
667,634 A * 2/1901 Schmidt ..... B65D 3/20 229/128

(Continued)

FOREIGN PATENT DOCUMENTS

CN 102481994 A 5/2012
CN 203332516 U 12/2013

(Continued)

OTHER PUBLICATIONS

Lance Coleman, "Curious Cup—Louisville Man Invents No-Spill 'Origami' Cup," www.blounttoday.com, 20 pages, Sep. 3, 2008.

(Continued)

*Primary Examiner* — Kareen K Thomas
(74) *Attorney, Agent, or Firm* — Nutter McClennen & Fish LLP

(57) ABSTRACT

A vessel has an inner flap and an outer flap that fold across a base of the vessel to form a cover. The inner flap includes a dam tab along the outer edge of the inner flap. When the inner flap is folded down, the free edge of this tab contacts the wall of the vessel and bends upward forming a "folded edge" dam. This folded edge dam can either be one segment or be made of two or more segments divided by one or more V-shaped cuts to allow each segment to fold down and fit together seamlessly. A restrictive channel is formed by the outer and inner flaps together with the "folded edge" dam, which is present in-between the outer and inner flaps.

38 Claims, 54 Drawing Sheets

*(Closing Vessel - Step 2, Outer flap down. Spout formed)*

*(dashed lines indicate elements beneath another)*

*(Vessel Cross Section)*

Related U.S. Application Data continuation of application No. 14/672,145, filed on Mar. 28, 2015, now Pat. No. 9,751,655.

(60) Provisional application No. 61/971,774, filed on Mar. 28, 2014.

(58) Field of Classification Search

CPC .. B65D 5/0236; B65D 5/0245; B65D 5/0254; B65D 5/0263; B65D 5/0272; B65D 5/0281; B65D 5/029; B65D 5/04; B65D 5/08; B65D 5/10; B65D 2575/00; B65D 2575/28; B65D 2575/32; B65D 2575/36; B65D 2571/00037; B65D 2571/00172; B65D 2571/00185

USPC ..... 229/107, 200, 128, 404, 5.5, 906.1, 403; 220/694, 703, 711, 714, 715, 62, 62.1, 6

See application file for complete search history.

(56) References Cited

U.S. PATENT DOCUMENTS 1,295,418 A 2/1919 Bohlman
1,375,778 A 4/1921 Clearwater
1,527,830 A 2/1925 Booker
1,543,209 A 6/1925 Fulton
2,016,964 A * 10/1935 Huffman ..... B21D 51/42 413/22
2,074,824 A 3/1937 Karlsson-Ygger
2,321,042 A 6/1943 Preis
2,344,359 A 3/1944 Lehmann
2,367,780 A 1/1945 Inman
2,608,841 A 9/1952 Rice
2,646,200 A 7/1953 Atkins
2,661,138 A 12/1953 Leonard
2,687,840 A 8/1954 Innes
2,797,041 A 6/1957 Rondone
2,812,121 A 11/1957 Sheets
D185,882 S 8/1959 Bamburg
2,964,227 A 12/1960 Goldsholl
3,047,179 A 7/1962 Madej
3,090,542 A 5/1963 Miller
3,125,258 A 3/1964 Watts
3,150,811 A 9/1964 Amberg
3,190,440 A 6/1965 Palmer
3,302,858 A 2/1967 Miller
3,315,866 A 4/1967 Kersh et al.
3,334,797 A 8/1967 Latham et al.
3,343,743 A 9/1967 Hamilton, Jr. et al.
3,361,308 A 1/1968 Rumberger
3,365,114 A 1/1968 Macchi
D219,266 S 11/1970 Biallo
3,595,446 A 7/1971 Hellstrom
3,630,430 A 12/1971 Struble
3,680,771 A 8/1972 Blunsdon
3,765,594 A 10/1973 Cramphorn
3,806,023 A 4/1974 Barnett
3,809,310 A 5/1974 VanderLugt, Jr.
3,845,897 A 11/1974 Buttery et al.
3,929,222 A 12/1975 Smith et al.
3,964,606 A 6/1976 Hogg et al.
3,971,503 A 7/1976 Allan et al.
4,008,848 A * 2/1977 Christensson ..... B65D 5/56 229/190
4,083,447 A 4/1978 Walters et al.
4,135,512 A 1/1979 Godsey
4,150,747 A 4/1979 Gordon
4,185,764 A 1/1980 Cote
4,201,331 A 5/1980 Austin
4,238,069 A 12/1980 Morris, Jr.
4,267,955 A 5/1981 Struble
4,322,014 A 3/1982 Philip
4,368,841 A 1/1983 Eddy
4,418,862 A * 12/1983 Vesborg ..... B65D 5/0254 229/110
4,420,111 A 12/1983 Hament
4,535,928 A 8/1985 Capo
4,564,139 A 1/1986 Reil
4,573,631 A 3/1986 Reeves
4,620,665 A * 11/1986 McSherry ..... B65D 5/02 156/73.1
4,630,733 A 12/1986 Fear
4,706,874 A 11/1987 Reil
4,711,389 A 12/1987 Alba et al.
4,712,725 A 12/1987 Moore
4,714,164 A 12/1987 Bachner
4,714,190 A 12/1987 Morrocco
4,730,766 A 3/1988 Fear
4,805,775 A 2/1989 Fear
4,886,206 A 12/1989 Martinez
D306,975 S * 4/1990 Brondyke ..... D9/431
4,915,235 A 4/1990 Roosa
5,009,901 A * 4/1991 Byrne ..... B65B 3/04 206/219
5,048,749 A 9/1991 Wischusen, III
5,061,501 A 10/1991 Lowe
5,062,568 A 11/1991 Hill et al.
5,137,210 A 8/1992 Hibbs
5,301,870 A 4/1994 Smith et al.
5,358,175 A * 10/1994 Cai ..... B65D 3/08 229/104
5,400,989 A 3/1995 Gaskill
5,417,364 A 5/1995 Shaw
5,423,476 A 6/1995 Ferrer
D367,816 S 3/1996 Cai
5,588,552 A 12/1996 Johnson
5,626,283 A 5/1997 Mellon
5,645,191 A 7/1997 Neville
5,676,306 A 10/1997 Lankin et al.
5,697,549 A 12/1997 Yocum
5,711,479 A 1/1998 Spronk
5,720,429 A 2/1998 Cordle
D406,058 S 2/1999 Allmon
5,875,957 A 3/1999 Yocum
5,911,358 A 6/1999 Kenner et al.
5,960,987 A 10/1999 Solland et al.
5,979,745 A 11/1999 Surlina
D418,368 S * 1/2000 Solland ..... D7/510
6,019,277 A 2/2000 Lundström
6,027,018 A 2/2000 Yocum
6,164,488 A 12/2000 Solland et al.
6,176,420 B1 1/2001 Sarson et al.
6,216,946 B1 4/2001 Cai
6,230,969 B1 5/2001 Spransy
D451,385 S 12/2001 Bryan et al.
6,360,944 B1 3/2002 Gorman
D456,253 S 4/2002 Bryan et al.
D456,710 S 5/2002 Persson
6,394,338 B1 5/2002 Sluder
D467,798 S 12/2002 Cohon
D469,691 S 2/2003 Brondyke et al.
6,758,390 B2 7/2004 Sarson et al.
D495,209 S 8/2004 Tranfaglia et al.
D502,364 S 3/2005 Chan
6,955,289 B2 10/2005 Green
D605,895 S 12/2009 Abbott
D628,059 S 11/2010 Perkins-Stanaford et al.
D637,872 S * 5/2011 Sarson ..... D7/510
8,505,807 B2 8/2013 Herman
8,540,114 B2 * 9/2013 Sarson ..... B65D 21/0217 220/834
8,746,545 B2 * 6/2014 Houck ..... A47G 19/2272 229/128
8,864,015 B2 * 10/2014 Lu ..... B65D 3/20 229/128
9,321,551 B2 4/2016 Lu et al.
9,359,101 B2 6/2016 Robertson
2004/0011862 A1 * 1/2004 Sarson ..... B65D 3/28 229/404
2004/0211823 A1 10/2004 Sarson et al.
2005/0173507 A1 * 8/2005 Green ..... B65D 3/20 229/404

(56) References Cited

U.S. PATENT DOCUMENTS

| | | | | |
|---|---|---|---|---|
| 2006/0169759 | A1* | 8/2006 | Sarson | B65D 3/268 229/400 |
| 2009/0114710 | A1* | 5/2009 | Lang | B65D 3/20 229/404 |
| 2009/0261156 | A1* | 10/2009 | Abbott | B65D 3/06 229/404 |
| 2010/0252424 | A1 | 10/2010 | Amano et al. | |
| 2010/0252524 | A1 | 10/2010 | Dubs et al. | |
| 2010/0314434 | A1* | 12/2010 | Herman | B65D 1/265 229/107 |
| 2012/0286027 | A1* | 11/2012 | Lu | B65D 3/20 229/404 |
| 2012/0292382 | A1* | 11/2012 | Cai | B65D 5/6685 229/404 |
| 2013/0056469 | A1 | 3/2013 | Davis et al. | |
| 2014/0042217 | A1* | 2/2014 | Houck | A47G 19/2272 229/404 |
| 2015/0097026 | A1* | 4/2015 | Lu | B65D 3/30 229/128 |

FOREIGN PATENT DOCUMENTS

| | | | |
|---|---|---|---|
| EP | 1 354 804 | A1 | 10/2003 |
| EP | 1 236 648 | B1 | 6/2006 |
| GB | 773138 | | 4/1957 |
| GB | 2 380 397 | A | 4/2003 |
| JP | P2003-72733 | A | 12/2003 |
| JP | P4853603 | | 12/2012 |
| WO | WO 2005/012114 | A1 | 2/2005 |
| WO | WO 2010144810 | A1 | 12/2010 |
| WO | WO 2013/175020 | A1 | 11/2013 |

OTHER PUBLICATIONS

Keith Orchard, The Kiss Cup, *Kiss Cup Photographs* http://www.jovoto.com/contests/drink-sustainably/ideas/5312, 5 pages, 2010.

International Searching Authority, International Search Report—International Application No. PCT/US2010/038327, dated Sep. 14, 2010, together with the Written Opinion of the International Searching Authority, 11 pages.

International Searching Authority, International Search Report—International Application No. PCT/US2015/023219, dated Jun. 16, 2015, together with the Written Opinion of the International Searching Authority, 9 pages.

International Searching Authority, International Preliminary Report on Patentability—International Application No. PCT/US2015/023219, dated Oct. 13, 2016, together with the Written Opinion of the International Searching Authority, 6 pages.

USPTO, Office Action dated Jun. 3, 2016 in U.S. Appl. No. 14/508,339, 17 pages.

USPTO, Office Action dated Dec. 30, 2016 in U.S. Appl. No. 14/508,339, 18 pages.

USPTO, Office Action dated Oct. 31, 2017 in the U.S. Appl. No. 15/591,251, 11 pages.

Chinese Patent Office, Chinese Office Action for Application No. 201580017057.5, dated Sep. 26, 2017, 9 pages.

Patent Cooperation Treaty, PCT Request; Application No. PCT/US2010/38327, filed Jun. 11, 2010, 24 pages.

* cited by examiner

*(Closing Vessel - Step 2, Outer flap down. Spout formed)*

*(Closing Vessel - Step 1, Inner flap down)*

(Vessel Cross Section)

(Vessel Open - Inner & outer flaps up)

(Vessel Body Cut Pattern)

(Vessel Bottom Cut Pattern)

(Vessel Top)

(Vessel Front )

(Vessel Left Side)

(Vessel Back)

(Vessel Right Side)

(Vessel Bottom)

(Vessel Top)

(Vessel with spout enlargement serrations to accommodate a straw, for instance)

(Vessel Front )

(Vessel Body Cut Pattern with serrations to form enlarged or additional openings)

*(Vessel with cap closure at spout)*

(Vessel Top)

(Vessel with spout closure tab)

(Vessel Front )

(Vessel Left Side)

(Vessel Back)

*(Vessel Body Cut Pattern with closure tabs)*

*(Vessel with plug closure at spout)*

*(Closing Vessel - Step 2, Outer flap down. Spout formed)*

(Closing Vessel - Step 1, Inner flap down)

(Vessel Open - Inner & outer flaps up)

*(dashed lines indicate elements beneath another)*

*(Vessel Cross Section)*

*(Enlarged Vessel Cross Section)*

(Vessel Body Cut Pattern)

(Vessel Bottom Cut Pattern)

(Vessel Top)

(Vessel Front )

*(Vessel Left Side)*

*(Vessel Back)*

*(Vessel Right Side)*

*(Vessel Bottom)*

*(Vessel Body Cut Pattern)*

*(Vessel Body Cut Pattern with No Drainage Hole)*

*(Vessel Body Cut Pattern)*

(Vessel Body Cut Pattern with Additional Embossments on Closure Flaps 120 and 140)

*(Vessel Body Cut Pattern)*

*(Vessel Body Cut Pattern with Adhesive Strips)*

*(Vessel Body Cut Pattern)*

*(Vessel Body Cut Pattern with Extended Spout Ledge)*

*(Vessel Body Cut Pattern)*

*(Vessel Body Cut Pattern with Lip Tab)*

*(Vessel Body Cut Pattern)*

(Optional Vessel Body Cut Pattern with closure tabs)

(Vessel Top)

(Optional vessel with spout closure tab)

(Vessel Front )

(Vessel Left Side)

(Vessel Back)

(Optional vessel with spout closure tab)

(Vessel Body Cut Pattern with Waterproofing Applied to Cut Edges and Creases)

*(Optional Vessel Body Cut Pattern with closure tabs)*

*(Vessel Body Cut Pattern with No Drainage Hole)*

*(Optional Vessel Body Cut Pattern with closure tabs)*

(Vessel Body Cut Pattern with Additional Embossments on Closure Flaps 120 and 140)

*(Optional Vessel Body Cut Pattern with closure tabs)*

*(Vessel Body Cut Pattern with Adhesive Strips)*

*(Optional Vessel Body Cut Pattern with closure tabs)*

(Optional Vessel Body Cut Pattern with serrations to form enlarged or additional openings)

(Vessel Top)

(Optional vessel with spout enlargement serrations to accommodate a straw, for instance)

(Vessel Front )

(Optional vessel with with serrations to form enlarged or additional openings)

(Vessel Body Cut Pattern with Waterproofing Applied to Cut Edges and Creases)

*(Optional Vessel Body Cut Pattern with serrations to form enlarged or additional openings)*

*(Vessel Body Cut Pattern with No Drainage Hole)*

*(Optional Vessel Body Cut Pattern with serrations to form enlarged or additional openings)*

(Vessel Body Cut Pattern with Additional Embossments on Closure Flaps 120 and 140)

*(Optional Vessel Body Cut Pattern with serrations to form enlarged or additional openings)*

*(Vessel Body Cut Pattern with Adhesive Strips)*

*(Optional Vessel Body Cut Pattern with serrations to form enlarged or additional openings)*

Optional vessel with plug closure at spout)

(Optional vessel with cap closure at spout)

(Optional vessel with cap closure at spout)

(Combination Vessel Body Cut Pattern)

(Combination vessel with with serrations to form enlarged or additional openings & closure tabs)

(Combination Vessel Body Cut Pattern)

(Combination vessel with with serrations to form enlarged or additional openings, closure tab, adhesive closure)

(Combination Vessel Body Cut Pattern)

(Combination vessel with with serrations to form enlarged or additional openings, and closure tab)

(Combination Vessel Body Cut Pattern)

(Combination vessel with with serrations to form enlarged or additional openings, and plug closure at spout)

*(Combination Vessel Body Cut Pattern)*

*(Combination vessel with with serrations to form enlarged or additional openings, closure tab, and plug closure at spout)*

(Combination Vessel Body Cut Pattern)

(Combination vessel with with serrations to form enlarged or additional openings, and cap closure at spout)

*(Combination Vessel Body Cut Pattern)*

*(Combination vessel with with serrations to form enlarged or additional openings, closure tab, and cap closure at spout)*

VESSEL WITH FOLDED DAM

CROSS REFERENCE TO RELATED APPLICATIONS

The present application is a continuation of, and claims priority to, U.S. patent application Ser. No. 15/691,251, filed Aug. 30, 2017 and titled "Vessel With Folded Dam," naming Peter Herman and Robert J. D'Amato as inventors, which is a continuation of U.S. patent application Ser. No. 14/672,145, filed Mar. 28, 2015 and titled "Vessel With Folded Dam," naming Peter Herman and Robert J. D'Amato as inventors, and also claims priority to U.S. provisional application 61/971,774, filed Mar. 28, 2014, titled "Vessel With Folded Dam," naming Peter Herman and Robert J. D'Amato as inventors, and is related to U.S. Provisional Patent Application Ser. No. 61/186,458, filed Jun. 12, 2009; and is also related to U.S. non-provisional patent application Ser. No. 12/813,840, published Dec. 16, 2010 as US Published Patent Application No. US 2010/0314434 and issued as U.S. Pat. No. 8,505,807 on Aug. 13, 2013; and is also related to US non-provisional patent application Ser. No. 13/942,916, filed Jul. 16, 2013 and published Nov. 14, 2013 as US Published Patent Application No. 2013/0299567. All of the foregoing applications, patents and publications are hereby incorporated by reference herein in their entirety for all purposes.

TECHNICAL FIELD

Embodiments relate to vessels and methods of making the same, and more particularly to drinking vessels, and to vessels used for pouring liquid and/or non-liquid substances, composed from flexible materials.

BACKGROUND ART

It is known in the prior art to provide disposable liquid containers such as paper cups. These cups are generally coated with a substance that prevents the paper container from absorbing or leaking the liquid contained therein. Furthermore, in the restaurant arena, such as fast food restaurants, coffee shops, etc., a separate lid, for example a plastic lid, is provided as a complement to such cups in order to help prevent spillage of a hot or cold beverage, for example. The lids are often plastic lids and some have an opening for insertion of a straw while others form a narrow opening conducive to direct user consumption.

However, since these cups often come in a variety of sizes, a restaurant or coffee shop will generally be required to stock lids in multiple sizes to complement the variety of cup sizes. Accordingly, providing consumers with a variety of cup sizes in the form of devices known in the prior art requires the use of separate items (i.e., the cup and corresponding lid), generally made of different materials and further requires coordination and assembly of these items prior to serving a patron. Furthermore, more organizations are on a quest to provide more environmentally safe products such as 100 percent recyclable cups, which may be harder to facilitate with cups made of different materials than their corresponding lids.

SUMMARY OF EMBODIMENTS

In accordance with one embodiment, a vessel for holding and dispensing contents includes a base region that has a width across its top. The base has an inner side wall that defines an interior volume. A top region of the base has two opposing flaps: an inner flap and an opposing outer flap. In some embodiments, the two flaps are delineated from the base region by two respective paths.

The inner flap includes a dam flap, or dam tab, extending from a free edge (e.g., the edge of the inner flap that is opposite the place where the inner flap folds from the base region). The flaps are disposed so that, when folded along their respective paths, they define an elevated spout having a spout opening, and the dam flap forms a folded edge dam between the outer and inner flaps, the folded edge dam extending up the spout towards the spout opening. For example, in some embodiments, the inner flap, including the dam flap, is wider than the width of the vessel and has a scored outer edge defining the dam flap, so that when the inner flap is folded down, the dam flap contacts the side wall of the vessel and this action folds the dam flap upward along the score line, thus forming the folded edge dam.

In some embodiments, the dam flap has a length defined along the free edge of the inner flap, and a width extending away from the free edge, the length greater than the width. In some embodiments, the dam flap extends more than one half of the length of the free edge of the inner flap.

Further, when the inner and outer flaps are folded, the dam flap and the inner side wall cooperate to define a channel to direct substances towards the spout opening when the vessel is being used for drinking or pouring those substances.

A dam flap may have a single section, or may include two (or more) segments divided by (one or more) V-shaped gaps, such that when the inner flap is folded down, the segments of the dam flap are raised upward and fold between the inner flap and the folded outer flap, and fit together in a fashion closing the V-shaped gap between the segments.

Some embodiments may include straw holes. For example, the flaps and/or the base of the vessel may include one or more straw holes. To that end, the inner and outer flaps may contain straw holes, or serrations configured to allow a portion of the flap to be punched out to form one or more straw holes. In some embodiments, each of the inner flap and outer flap may have corresponding straw holes that, when the outer flap is folded down over the inner flap, the straw holes overlap to cooperate to form a single straw hole allowing a straw to pass through the flaps to extend between the interior volume and the exterior of the vessel.

In some embodiments, the spout may include one or more serrations configured to enlarge the spout opening when the serrations are torn, compressed, stretched, or otherwise distorted.

Various embodiments may include a variety of other features. For example, in some embodiments, the inner flap may include a drain aperture configured to allow material to flow into the volume of the vessel from a space in-between the inner and outer flaps.

The outer flap may, in some embodiments, include an adhesive tab configured to secure the outer flap to the base of the vessel, or adhesives on an inner surface of the outer flap and/or adhesives on an outer surface of the inner flap, to secure the outer flap to the top of the inner flap.

Some embodiments may include features to help seal the spout opening. For example, some embodiments include a spout cover tab extending from the spout and configured to fold over and cover the spout opening. Some embodiments further include an adhesive on the spout cover tab, the adhesive configured to releasably attach a free end of the spout cover tab to the vessel spout when the spout cover tab is folded over the spout opening. Alternately, some embodiments include a plug closure configured to removably fit within the spout opening. For example, a plug closure may include a stopper portion and a base portion, the stopper portion extending from the base portion and configured to fit within the spout opening, and the base portion configured to remain outside of the spout opening when the stopper portion is within the spout opening, for example so as to prevent the plug closure from completely falling through the spout opening.

Alternately, some embodiments include a cap closure molded over the spout to cover the spout opening.

In some embodiments, edges of a surface, such as the edge of a flap, for example, and/or fold paths (e.g., scores or creases) may be waterproofed, for example by the application to the edges and/or creases of a waterproofing substance.

Various embodiments may be formed or fabricated in a variety of ways from a variety of materials. For example, in some embodiments, the vessel is formed from an insulating material. In some embodiments, the vessel may be fabricated by injection modeling, by thermoforming, or by rolling, scoring and forming from a sheet.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1:
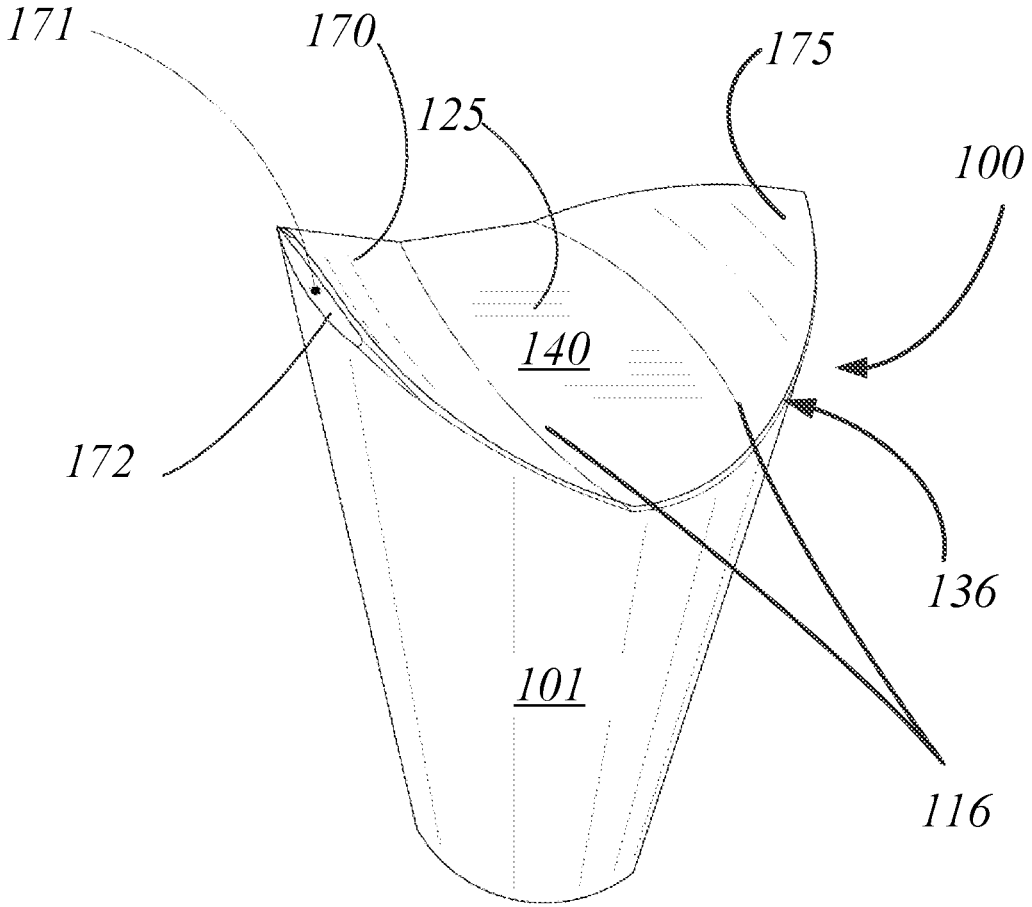
FIG. 1 schematically illustrates the embodiment of the vessel of FIG. 1 with both flaps closed.

Embodiments provide a vessel having features that assist in retaining the content of the vessel and making the vessel more user-friendly. Various embodiments include a dam flap that folds between an inner flap and an outer flap to form a foldable dam that impedes the escape of vessel content from the inner volume of the vessel and guides vessel content to a spout.

The inner flap and outer flap fold across a base of the vessel. The inner flap, which is folded first, is wider than the width of the base of the vessel at the level of the fold and has a fold line near its edge. Thus when this inner flap is first folded down, the free edge of this flap hits the sidewall of the vessel body and this contact bends the free edge of the inner flap upward along the score line forming a "folded edge" dam. This "folded edge" dam can either be one segment or have two or more segments divided by one or more V-shape cuts to allow each segment to fold down and fit together seamlessly. After the inner flap is folded down, the second outer flap is folded down on top of the inner flap. The outer flap holds the inner flap in place and forms a restrictive channel for substances to flow up the spout. The restrictive channel is formed by the outer and inner flaps together with the "folded edge" dam, which is present in between the outer and inner flaps. This vessel design allows substances to be poured safely through the spout opening, without significant spillage even when the user compresses the vessel. Further, the "folded edge" dam does not rely on any adhesives or sealants that can interfere with stacking and nesting of said vessels.

Definitions. As used in this description and the accompanying claims, the following terms shall have the meanings indicated, unless the context otherwise requires:

To "affix" a sheet of material is to form a connection between that sheet and another surface. Such a connection may be created using an adhesive layer applied between overlapping portions, or spanning adjacent portions, of the sheet and the other surface being connected. The connection may alternatively, or in addition, be achieved by crimping, fusing, or welding of the sheet to the other surface, under conditions, for example, including the application of one or more of pressure and heat.

"Cooperating" apertures are apertures in different surfaces, or different locations of a single surface that align, for example when folded over one another, to form an aperture (which may be referred to as a "compound aperture") through which an object like a drinking straw could pass.

A "frusto-conical" shape includes a shape similar to a frustum of a cone, including, for example, a pyramidal section having rounded edges, so as to approximate a frustum of a cone.

An "insulating material" is a material capable of being formed into a vessel as described herein, and which has a thermal conductivity of less than 0.2 watts per meter kelvin [(W/(mK)].

A "fold path" is a path along-which a flap, tab, or material may be folded, and may include for example scoring paths and creases.

The reference numbers in the attached figures are as follows:

| Ref No. | Feature |
|---|---|
| 100 | Vessel |
| 101 | Vessel body or base |
| 108 | Embossment or scoring to form specific fold or crease; |
| 109 | Embossment to indicate fill line |
| 110 | Sealed closure seam; |
| 111 | Bottom of vessel |
| 113 | Adhesive strip |
| 114 | Waterproofing applied to edge and/or scoring or crease |
| 115 | Bottom edge |
| 116 | Score lines |
| 120 | Inner flap |
| 121 | Fold path that delineates inner flap from vessel base |
| 122 | Drain aperture |
| 123 | Center point of edge of inner flap |
| 124 | Edge of inner flap |
| 125 | Flat region of folded flaps |
| 126 | Outer surface of inner flap |
| 130 | Dam tab or dam flap |
| 131 | Part of tab or dam flap |
| 132 | Part of tab or dam flap |
| 133 | V-shaped gap |
| 134 | Folding path or crease that delineates dam flap from the remainder of the inner flap |
| 135 | Edge of dam flap |
| 136 | Space sandwiched between folded flap 120 and 140 |
| 140 | Outer flap |
| 141 | Fold path that delineates outer flap from vessel base |
| 144 | Edge of outer flap |
| 145 | Top of vessel; outer surface of outer flap |
| 146 | Inner surface of outer flap |
| 160 | Closure tab |
| 161 | Adhesive for closure tab |
| 162 | Fold line that defines closure tab |
| 165 | Adhesive tape |
| 170 | Ascending region of folded flaps to form spout |
| 171 | Spout |
| 172 | Spout aperture |
| 175 | Second ascending region of folded flaps |
| 176 | Opposing peak |
| 185 | Sidewall of the base of vessel |
| 188 | Interior volume of vessel |
| 193A-Z; 198 | Blanks from which vessel may be formed |
| 194 | Line of asymmetry |
| 195 | Top of base region |
| 197 | Elevated drinking portion including spout |
| 220 | Elevation of opposing peak |
| 225 | Elevation of spout |
| 290 | Folded edge dam |
| 291 | Channel formed by folded edge dam |
| 300 | Width of the vessel at the top of the vessel body |
| 301 | Width of inner flap including dam flap |
| 401 | Spout straw hole |
| 402 | Spout straw hole serration |
| 403 | Spout straw hole serration |
| 404 | Spout straw hole serration |
| 405 | Spout straw hole serration |
| 411 | Top straw hole |
| 412 | Top straw hole serration |
| 413 | Top straw hole serration |
| 421 | Side straw hole |
| 422 | Side straw hole serration |
| 500 | Foldable tab to cover spout aperture |
| 501 | Scored path that delineates foldable tab from blank |
| 502 | Intervening surface portion foldable tab |
| 523 | Adhesive that releasably attaches the closure tab to the spout |
| 600 | Plug closure |
| 601 | Plug base |
| 602 | Stopper portion |
| 650 | Cap closure |
| 660 | Spout ledge |
| 670 | Lip tab |

First Embodiment

FIG. 1 schematically illustrates a vessel 100, which may be a drinking or pouring cup for liquids and/or non-liquid substances, having a base region 101, which may be a frusto-conical base region or could have a shape other than a frusto-conical shape, and a pair of opposing flaps 120 and 140 extending from the upper end 195 of the base region 101. The base region 101, along with bottom member 111, forms an interior volume 188 of the vessel 100.

FIG. 1 is a perspective view of a pouring or drinking vessel in a closed configuration in accordance with a first embodiment. The vessel 100 illustrated in FIG. 1 is characterized by a base 101. The base allows the user to grasp vessel 100 in a comfortable manner and allows the vessel to be easily maintained within a cup holder, for example within an automobile.

Vessel 100 includes a top or cover formed from two overlapping flaps. In the current view, flap 140 is visible since it is the outer flap in this embodiment. The overlapping flaps form a portion of an elevated pouring or drinking portion that includes a spout 171 and an aperture 172. The spout 171 is configured so that when the spout 171 is inserted in the mouth of a user in use of the vessel for drinking, the lips of the user may come into contact with the material over a full 360-degree angular extent of the material disposed around the periphery of the aperture. The spout 171 allows the user to easily pour or drink from the cup 100, but helps prevent spillage of a beverage, for example, contained in the vessel 100. Unlike a traditional gable top milk carton, such as that provided in U.S. Pat. No. 2,826,349 which can be opened to form a spout for pouring, the vessel is designed so that a user may completely surround the aperture in the spout with her lips when consuming the contents of the vessel.

Figure 2A:
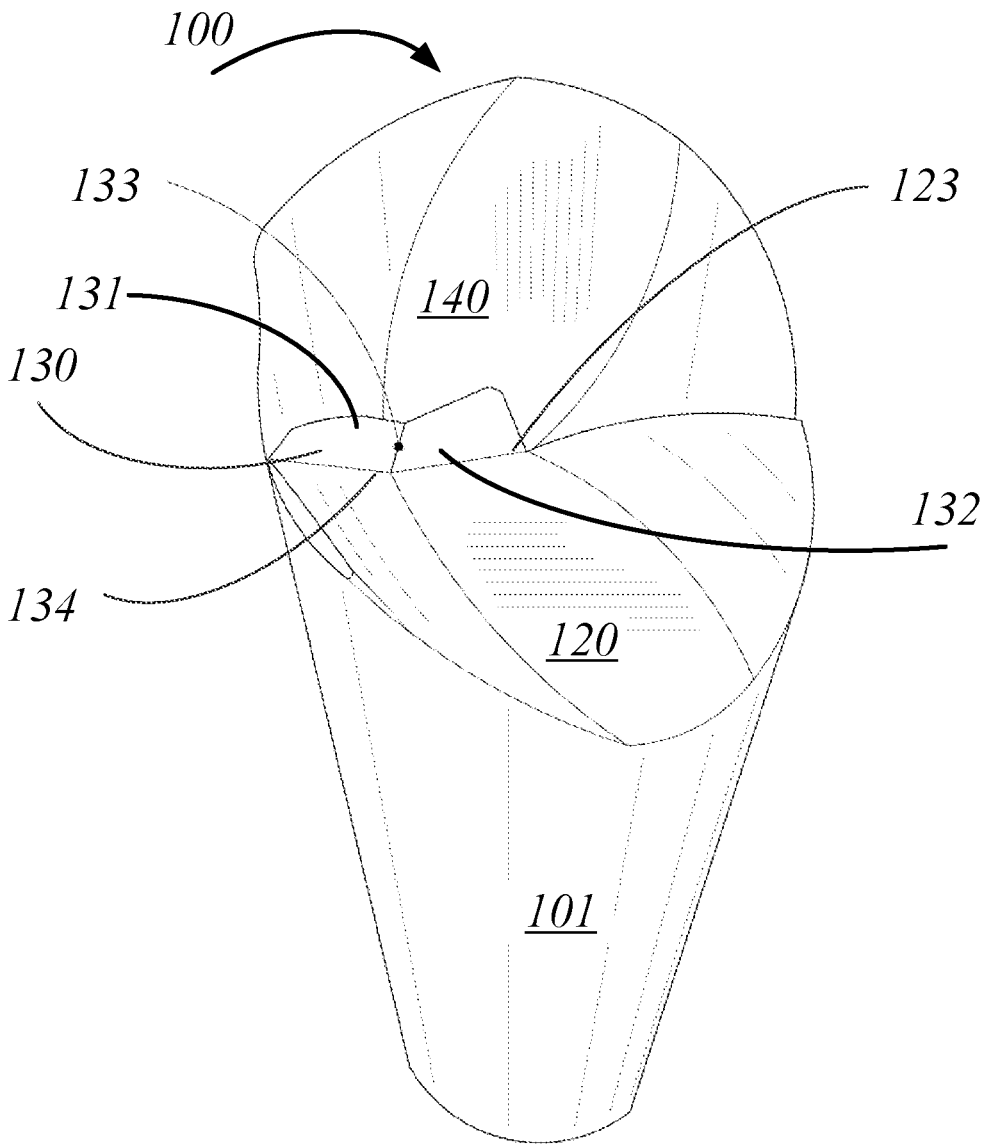
FIG. 2A schematically illustrates the embodiment of the vessel of FIG. 1 with one open flap and one closed flap.

FIG. 2A is a perspective view of the vessel of FIG. 1 with outer flap 140 open and inner flap 120 closed.

The flaps 120 and 140 are configured such that when both flaps are folded along their respective curved fold paths (121, 141), the outer flap 140 overlies the inner flap 120, and at least a portion of the outer edge 124 of the inner flap 120 may coincide with the scored path (designated 141) of the opposing outer flap 140, and the flaps 120 and 140 define an elevated pouring or drinking portion 197 having a spout 171 formed between an extension 102 of the base region 101 and at least one of the two flaps 120 and 140.

Flaps 120 and 140 each form a portion of both spout 171 and opposing peak 176. Spout 171 and opposing peak 176 are opposite one another in the upper region of the vessel. Accordingly, tilting vessel 100, for example, for consumption of a beverage contained therein through spout 171, moves the beverage away from the opposing peak 176.

Figure 2B:
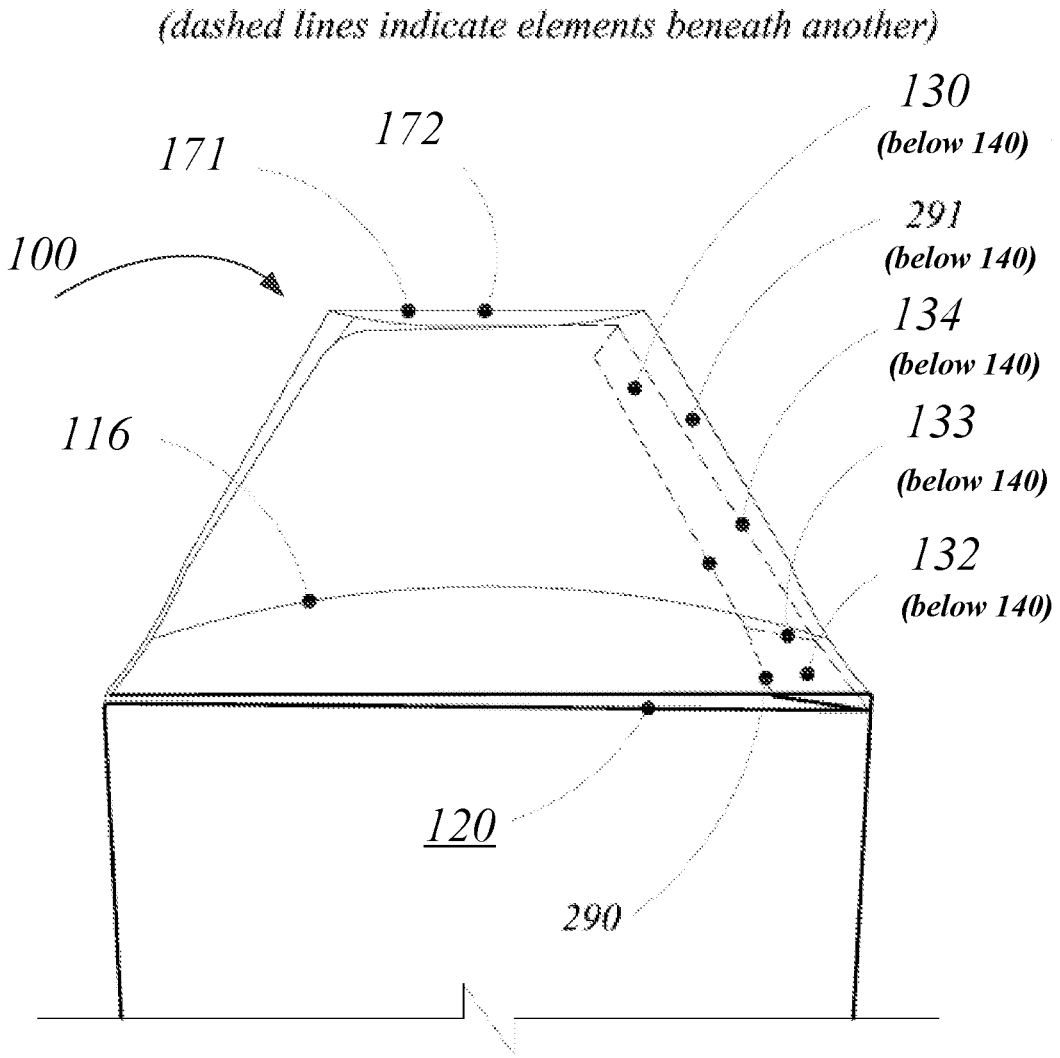
FIG. 2B schematically illustrates a cross-section of the vessel of FIG. 1.
Figure 6:
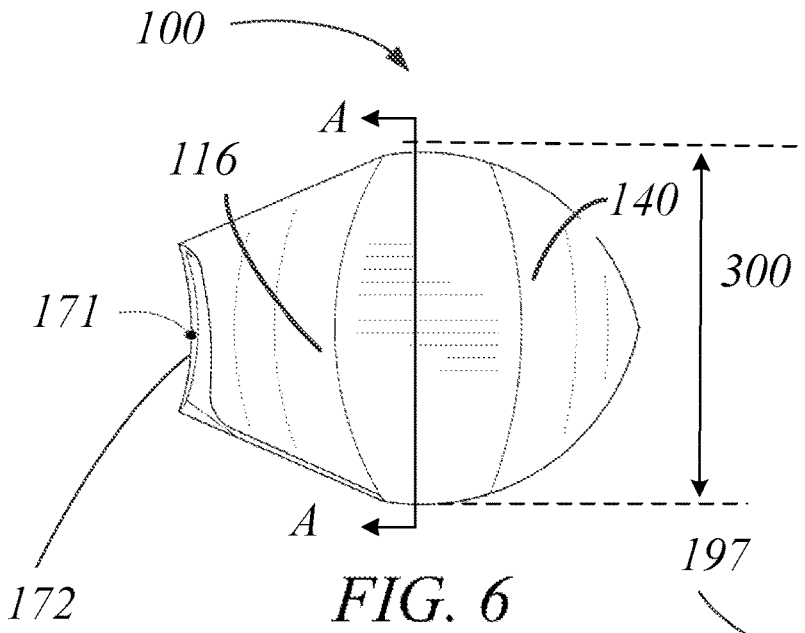
FIG. 6 schematically illustrates a top view of the vessel of FIG. 1.

The formation of spout 171 and opposing peak 176 are further schematically illustrated in FIG. 2B, which schematically illustrates a cross-section of vessel 100 along line A-A of FIG. 6. The outer flap 140 includes (optional) central score lines 116 in this embodiment. Central score lines 116 may be pre-formed into flap 140 in order to facilitate folding the flap into a closed configuration that accommodates the geometry of the vessel. In particular, the central score paths 116 delineate a relatively planar region 125 therebetween, and paths 116 delineate ascending regions 170 and 175 outside of flat region 125.

The inner flap 120 includes a dam tab 130 having a first portion 131 and a second portion 132, surrounding a "V" gap 133. The dam tab 130 is part of the inner flap 120, and extends from the portion of the inner flap 120 that is distal from the fold path 121. The dam tab 130 is delineated from remainder of the inner flap 120 by a corresponding folding path or crease 134. In some embodiments, wherein the inner flap 120 (including portions 131 and 132) is wider (width 301 in FIG. 4) than the width 300 (FIG. 6) of the vessel at the top 195 of the cup body 101, so that when the inner flap 120 (including the dam tab 130) is folded down, the inner flap's free edges (or outside edges) of portions 131 and 132 contact the opposing side wall 185 of the vessel 100 and this action further folds or bends the free dam tab 130 upward along the fold path 134, thus forming a "folded edge" dam 290.

When both flaps 120 and 140 are folded down, the dam tab 130 folds along the folding path 134 so as to lie between the inner flap 120 and the outer flap 140, as schematically illustrated in FIG. 2B. In the folded position, the dam tab 130 forms a dam (or "folded edge dam") 290 that extends along the edge of the inner flap 120 from the spout 171 towards (i.e., in the direction of) a center point 123 of the edge of the inner flap 120. In this embodiment, the folded edge dam 290 has two segments 131, 132 divided by a V shaped cut 133, such that when the inner flap 120 is folded down, the two segments 131, 132 of the folded edge dam 290 are raised or bent upward and fit together in a fashion closing the V shaped gap 133 between the segments, as schematically illustrated in FIG. 2A for example.

The dam 290 inhibits or prohibits the flow of liquid (or non-liquid substances) from the interior volume 188 of the vessel 100 to the space 136 sandwiched between the flaps 120 and 140. Indeed, the dam 290 and the sidewall 185 of the base 101 form a channel 291 for liquid (or non-liquid substances) that escapes the interior volume 188 of the vessel. The channel 291 extends along the spout 171 to the aperture 172, as indicated in FIG. 2B, for example.

Figure 3:
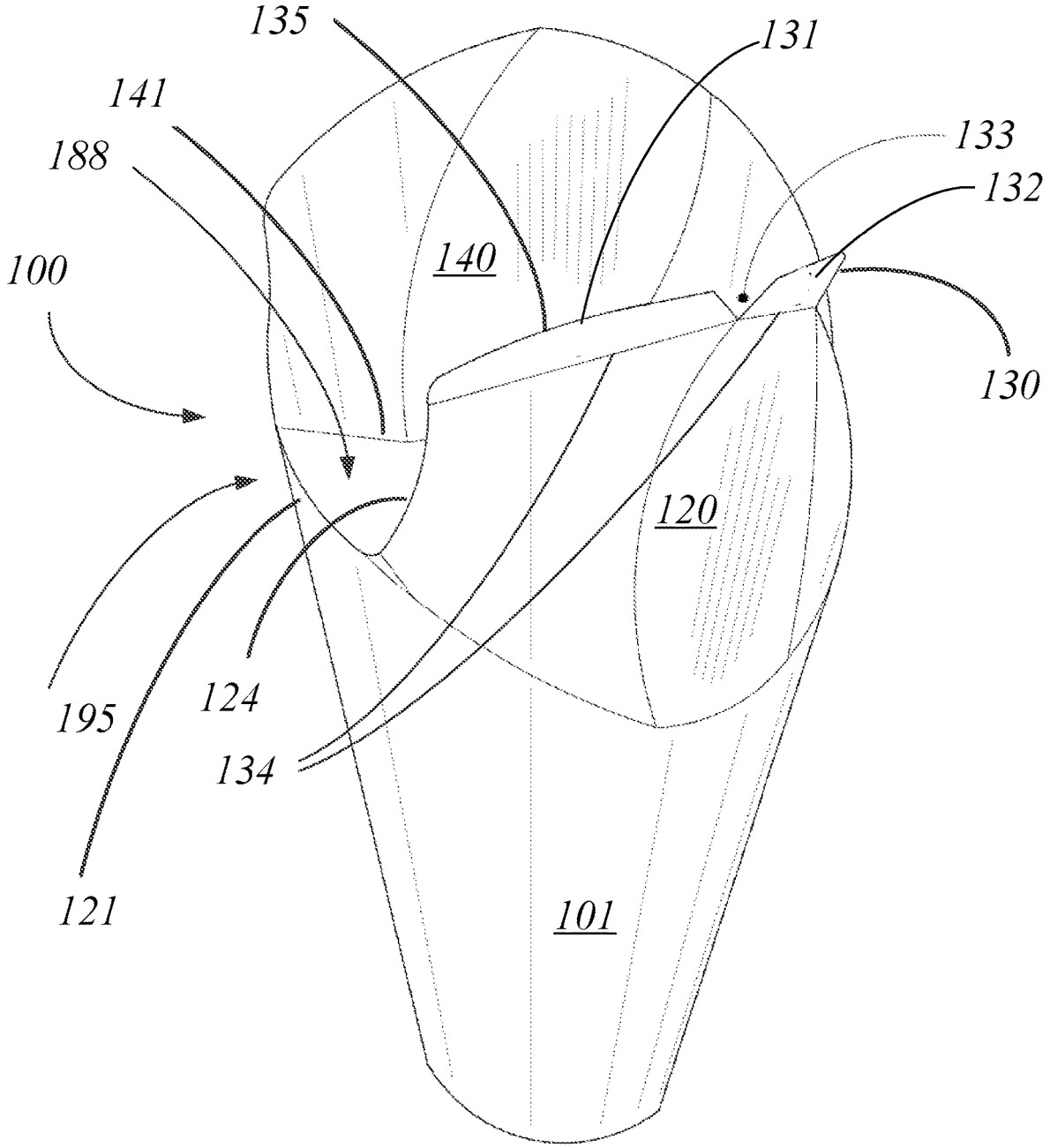
FIG. 3 schematically illustrates an embodiment of vessel with two open flaps.

FIG. 3 schematically illustrates a perspective view of the vessel of FIG. 1 in an open configuration, in which both flaps 140 and 120 are in unfolded positions. The flaps, which oppose one another, are more clearly seen in this configuration as an integral part of the vessel walls. Each flap extends directly from the base portion 101.

When both of the flaps 140, 120 of the vessel 100 are unfolded, as illustrated in FIG. 3, successive vessels may be stacked on one another. Such stacking permits compact storage of a large number of vessels and facilitates easily retrieving a single vessel from such a stack.

Figure 4:
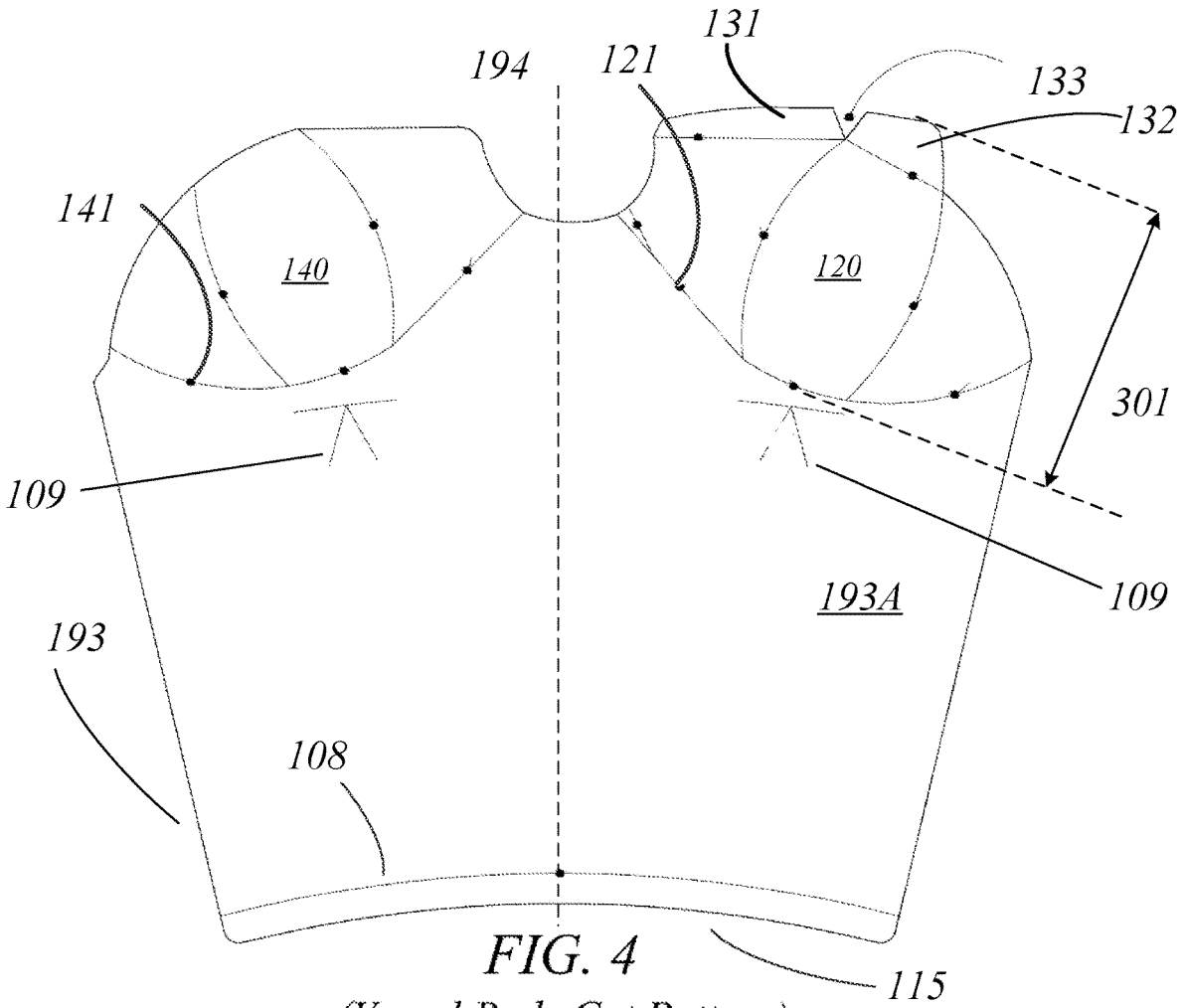
FIG. 4 schematically illustrates a blank configured for forming into a vessel such as the vessel of FIG. 1.

FIG. 4 schematically illustrates a sheet of flexible material 193, which may be referred to as a "blank," that may be used to form the base and flaps of vessel 100 of FIG. 1. As illustrated, the outline of the vessel is an asymmetric design (about line 194, which is not part of the sheet 193A of flexible material) formable into a vessel, having a frusto-conical shape with a flat bottom, and which also includes a top. To form the vessel, the outline may be cut along the periphery, scored along fold paths, rolled, and affixed. The bottom edge 115 of the outline forms the bottom edge of the vessel 100. Edge 115 is in the shape of an arc, which allows the vessel 100 to have a substantially flat base when formed. The various fold paths may be scored prior to formation of the vessel to guide folding of the vessel into the proper configuration.

Figure 5:
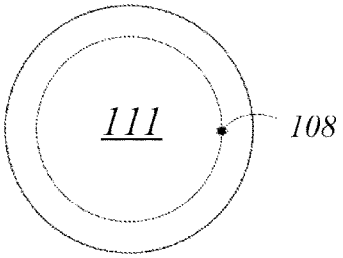
FIG. 5 schematically illustrates the bottom member of the vessel of FIG. 1.

FIG. 5 illustrates a bottom 111 for the vessel 100. The bottom 111, generally circular, may have a different diameter based on the dimensions of the vessel. For example, to increase the volume of the vessel the dimensions may be altered and the bottom may have a larger diameter. The bottom 111 of the vessel 100 may be affixed in the opening in the lower region of the base portion 101 when the sheet 193 is rolled. This enables the vessel 100 to retain a liquid (or non-liquid substances) placed therein via an opening in the upper region of the vessel when the flaps are unfolded. In some embodiments, the bottom may be a part of the same sheet forming the vessel.

FIGS. 6-11 illustrate different views of the vessel 100 of FIG. 1. FIG. 6 is a top view of the vessel 100. In this figure the spout 171 is visible. As schematically illustrated, the spout 171 and the opposing peak 176 are located at opposing extremities of vessel 100 and are formed from the folding flaps, of which flap 140 is visible. The folded flaps 120, 140 also form an integral cover for vessel 100.

Figure 7:
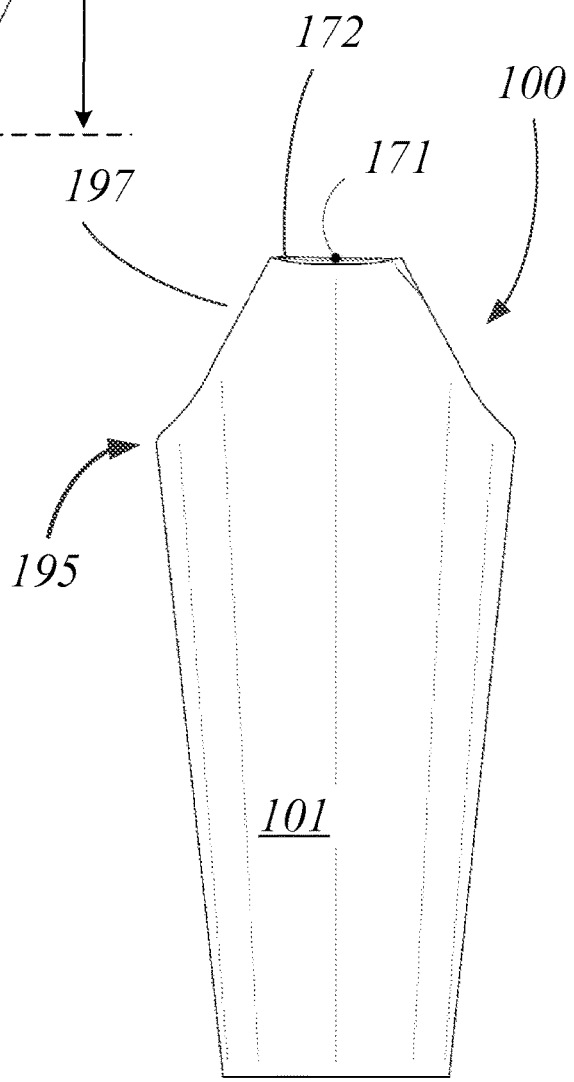
FIG. 7 schematically illustrates the front side of the vessel of FIG. 1.

FIG. 7 is a front view of the vessel. The term "front" in this description refers to the side having an elevated pouring or drinking portion and a spout 171.

Figure 8:
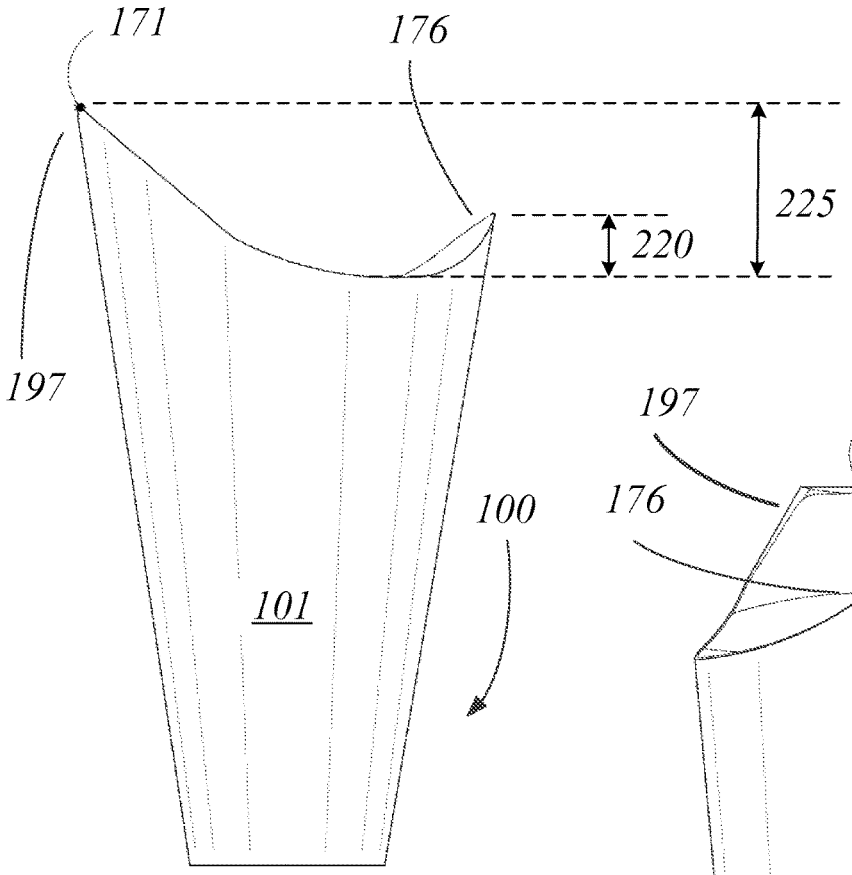
FIG. 8 schematically illustrates the left side of the vessel of FIG. 1.
Figure 9:
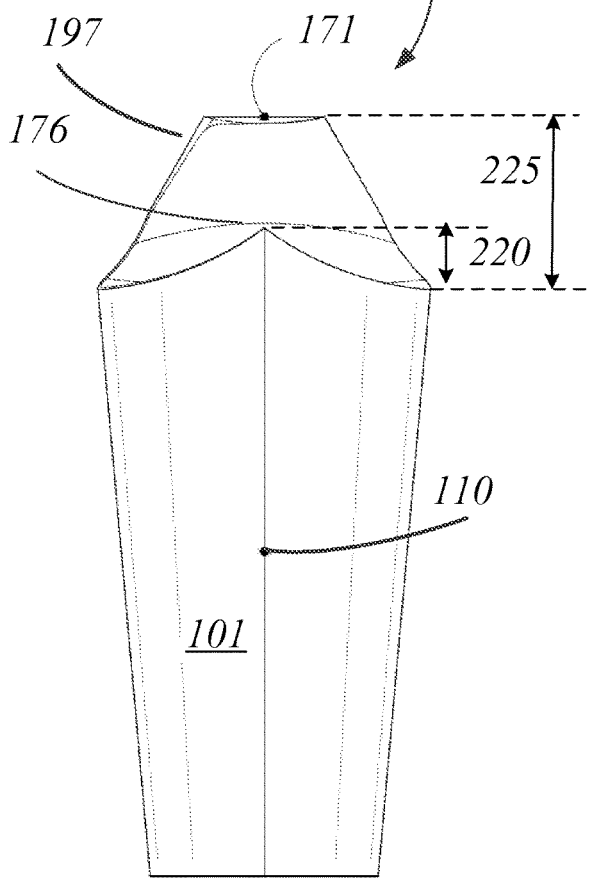
FIG. 9 schematically illustrates the back side of the vessel of FIG. 1.

FIG. 8 is a side view (denominated the "left" side) of the vessel 100, and FIG. 9 is back view of the vessel 100 of FIG. 1. In the embodiment illustrated, the opposing peak 176 is at a lower elevation (220), relative to the base 101 of the vessel 100, than the spout 171. In other words, the aperture 172 of the spout 171 has an elevation (225), relative to the base 101 that is greater than the elevation 220 of the opposing peak 176. Preferably, the elevation 225 of the aperture 172 is at least 2 centimeters above the planar region 125. This allows room between the spout 171 and the planar region 125 for a user's nose, e.g., between the spout 171 and opposing peak 176. In addition, the elevation (220) of the opposing peak is preferably at least 1 centimeter below the elevation (225) of the spout, so the opposing peak will not contact the user's face if the user tilts the vessel 100 while drinking liquid from the vessel 100.

Seam 110, as shown in FIG. 9, represents the overlap of the edges of form 193.

Figure 10:
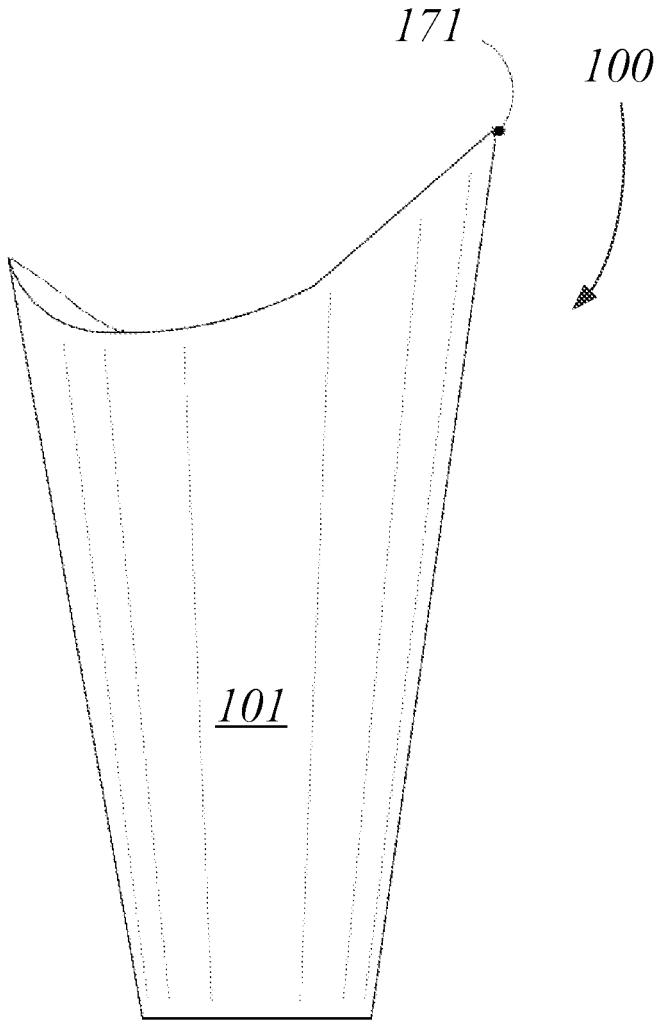
FIG. 10 schematically illustrates the right side of the vessel of FIG. 1.

FIG. 10 is a side view of the vessel 100 of FIG. 1. As further illustrated in this profile view, the spout 171 is formed similar to cups that facilitate sipping a beverage through a narrow opening.

Figure 11:
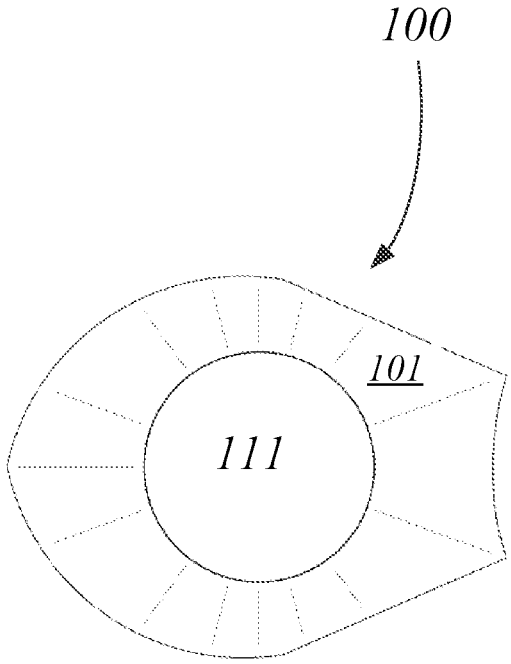
FIG. 11 schematically illustrates the bottom of the vessel of FIG. 1.

FIG. 11 is a bottom view of the vessel 100 of FIG. 1. Once a bottom 111 is secured to the opening in the base region 101 of vessel 100, for example by gluing, the vessel will be able to contain liquids (or non-liquid substances) placed therein without leakage.

Figure 12A:
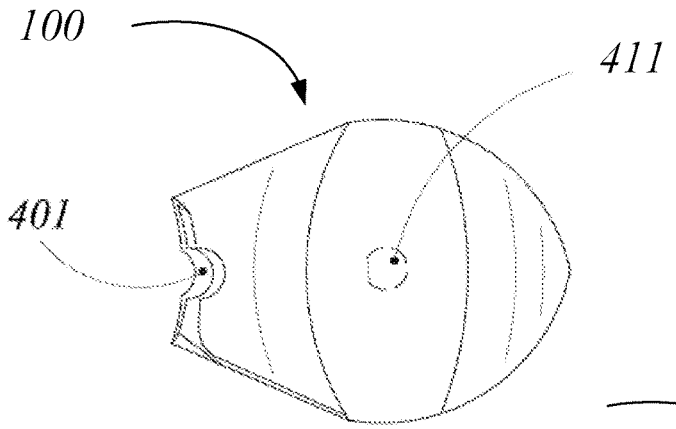
FIGS. 12A-12C schematically illustrate embodiments of serrations for forming or enlarging apertures in the vessel.
Figure 12C:
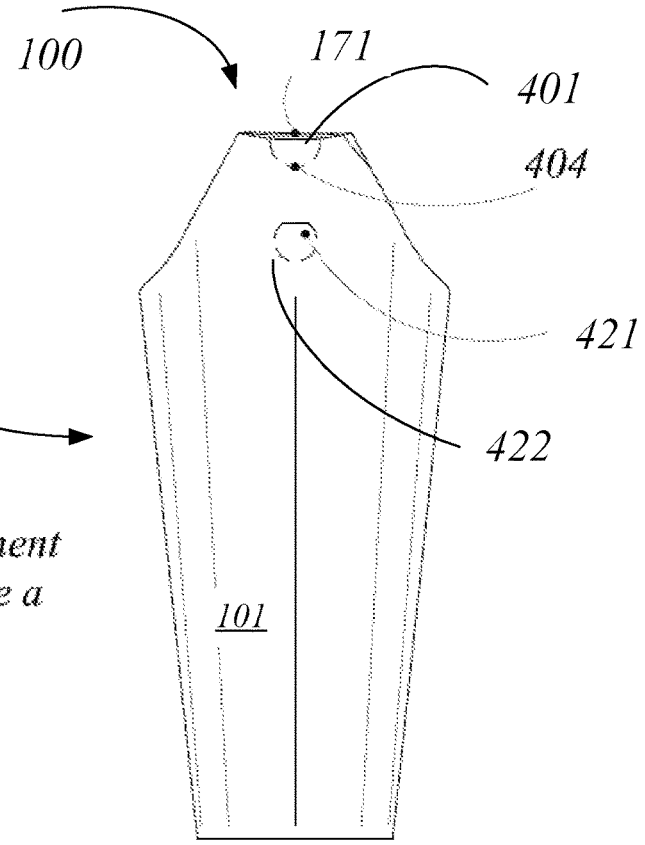
Figure 12B:
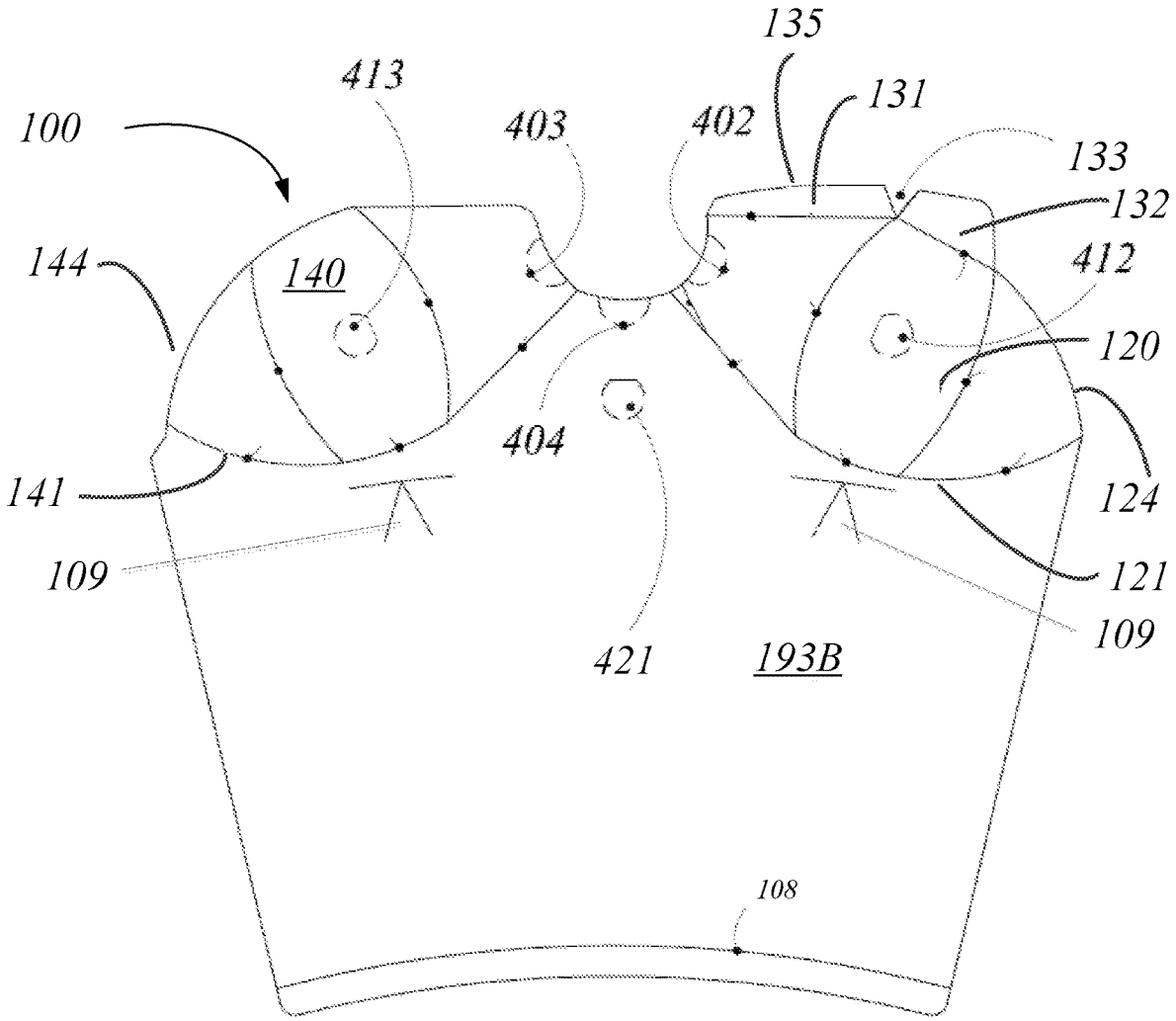

Under some circumstances the user of the vessel may desire to insert a straw. This could be accomplished by inserting the straw in the spout hole 172. To facilitate this insertion, some embodiments include serration 401 in the spout 171 as schematically illustrated in FIG. 12A, configured to be torn, compressed, stretched, or otherwise distorted to allow a larger opening in the spout 171. The serration 401 may include individual serrations 402 and 403 in each of flaps 120 and 140, configured to overlap one another when the flaps 120 and 140 are folded, to form serration 401. Alternatively, some embodiments include circular serrations 412 and 413 in the top of the vessel (FIG. 12B), configured to overlap one another (i.e., to form cooperating apertures) when the flaps 120 and 140 are folded. Circular serrations 412 and 413 are configured to be pushed through to form cooperating aperture to allow the formation of a straw hole 411A (FIG. 12A), could be included in the manufacture of the vessel 100. Some embodiments include circular serrations 404 and/or 405 (FIGS. 12B and 12C), which are also configured to be pushed through to allow the formation of straw holes 411B, 411C, respectively, so as to allow a straw to access the interior volume 188 of the vessel 100.

Figure 14A:
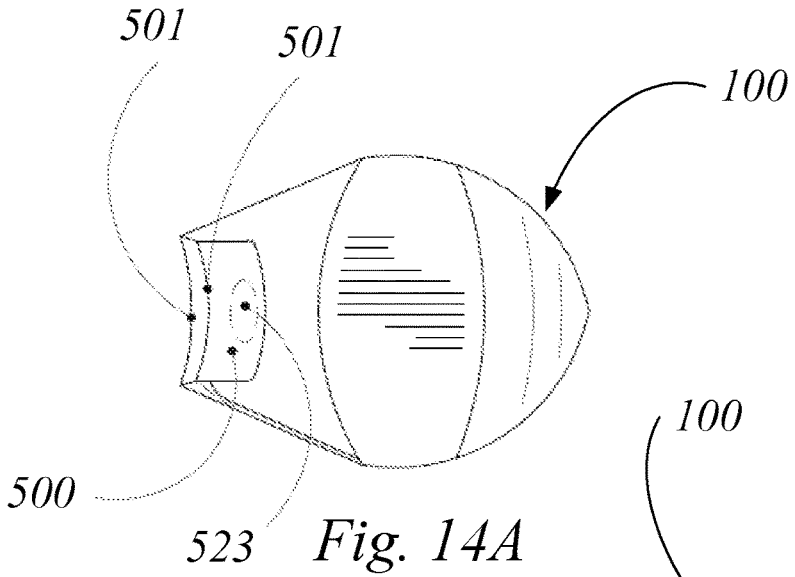
FIGS. 14A-14E schematically illustrate an embodiment of a vessel having a spout cover.
Figure 14B:
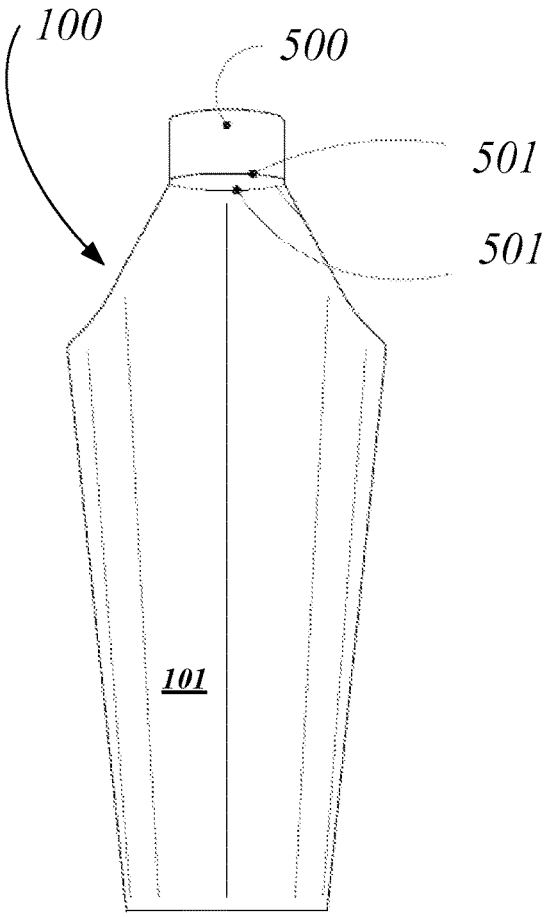
Figure 14C:
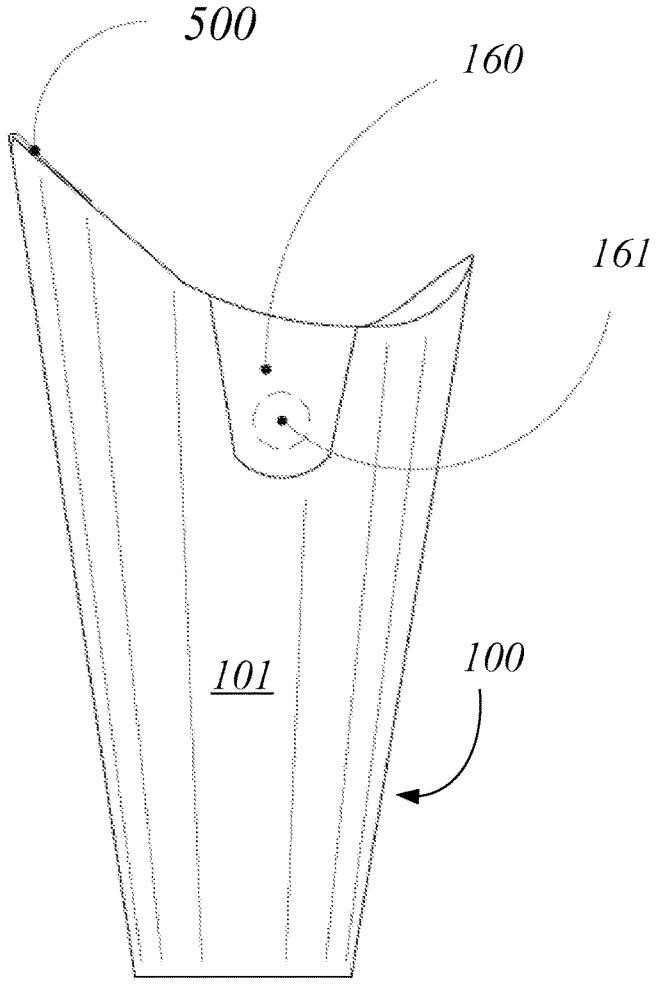

Under some circumstances the user may wish to enhance the spill resistance properties of the vessel through the use of closure tabs 160. These tabs could secure the outer flap 140 to the body 101. In this embodiment, tab 160 is formed as an integral part of the sheet from which the vessel 100 is formed and protrudes from an edge of outer flap 140 (FIG. 14B; FIG. 14C). The sheet includes a scored line or fold path 162 at the intersection of closure tab 160 and flap 140 to facilitate folding of the tab 160. The tab 160 may include an adhesive 161 on the side adjacent to the base 101 when folded in order to help maintain the cover 140 in a closed configuration, in which case the tab 160 may be referred to as an "adhesive tab."

Alternately, or in some embodiments, in addition, the adhesive 161 may be on the outer surface of the base 101, positioned to engage the tab 160 when the tab 160 is folded down alongside the base 101. The adhesive 161 is capable of repeatedly securing the tab 160 to the base 101 and repeatedly being removed from base 101. The tab 160 may therefore be described as "releasably" secured to the base 101, and adhesive 161 may thus be referred-to as a "multi-stick adhesive."

Figure 14D:
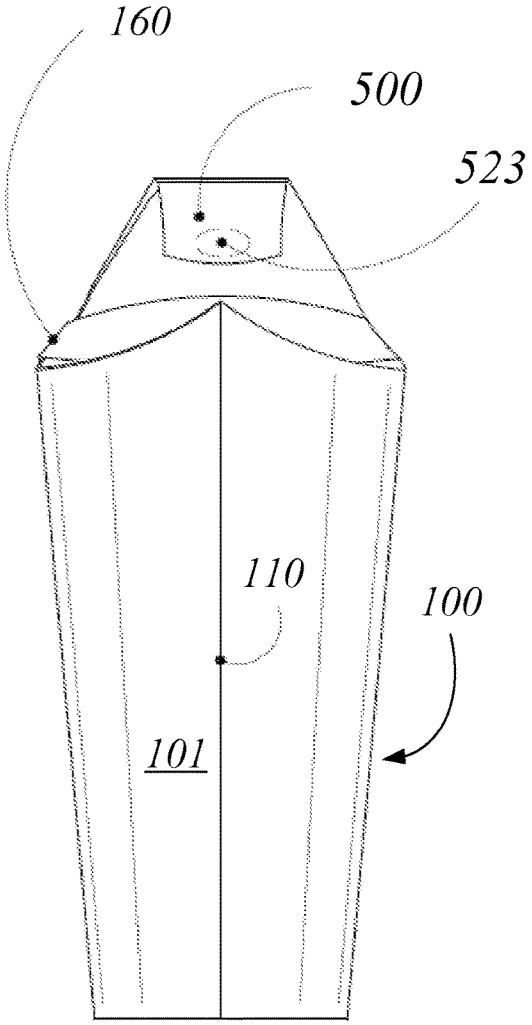
Figure 14E:
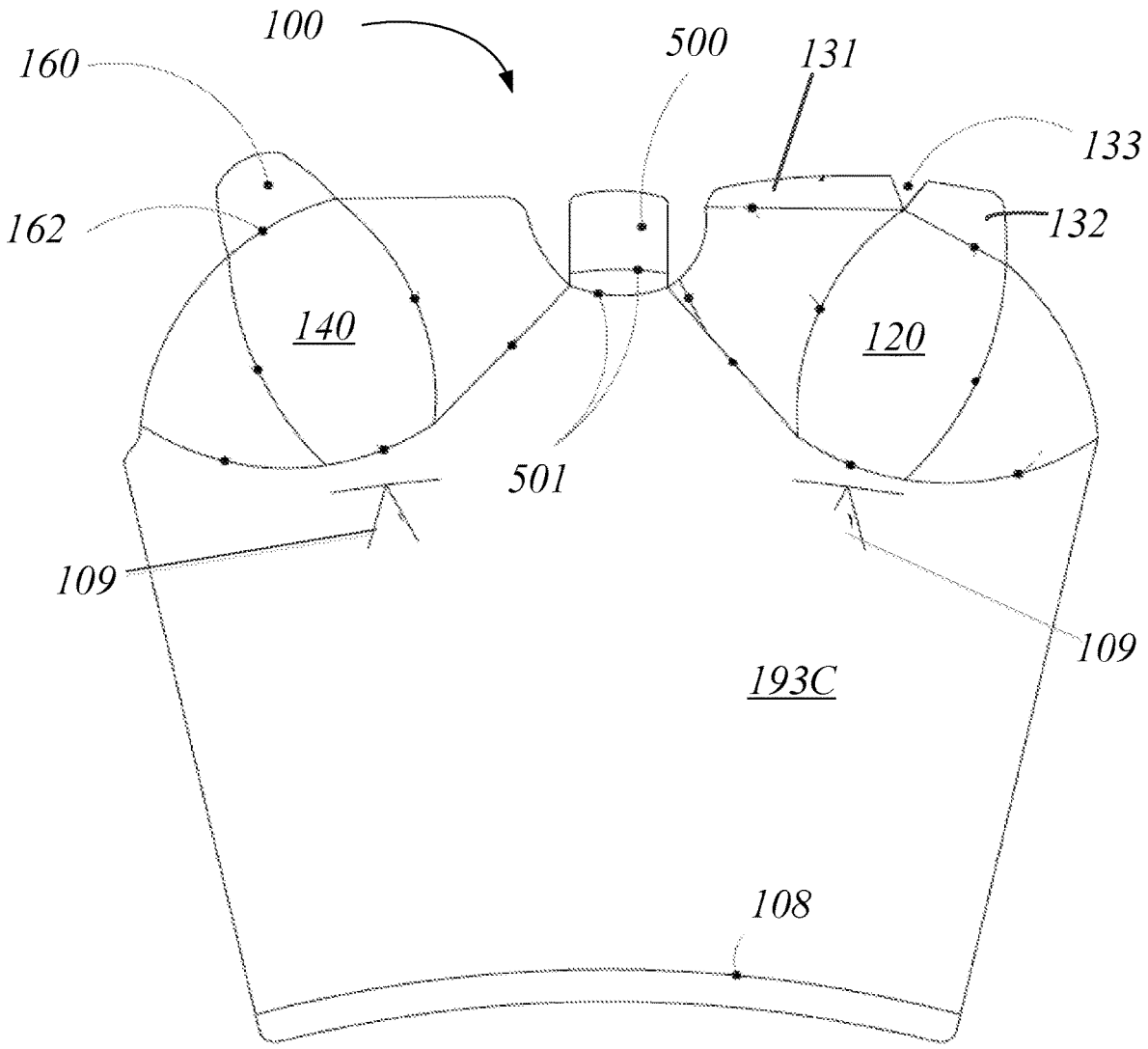

In some embodiments, the vessel 100 may include a cover, folding tab, plug or clip for end of spout 171 to impede flow through the spout opening 172 when not in use. For example, FIGS. 14A-14E are similar to FIGS. 4, and 6-9, as indicated by common reference numbers, but also include a spout cover tab 500 with a multi-stick adhesive 523. Tab 500 is configured to be folded over and cover the spout aperture 172 when the spout aperture 172 is not in use for an extended period of time. The adhesive 523 releasably attaches the spout cover tab 500 to the spout so that the spout cover tab 500 may be lifted to expose the spout aperture 172. When folded, the spout cover tab 500 may form a seal with the spout 171 to impede the flow of liquid (or non-liquid substances) through the aperture 172. FIG. 14A schematically illustrates a top view of a vessel 100 with a spout cover tab 500 folded over the aperture 172 of the spout 171. FIG. 14B schematically illustrates a front view of the vessel 100 with the spout cover tab 500 in the open, or up, position. FIGS. 14C and 14D illustrate, respectively, a left view and a back view of the vessel 100 with the tab 500 in the closed position. FIG. 14E schematically illustrates a blank 193C configured for forming into a vessel 100 having a tab 500.

Figure 15:
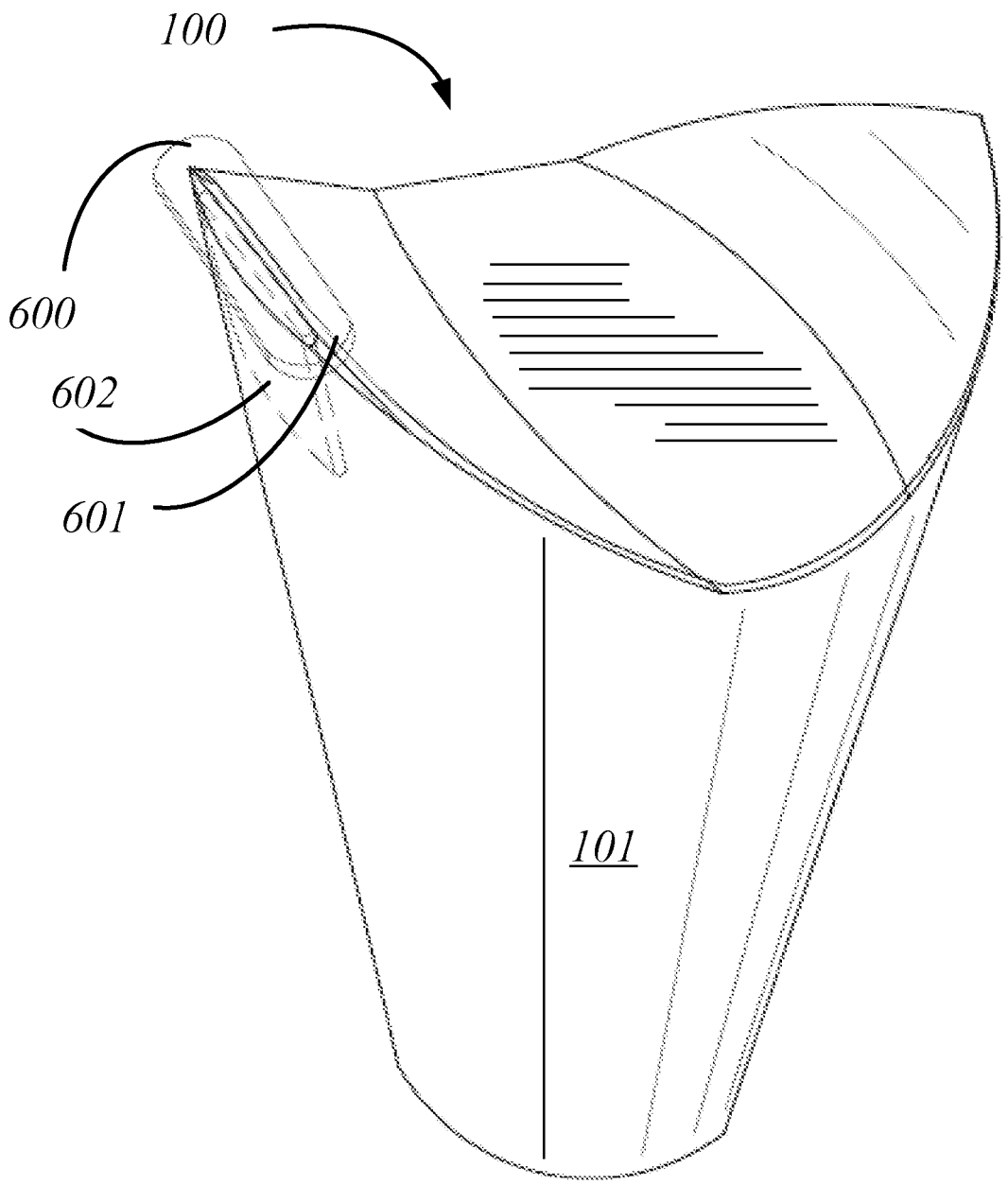
FIG. 15 schematically illustrates an embodiments of a vessel having a plug closure.

Alternatively, a cap or plug may serve to close the spout opening 172 when not in use. For example, FIG. 15 schematically illustrates a vessel 100 having a plug closure 600 within the aperture 172 of the spout 171. The plug closure 600 includes a plug base 601 and a stopper portion 602. The stopper portion 602 is configured to fit within and through the aperture 172 of the spout 171, while the plug base 601 is larger than the areal dimension of the aperture 172 of the spout 171, and so prevents the plug closure 600 from sliding through the aperture 172 of the spout 171. In some embodiments, the stopper portion 602 is configured to fit snugly into the aperture 172 so as to seal the aperture 172 and form a "friction fit" or "press fit" with the spout 171.

Figure 13:
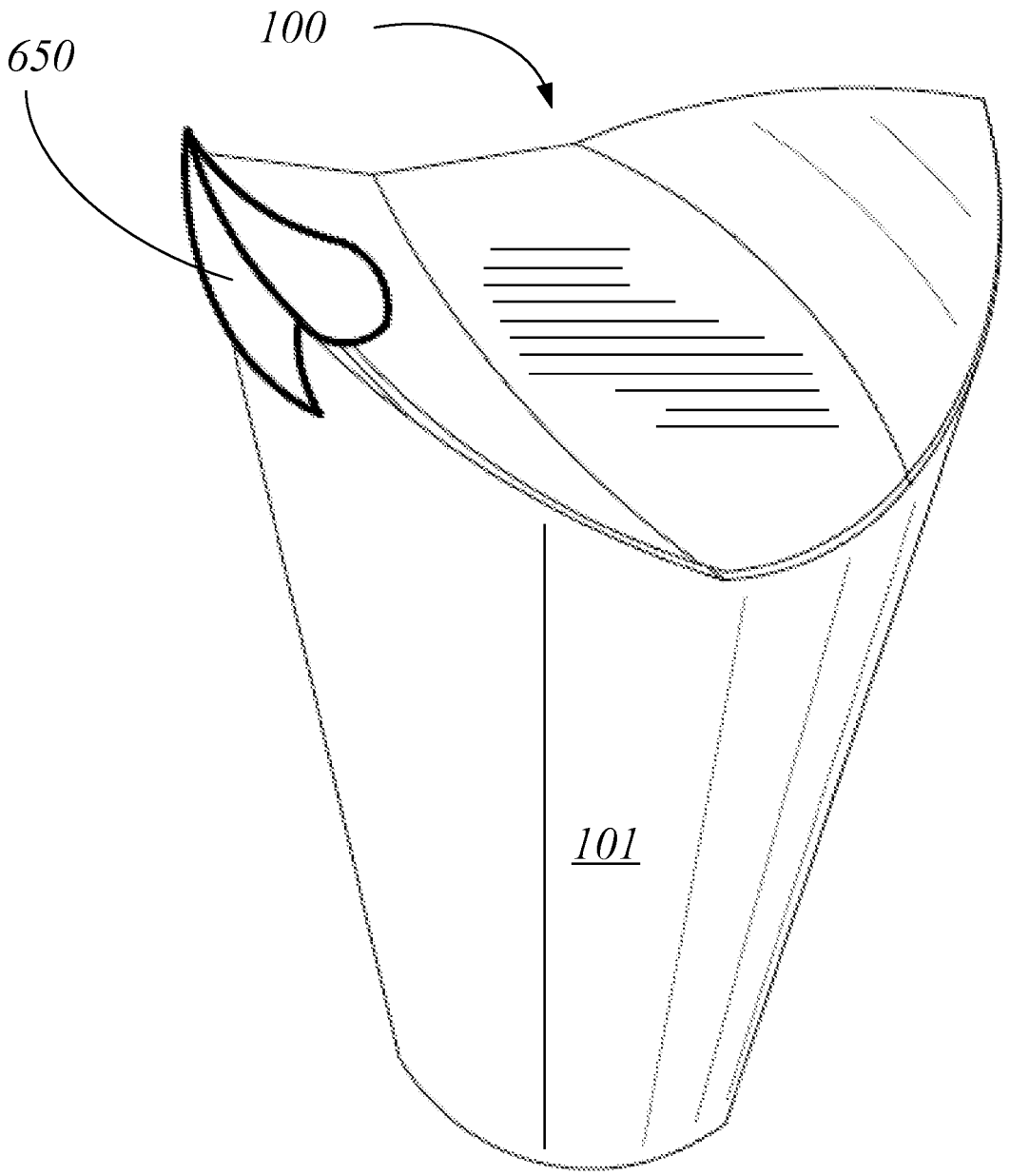
FIG. 13 schematically illustrates an embodiment of a vessel having a cap closure.

FIG. 13 schematically illustrates a vessel 100 with a cap closure 650 configured to be removably coupled to the spout so as to cover and close the spout aperture 172. The cap closure 650 is formed from a malleable material, such as a metal foil for example. To close the spout 171, a user applies the cap closure 650 to the spout 171 and squeezes the cap closure 650 to form it around the spout 171, and to compress a portion of the spout 171 so as to close and seal the spout aperture 172.

Other Embodiments

As mentioned above, a dam tab 120 may be one segment. An embodiment of a single-segment dam tab 130 is schematically illustrated in the embodiment schematically illustrated in FIGS. 16A-16S. This embodiment shares many of the features described above, as shown by common reference numbers.

Figure 16A:
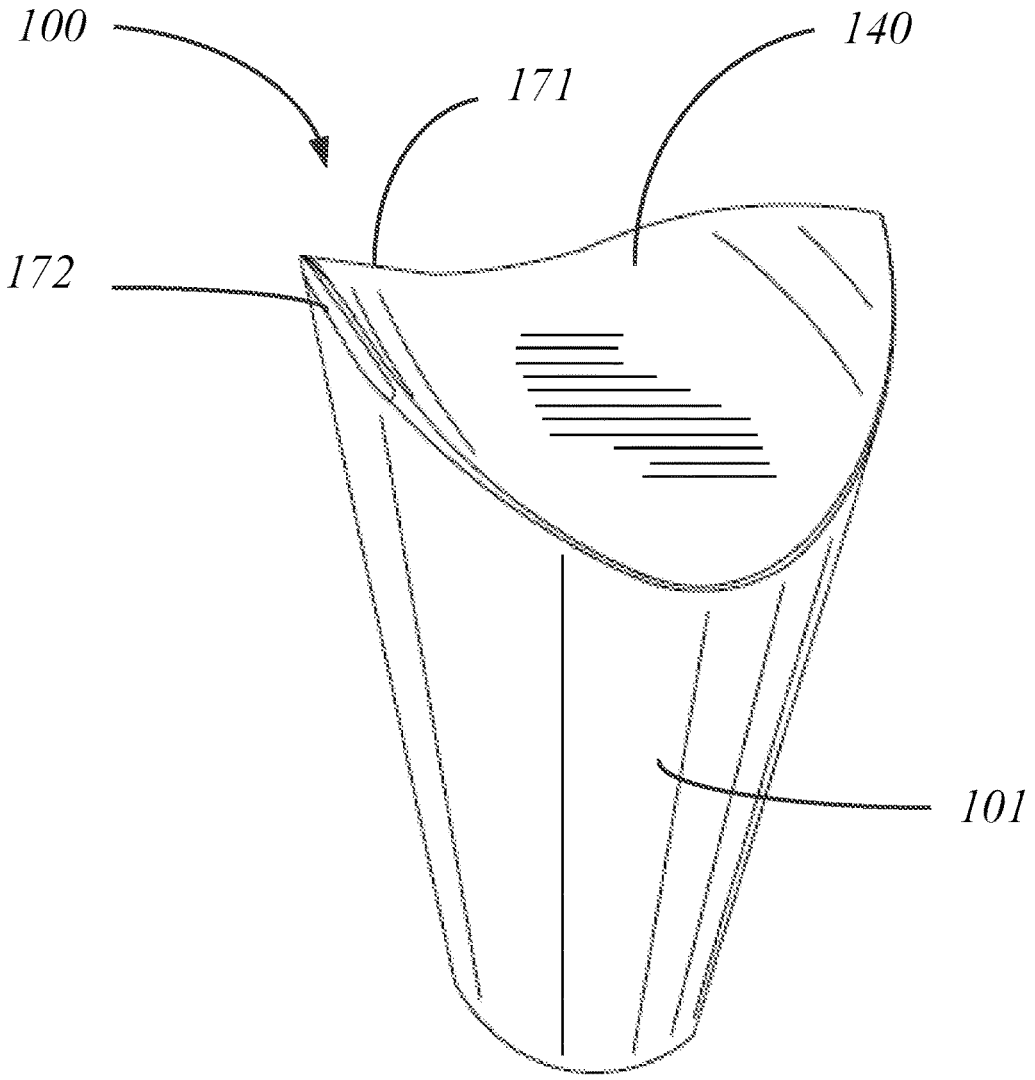
FIGS. 16A-16S schematically illustrate an alternate embodiment of a vessel.
Figure 16B:
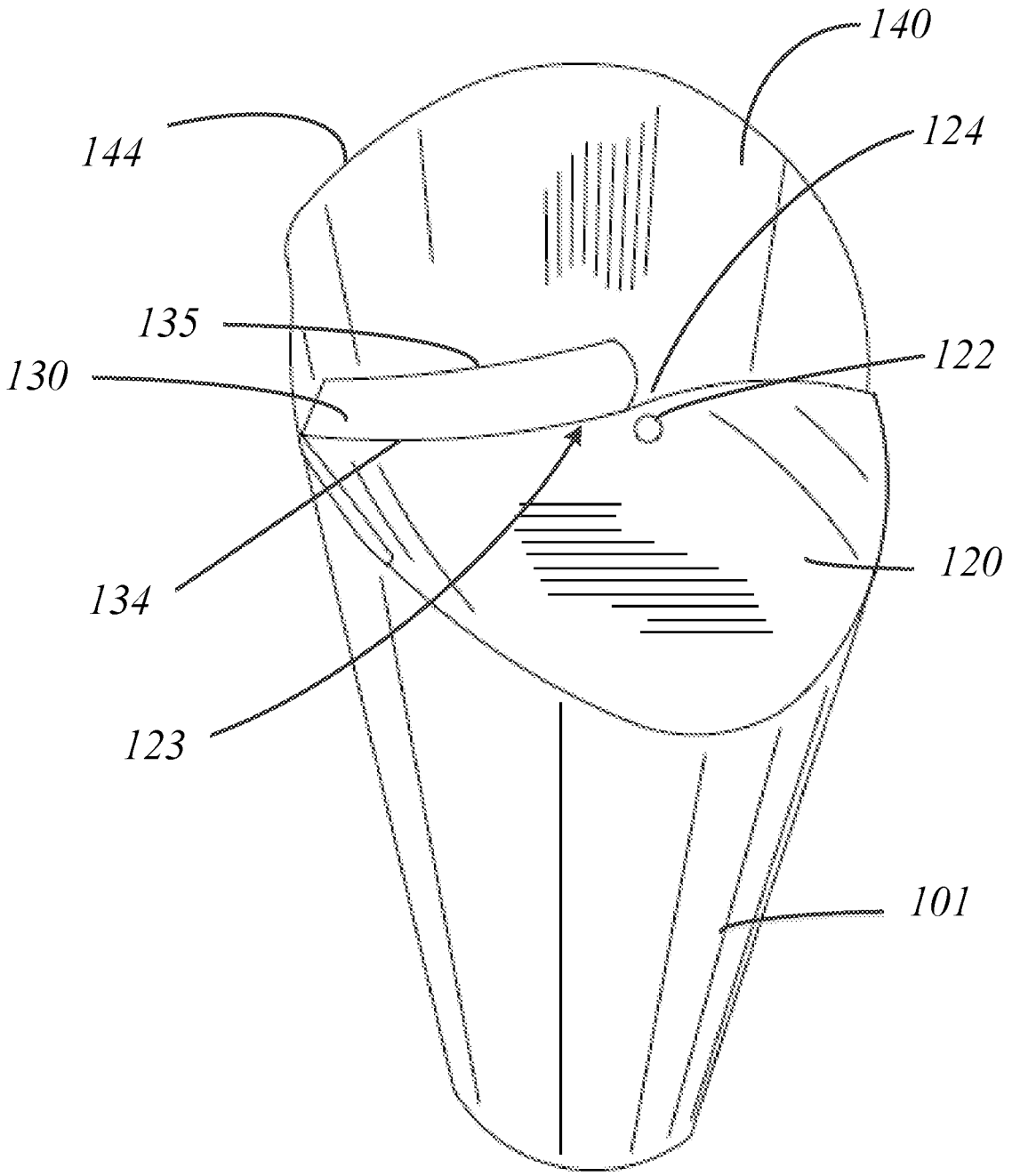
Figure 16C:
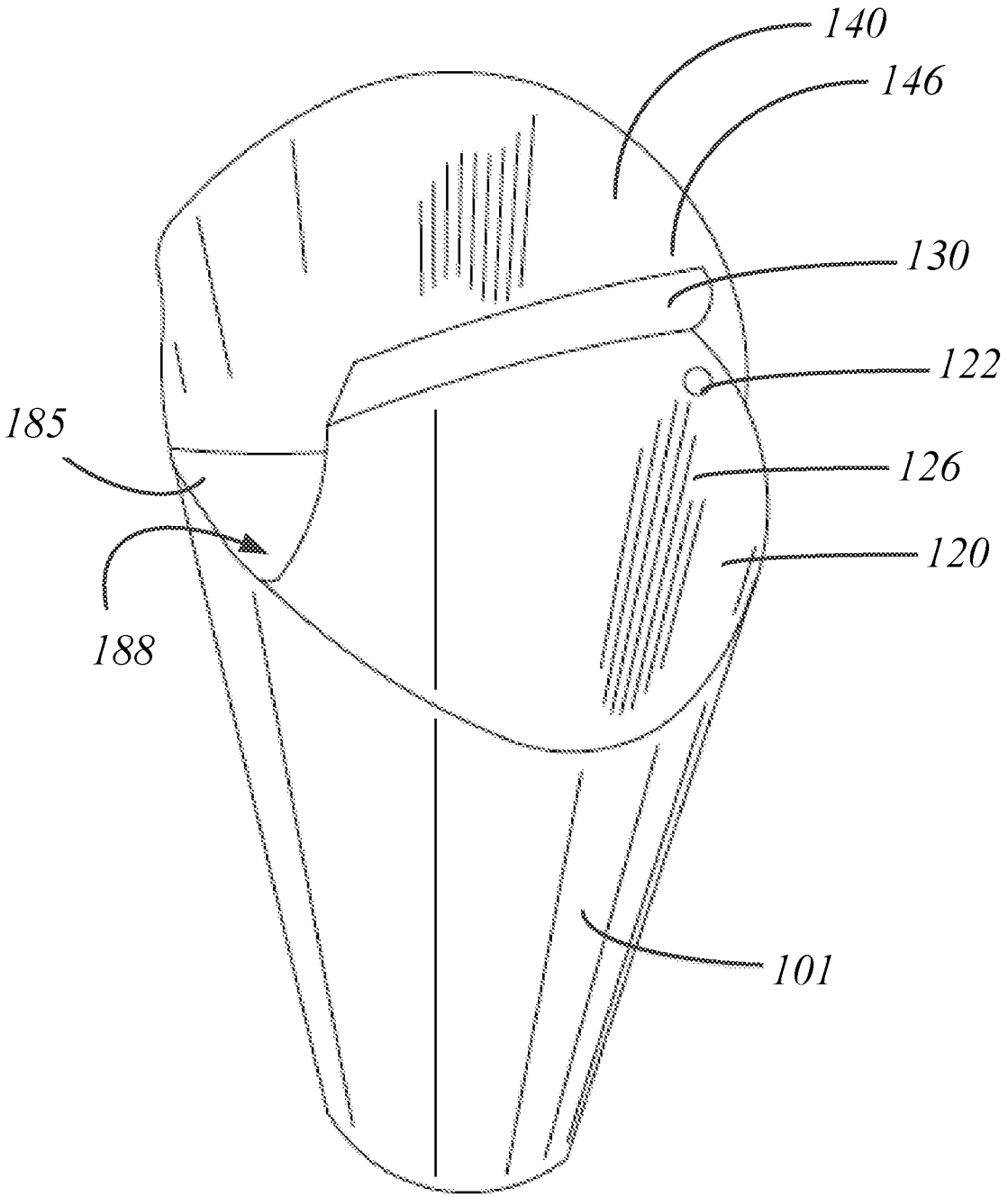

FIG. 16B schematically illustrates a vessel 100 with inner flap 120 and outer flap 140. The inner flap 120 includes a single-segment dam tab 130, which has a length 130L defined by the folding path, or crease, 134. The dam tab 130 has a width 130W defined in a direction perpendicular to the folding path or crease 134. The length 130L is greater than the width 130W, and in in some embodiments, the length 130L may be at least 2 times the width 130W, or in various embodiments may be 3 times, 4 times, 5 times or more the width 130W. In addition, the dam tab 130 may extend at least from the center point 123 of the edge (124 and 135) of the inner flap 120 to the spout 171, and may extend up the spout to or near to the spout opening 172.

The width 301 of the inner flap 120, which includes the dam tab 130, is greater than the width 300 of the top 195 of the vessel 100, so that when the inner flap 120 is folded down, as schematically illustrated in FIG. 16B, the dam tab 130 folds upward, away from the inner volume 188 of the vessel. When the outer flap 140 is folded down, the dam tab 130 is disposed between the inner flap 120 and the outer flap 140, to form a folded edge dam 290. In such a configuration, the folded edge dam 290 is in physical contact with the inner sidewall 185 of the base 101 of the vessel, along the fold path 134.

Figure 16D:
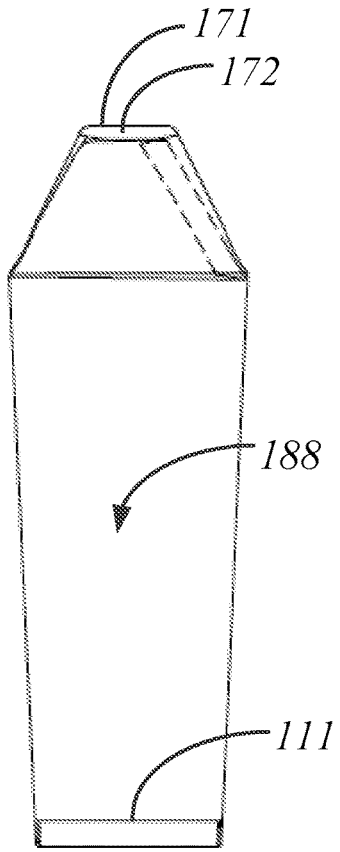
Figure 16E:
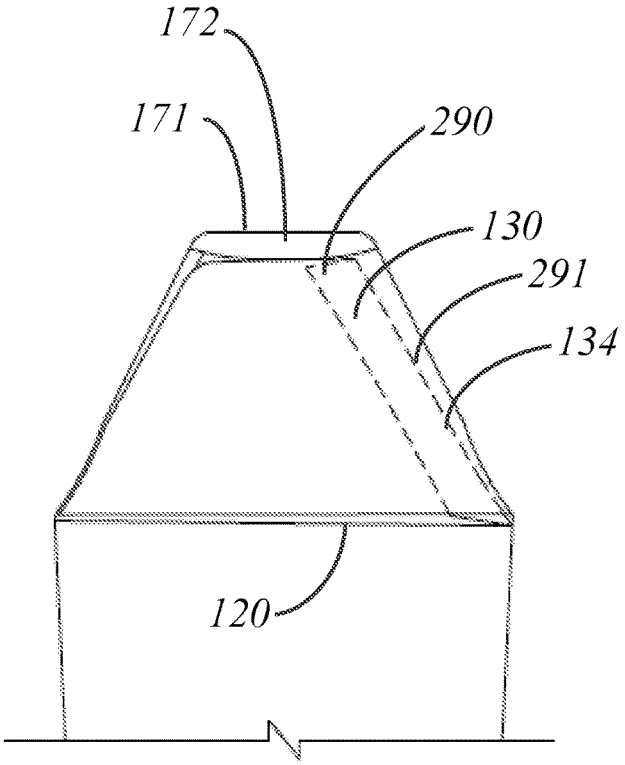

The dam 290 and the sidewall 185 of the base 101 form a channel 291 for liquid (or non-liquid substances) that escapes the interior volume 188 of the vessel 100. The channel 291 extends along the spout 171 to the aperture 172, as indicated in FIG. 16D and FIG. 16E, for example. The channel 291 directs such escaped liquid or non-liquid substances towards the spout opening 172 when the vessel 100 is being used for drinking or pouring those substances.

In some embodiments, some edges and/or fold lines/creases/score lines of the flaps and vessel may be waterproofed, or have an additional layer of waterproofing coating 114. For example, as schematically illustrated the in embodiment in FIG. 16N, edge 124 of inner flap 120 (which includes the edge 135 of the dam tab 130) and/or edge 144 of outer flap 140 and/or the edge 127 between the inner flap 120 and outer flap 140 and/or the fold lines/scoring (134) that delineates the dam tab 130 from the remainder of the inner flap 120, may be coated or impregnated with (additional) waterproofing material 114 such as a polylactic-acid-based compound, or a polyethylene-based compound, to name but a few examples.

In the event that any content of vessel escapes the volume 188 of the vessel 100 and finds its way between the folded inner flap 120 and outer flap 140, the escaped content may flow back into the volume 188 of the vessel through the drain aperture 122. Several of the embodiments shown and described herein schematically illustrate a drain aperture 122 through an inner flap, but it should be noted that the drain aperture is optional in all embodiments, and may be included in, or omitted from, any inner flap.

Figure 16F:
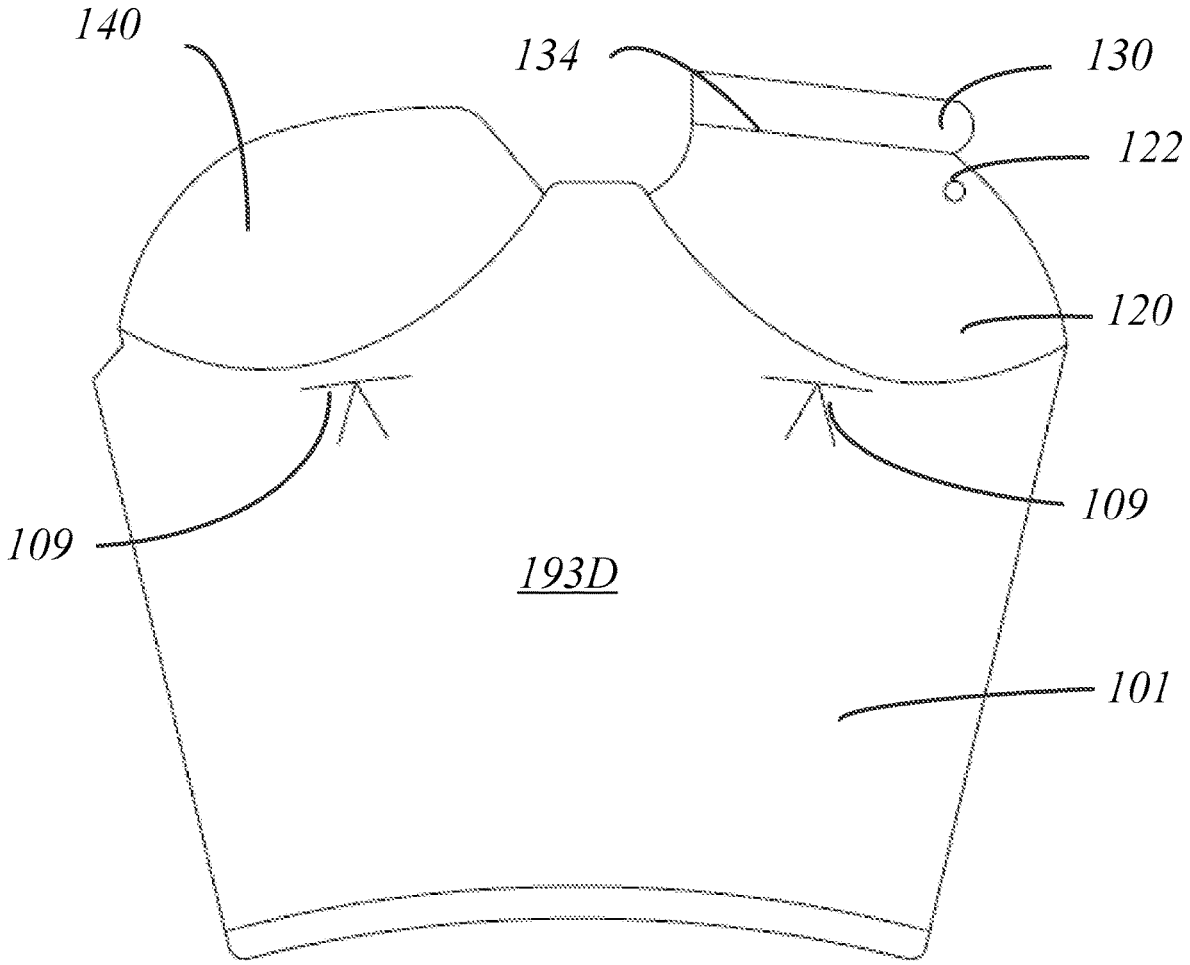
Figure 16G:
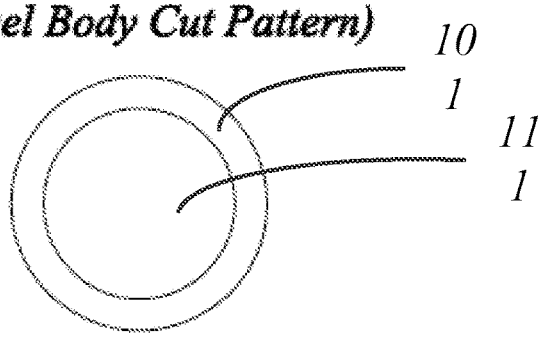

FIG. 16F schematically illustrates a sheet, or blank 193D, from which a vessel 100 may be formed by, for example, rolling the form into a frusto-conical shape and closing the flaps 120 and 130. In this embodiment, the blank 193D schematically illustrates the outer flap 140, the inner flap 120, including the dam tab 130, as well as the drain aperture 122. A similar blank 193F, omitting the drain aperture 122, is schematically illustrated in FIG. 16O.

Figure 16H:
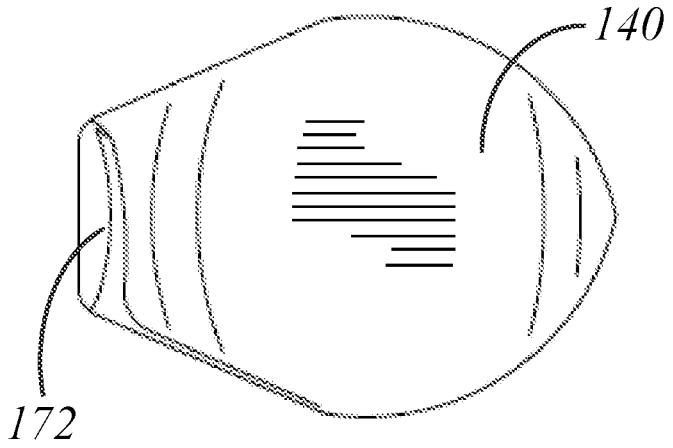
Figure 16I:
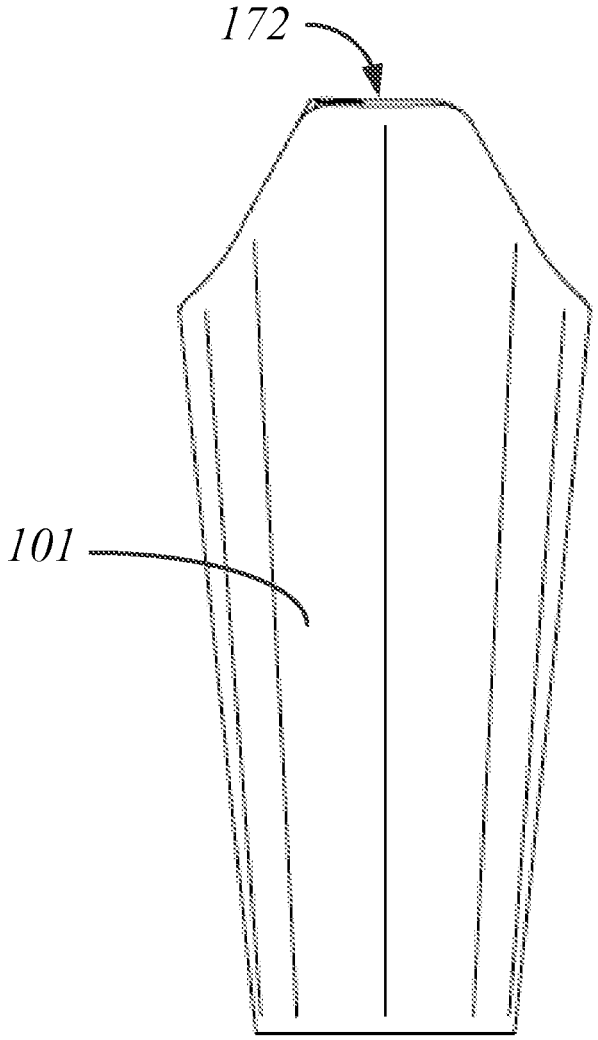
Figure 16J:
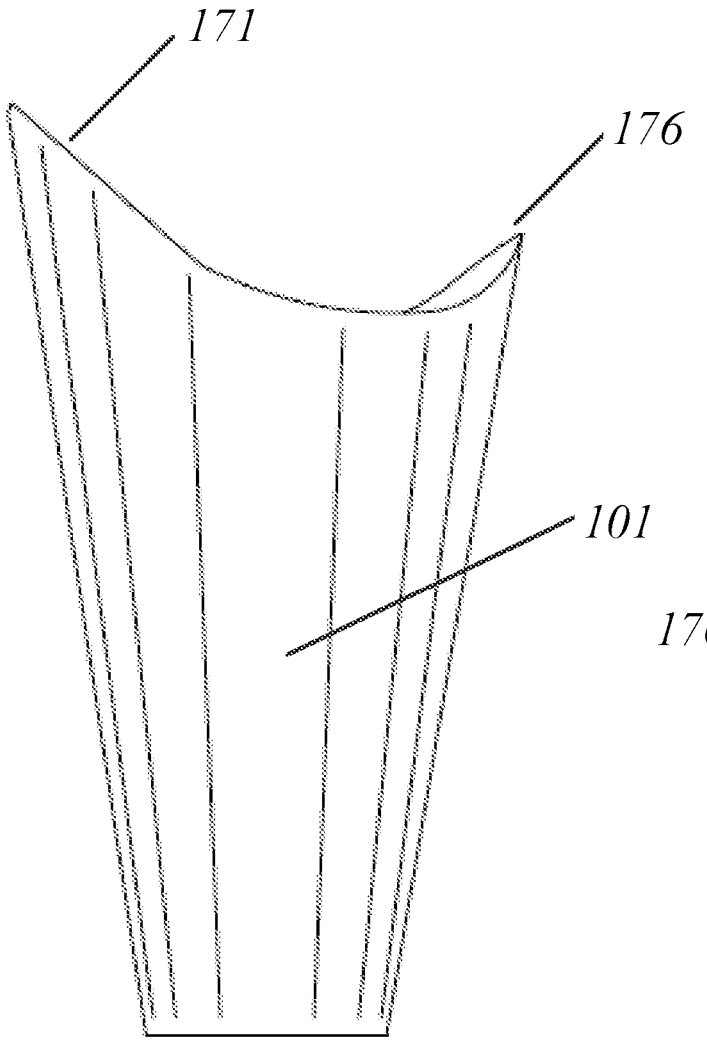
Figure 16K:
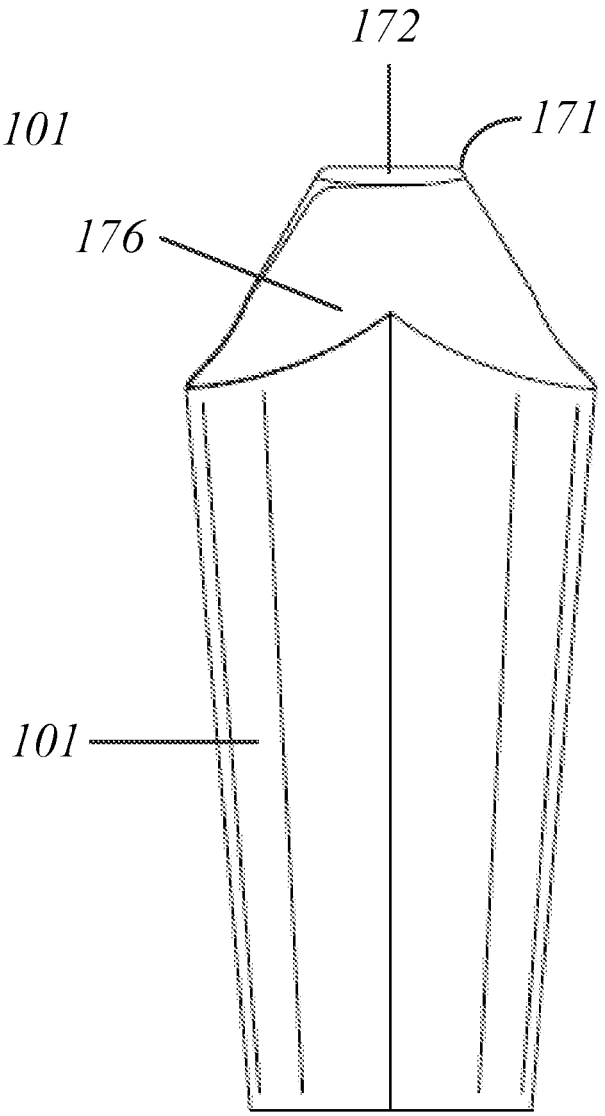
Figure 16L:
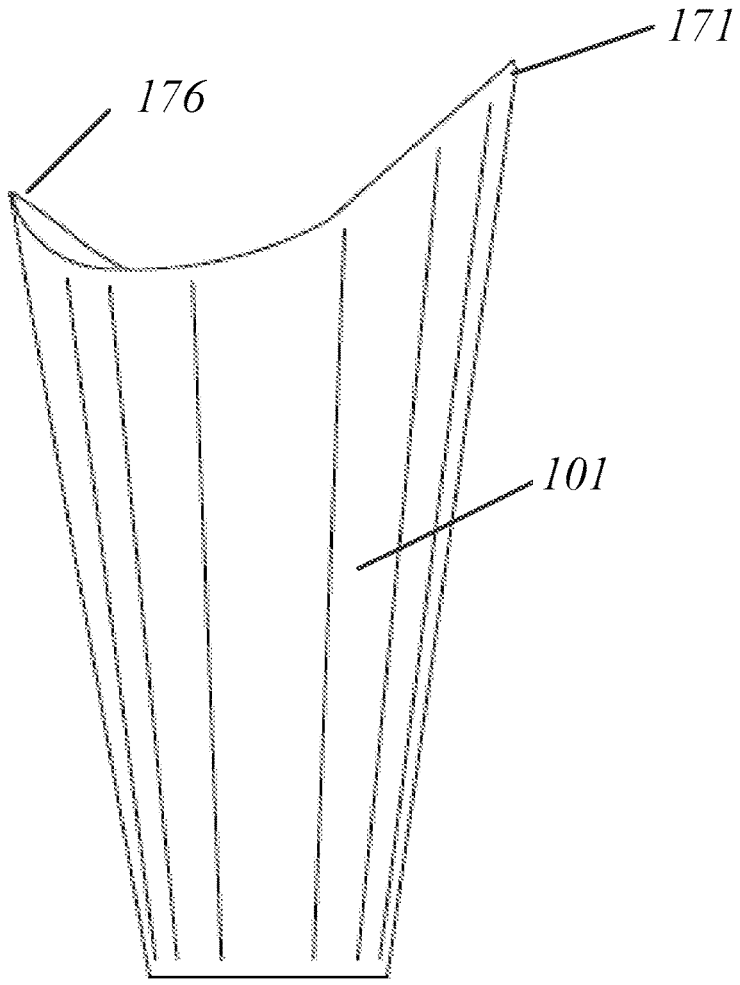
Figure 16M:
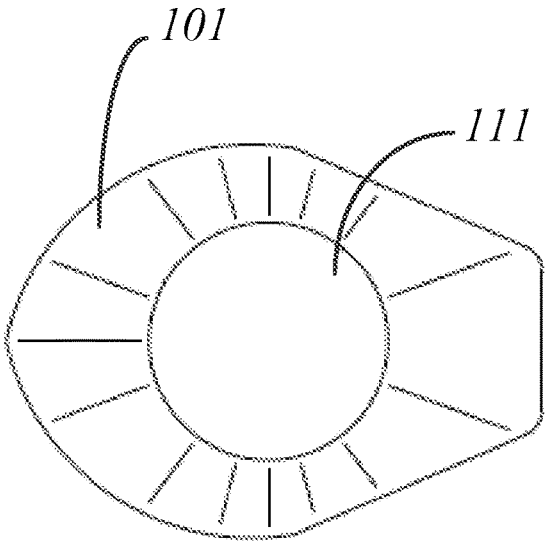
Figure 16N:
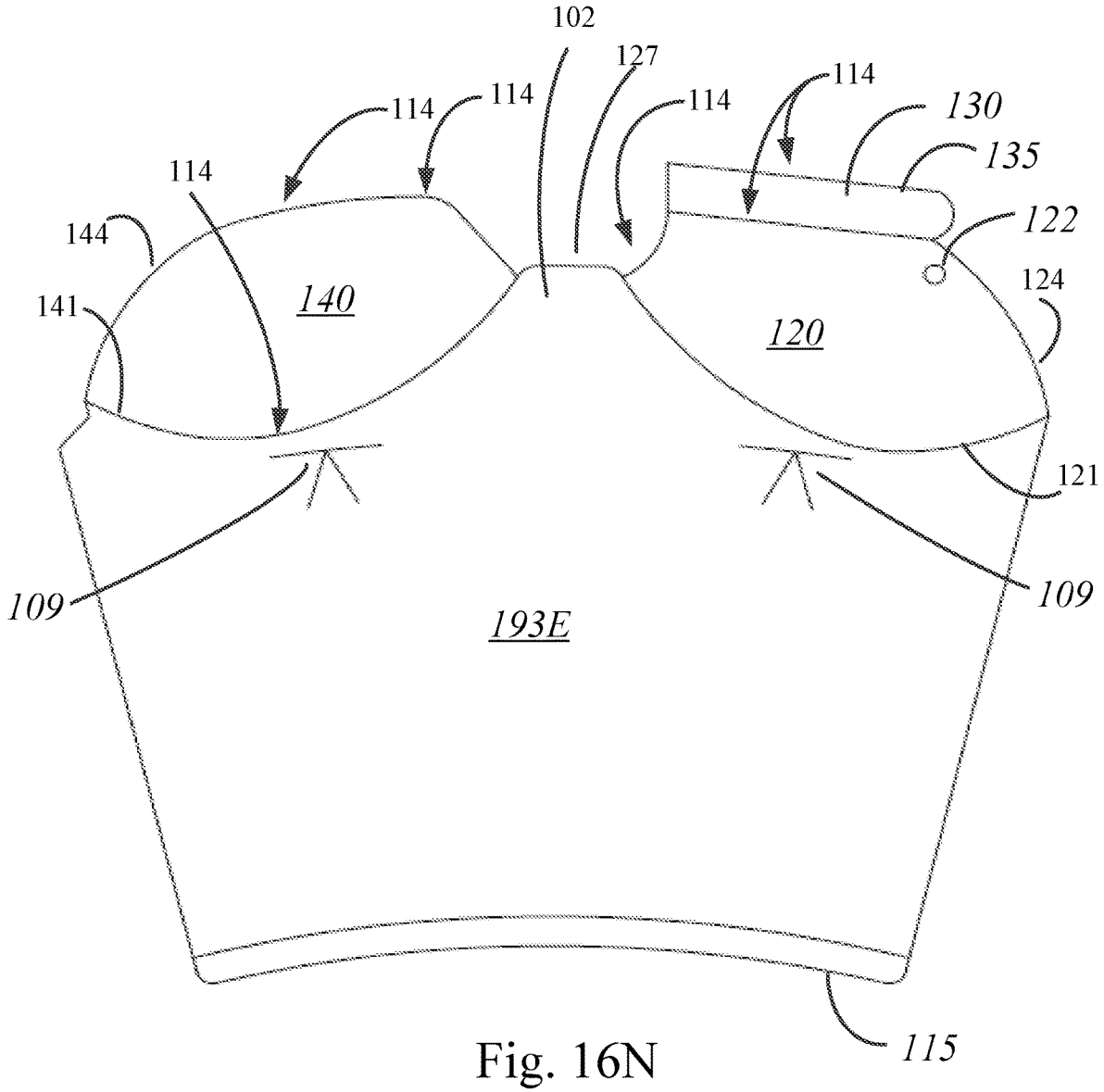
Figure 16O:
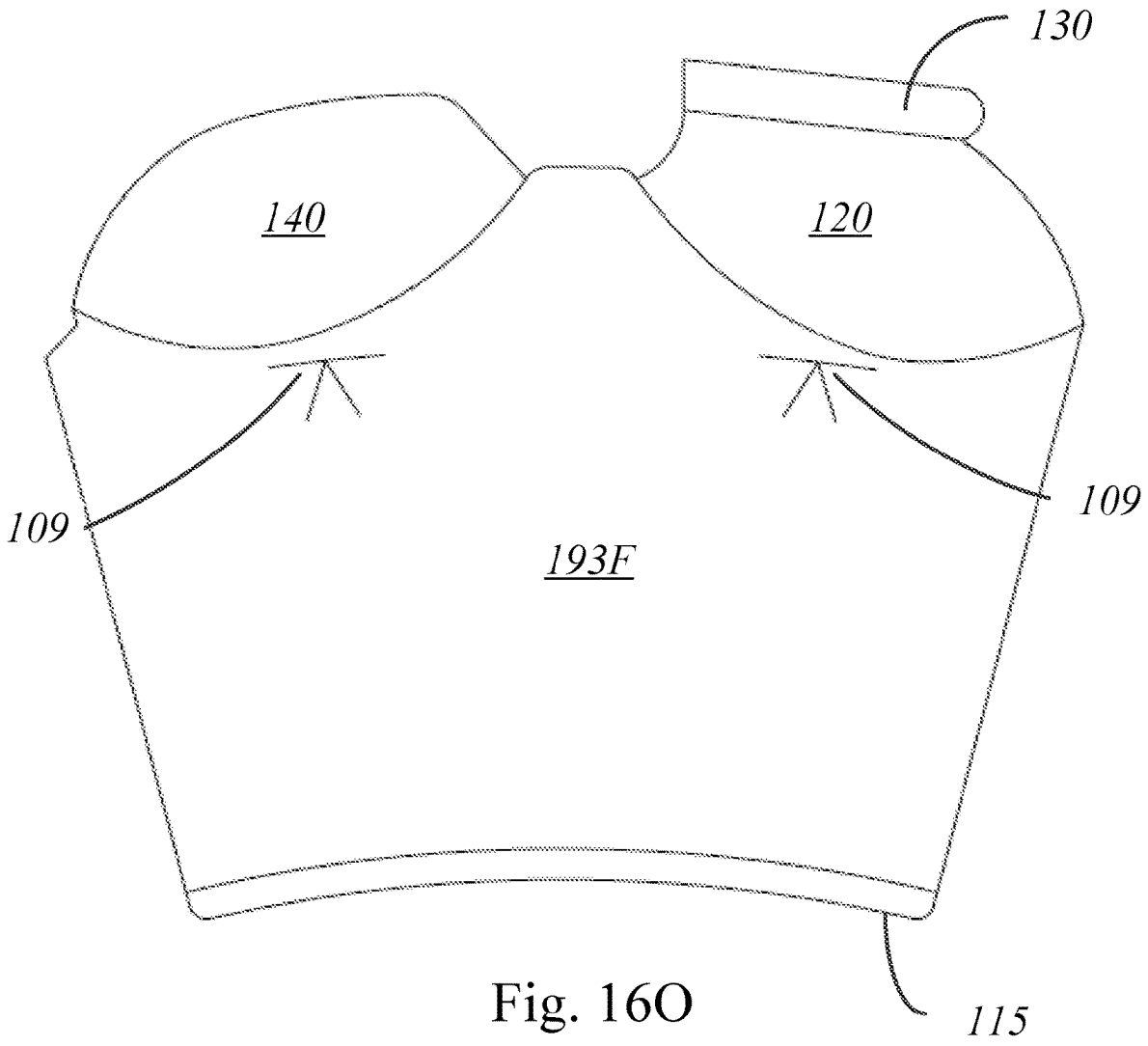
Figure 16P:
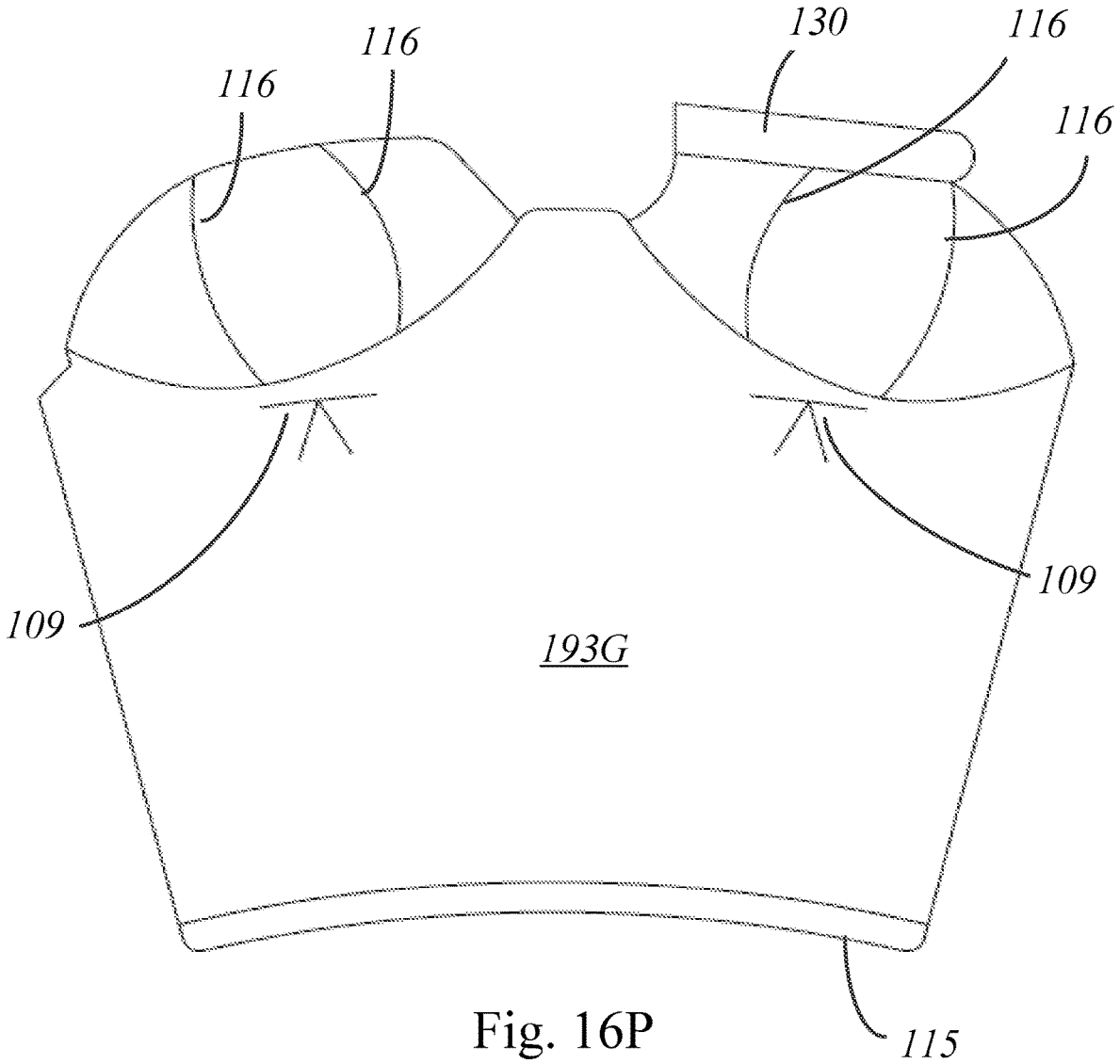
Figure 16Q:
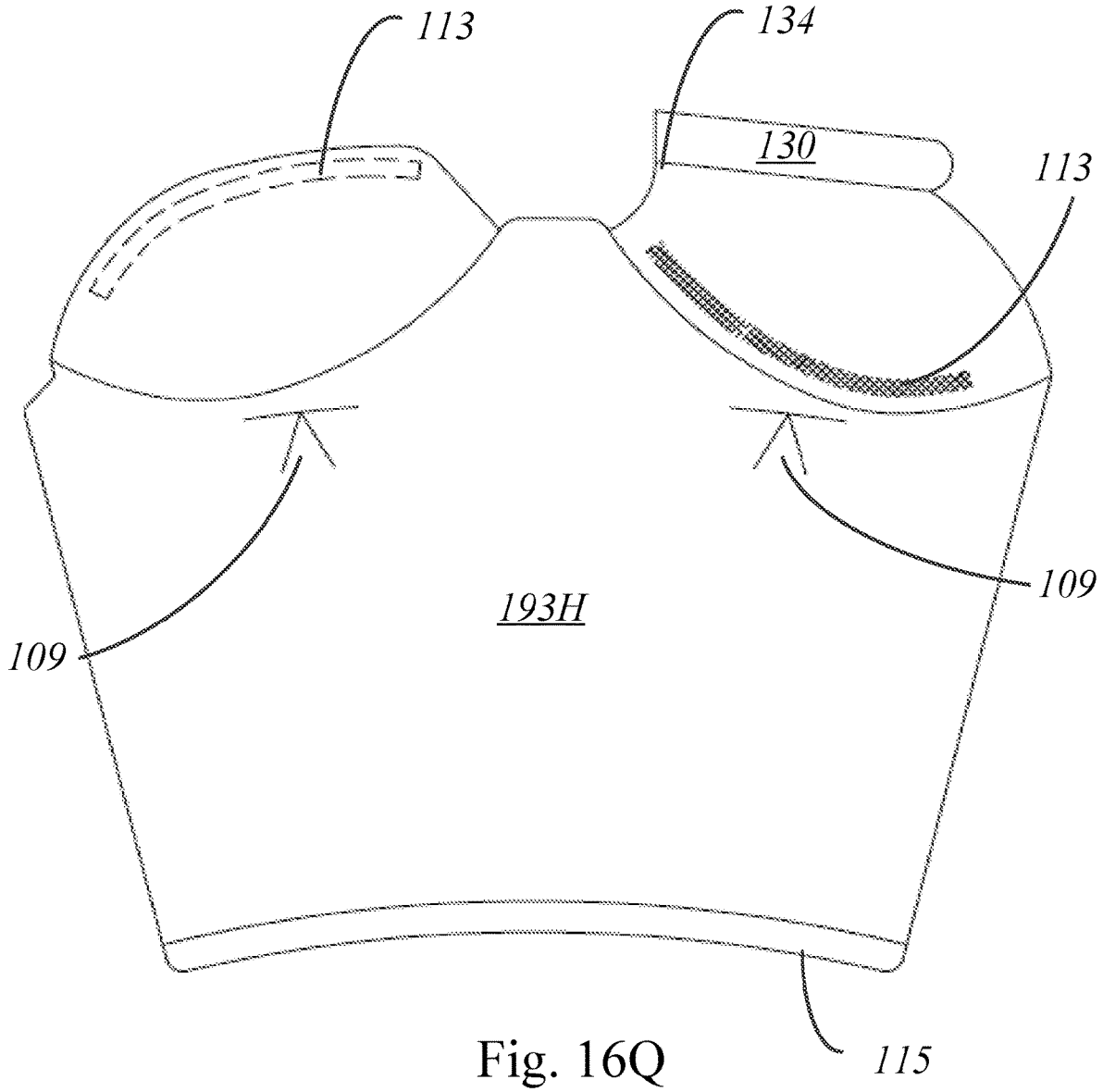

Also schematically illustrated in FIG. 16F and 16Q are blanks 193D and 193H having several optional fold lines 131, 141 that delineate the flaps 120 and 140 from the base 101 of the vessel 101, and fold line or crease 134 that delineates the dam tab 130 from the remainder of the inner flap 120.

FIG. 16Q schematically illustrates another embodiment of a blank 193H for forming a vessel 100, and having optional adhesive strips 113. The adhesive strip 113 on the outer flap 140 is on the inner surface 146 of the outer flap 140; the surface that faces the inner flap 120 when the inner flap 120 and outer flap 140 are folded, as schematically illustrated in FIG. 16A for example. Stated alternately, the adhesive strip 113 on the outer flap 140 is on the inside surface 146 of the vessel when the outer flap 140 is not folded down, because that surface faces inwards.

The adhesive strip 113 on the inner flap 120 is on the outer surface 126 of the inner flap 120; the surface that faces the outer flap 140 when the inner flap 120 and outer flap are folded. Stated alternately, the adhesive strip 113 on the inner flap 120 is on the outside surface of the vessel when the inner flap is not folded down, because that surface faces outwards from the vessel 100.

Figure 16R:
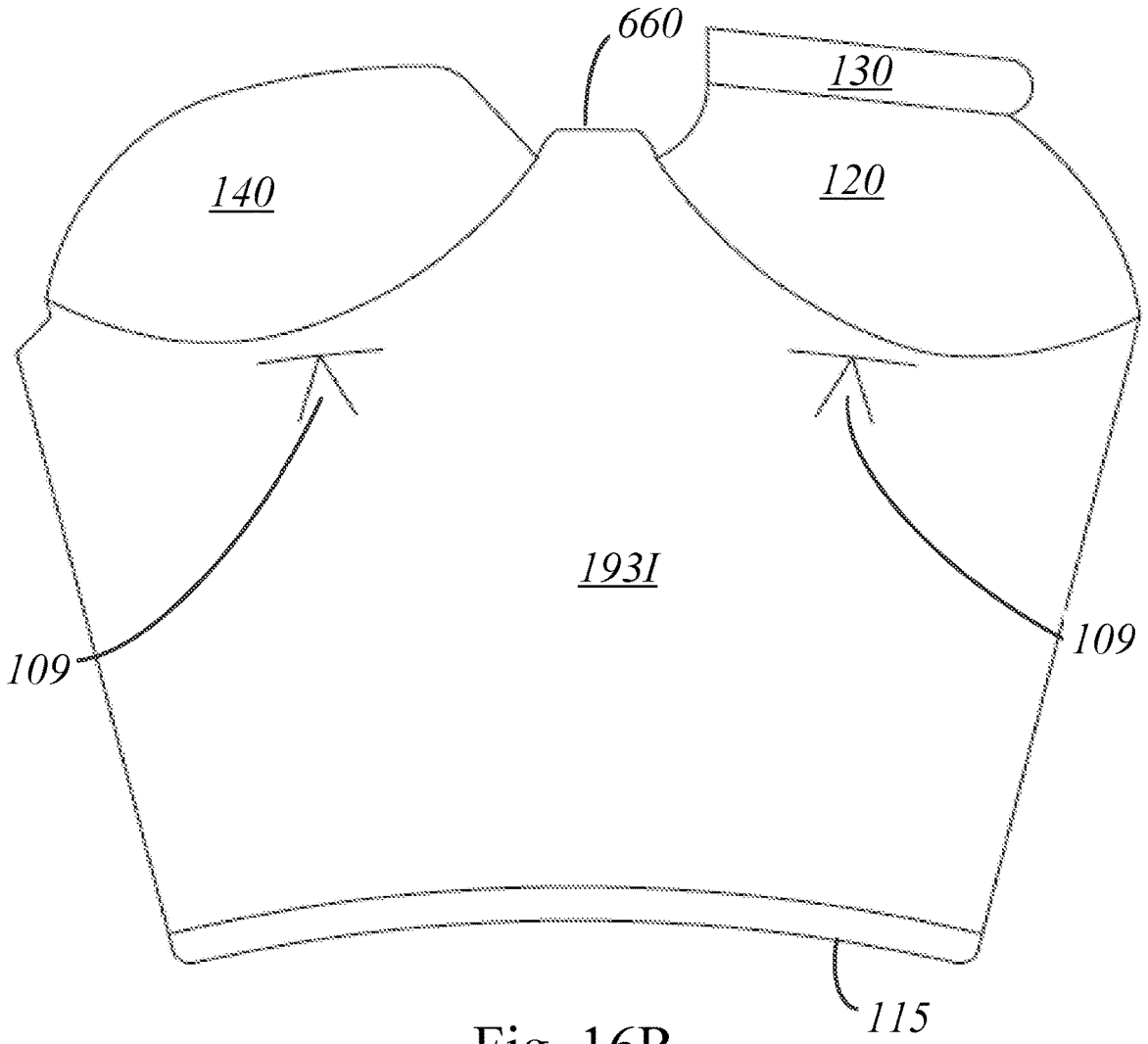

FIG. 16R schematically illustrates another embodiment of a blank 1931 for forming a vessel 100, and having a spout ledge 660 extending from the extension 102 of the base region 101 between the inner flap 120 and the outer flap 140. When the spout is formed, the ledge 660 reinforces the spout 171.

Figure 16S:
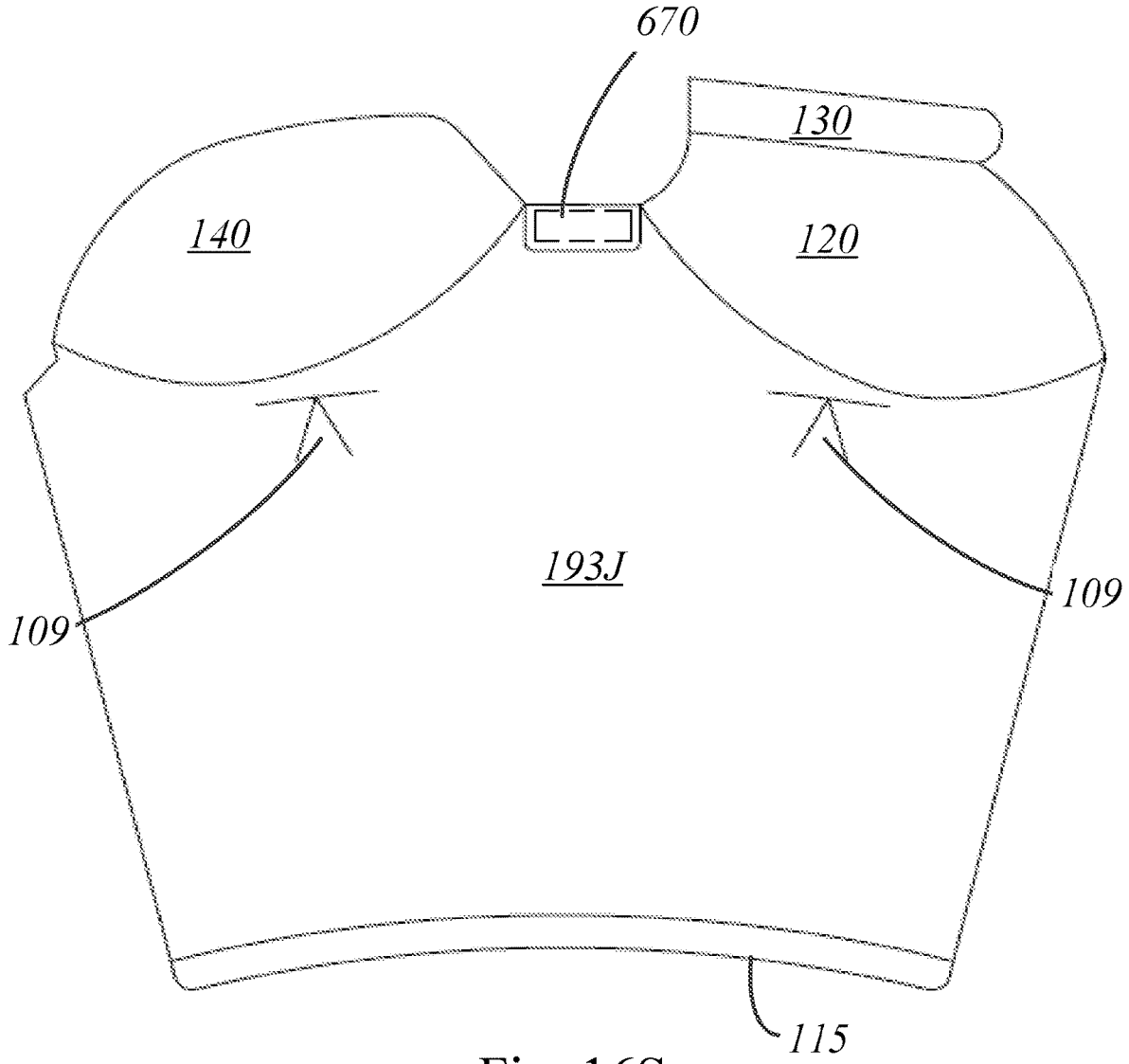
Figure 17A:
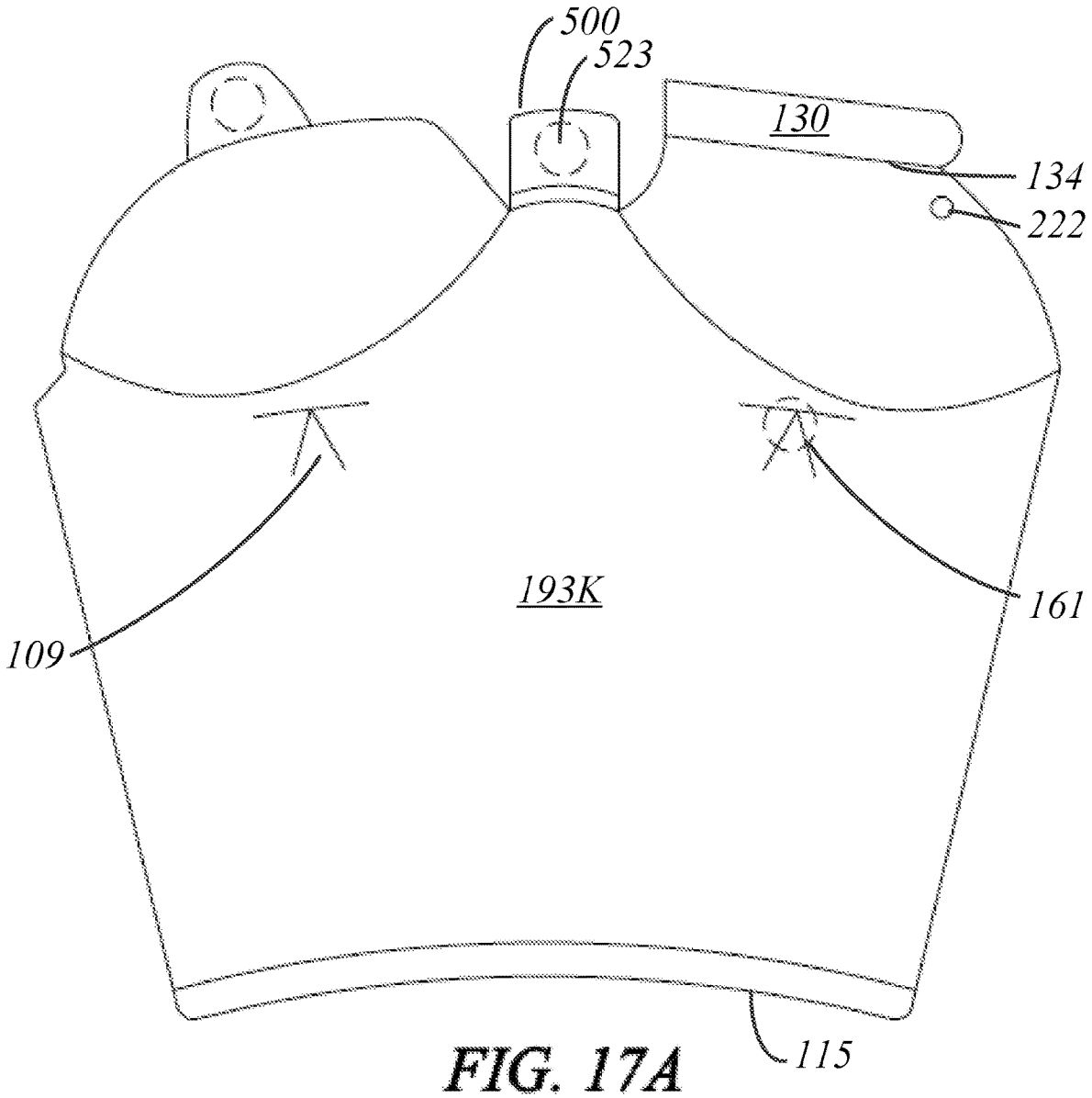
FIGS. 17A-17J schematically illustrate an alternate embodiment of a vessel.
Figure 17B:
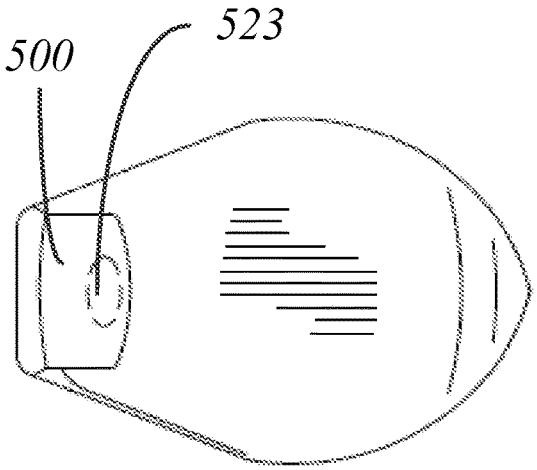
Figure 17C:
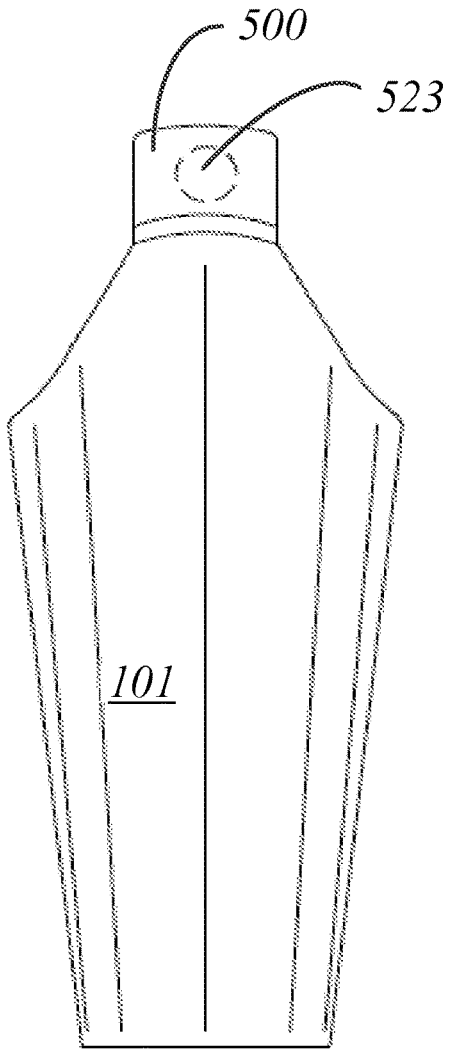
Figure 17D:
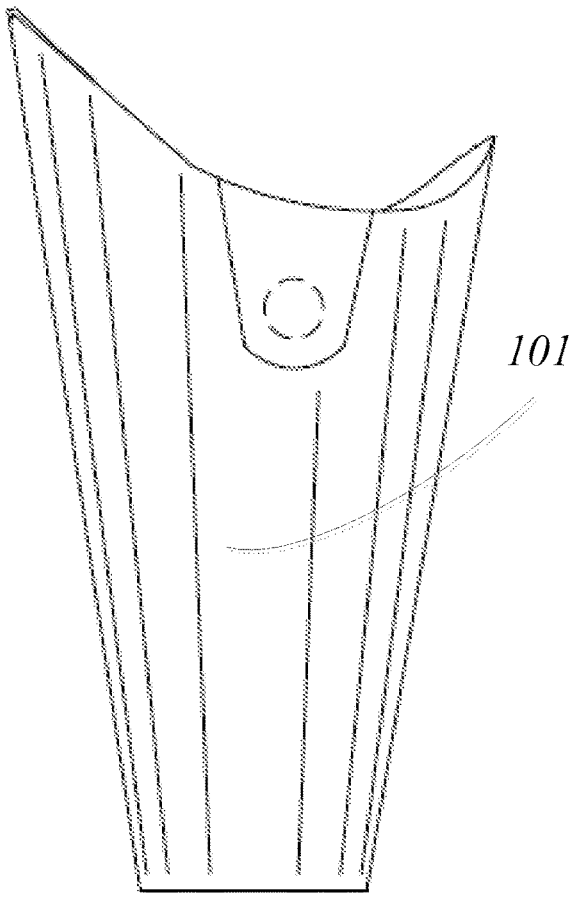
Figure 17E:
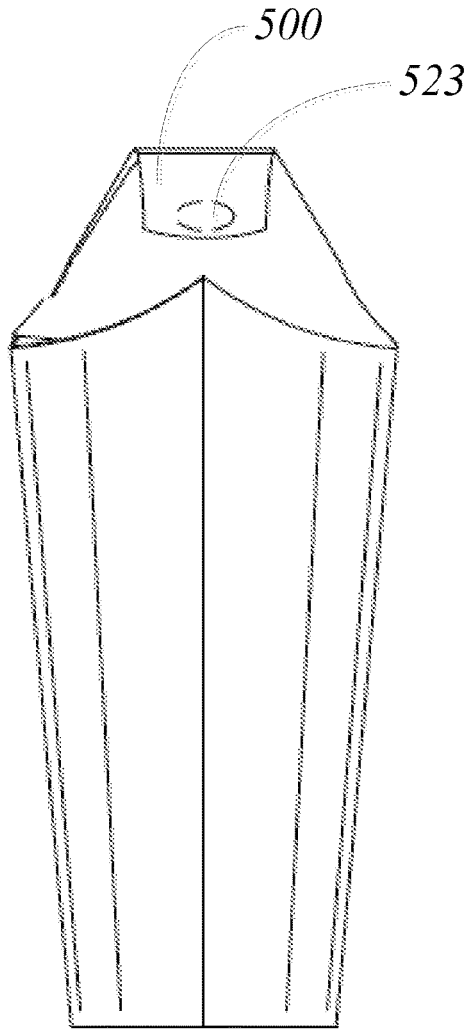
Figure 17F:
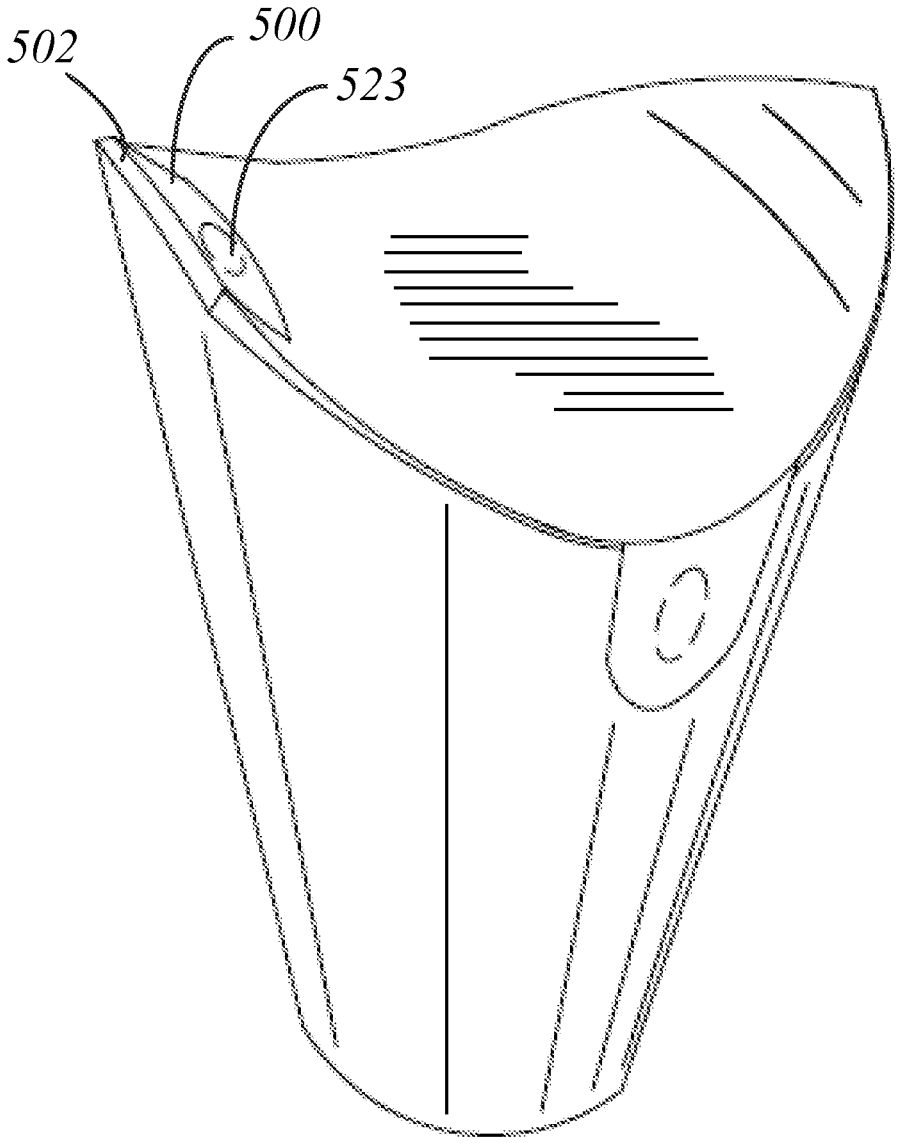
Figure 17G:
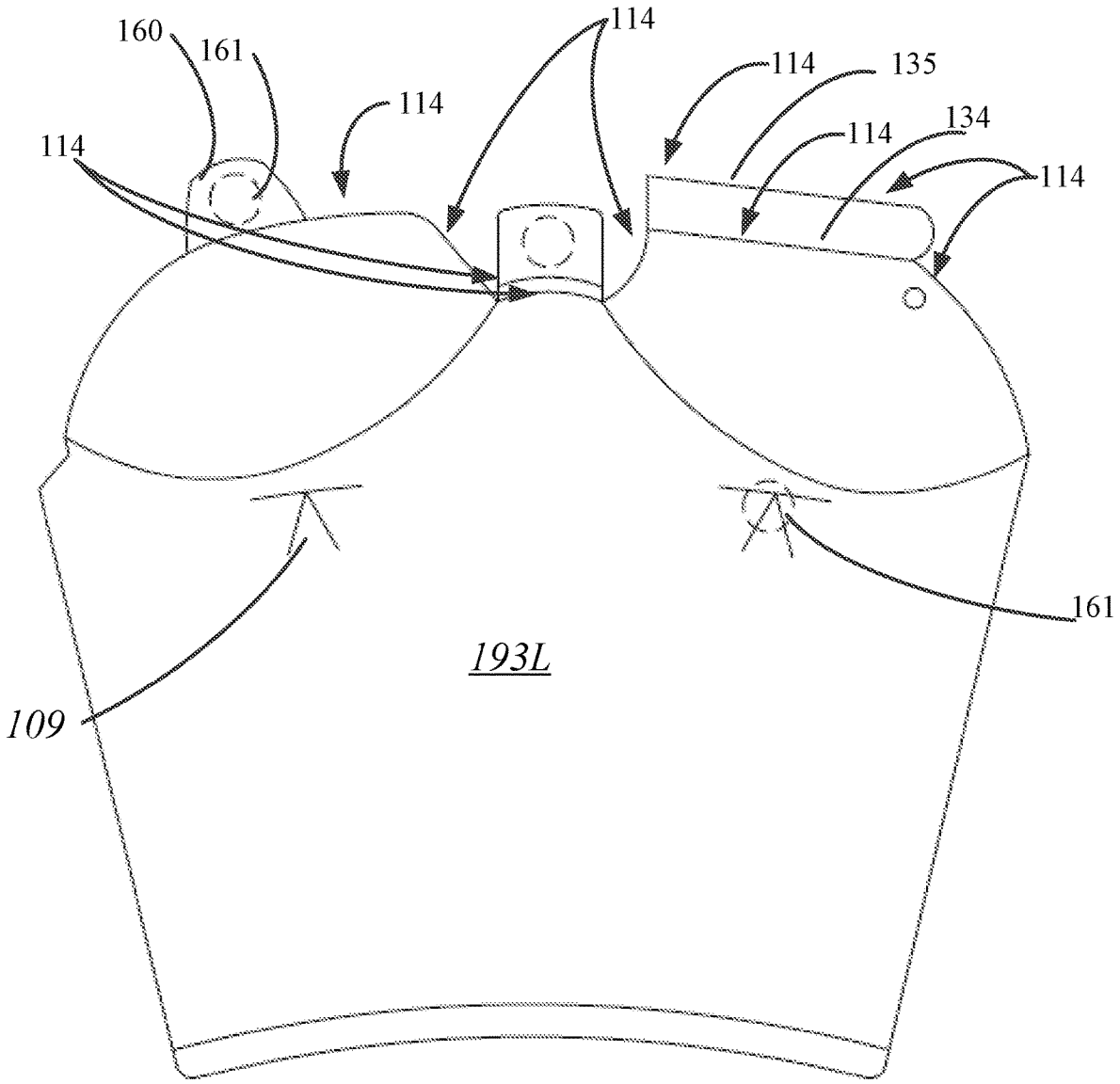
Figure 17H:
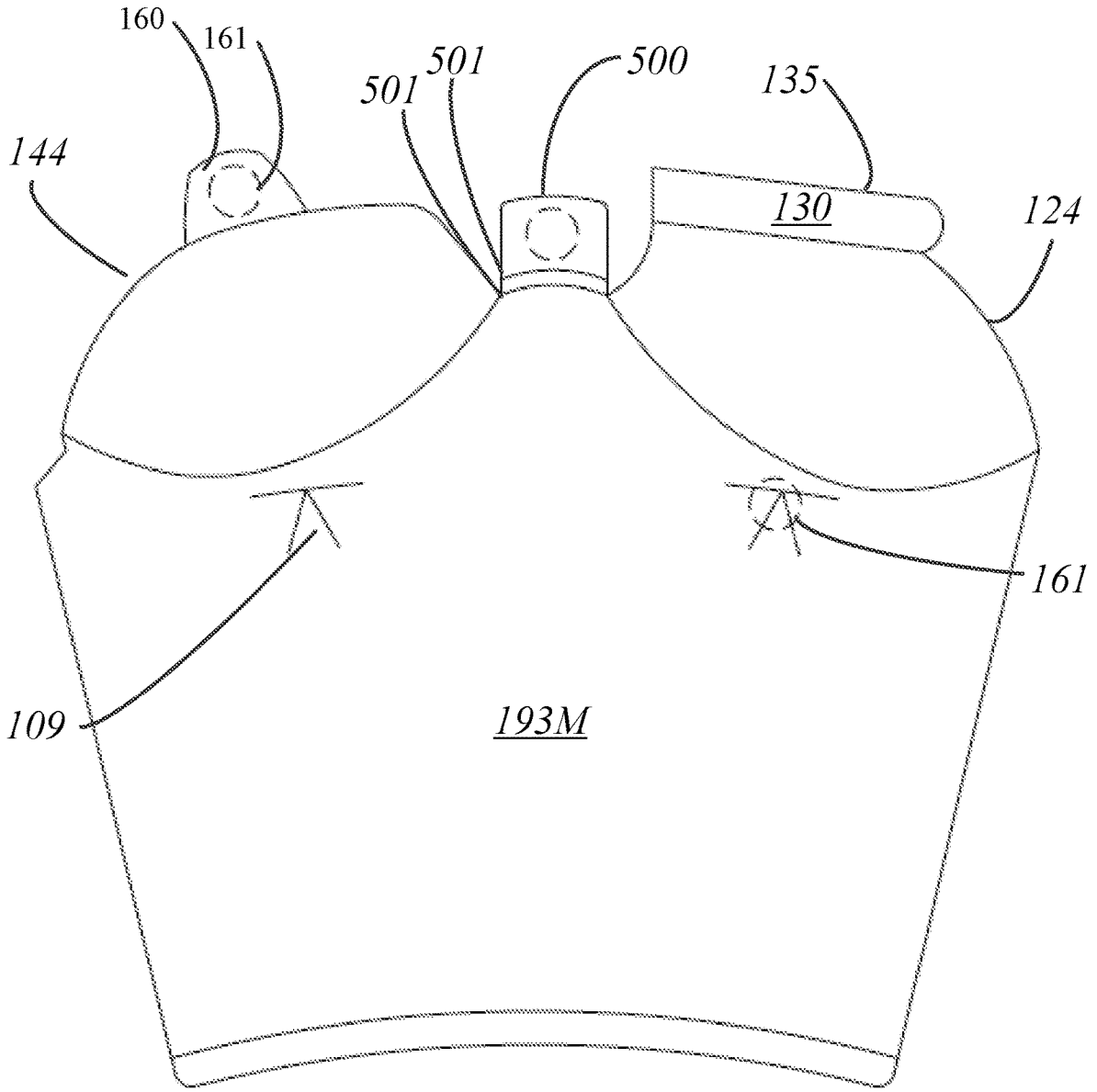
Figure 17I:
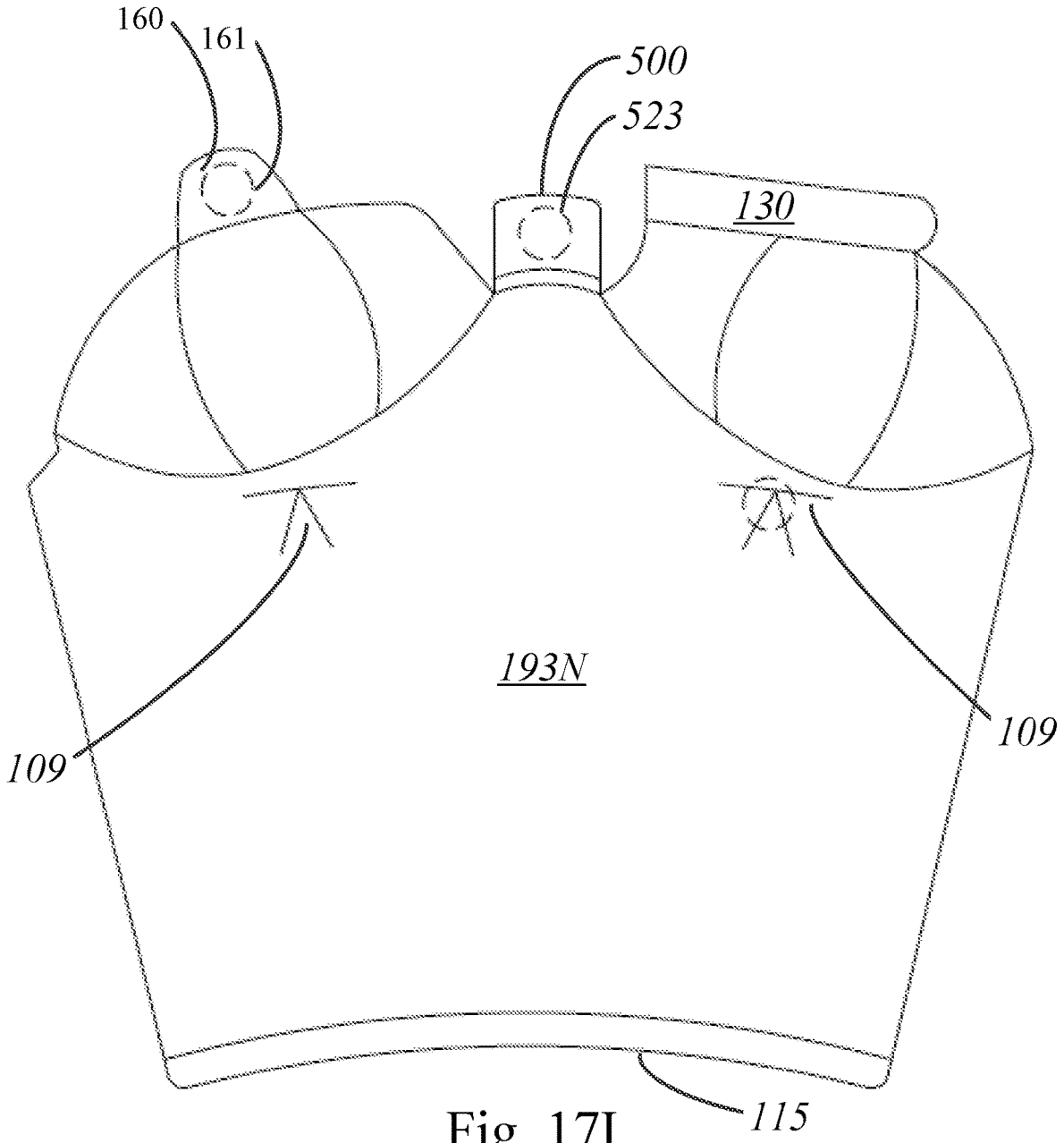
Figure 17J:
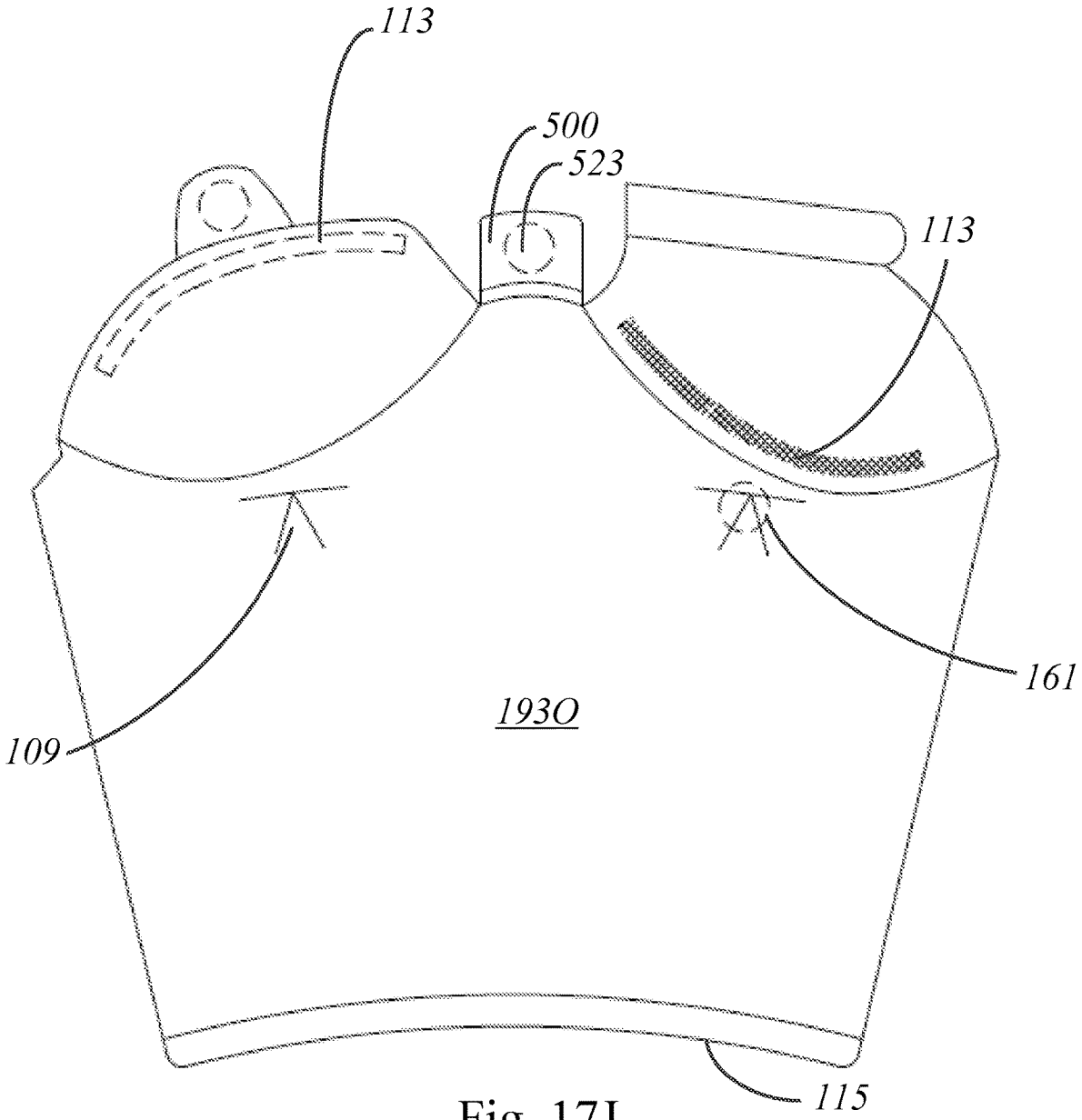
Figure 18A:
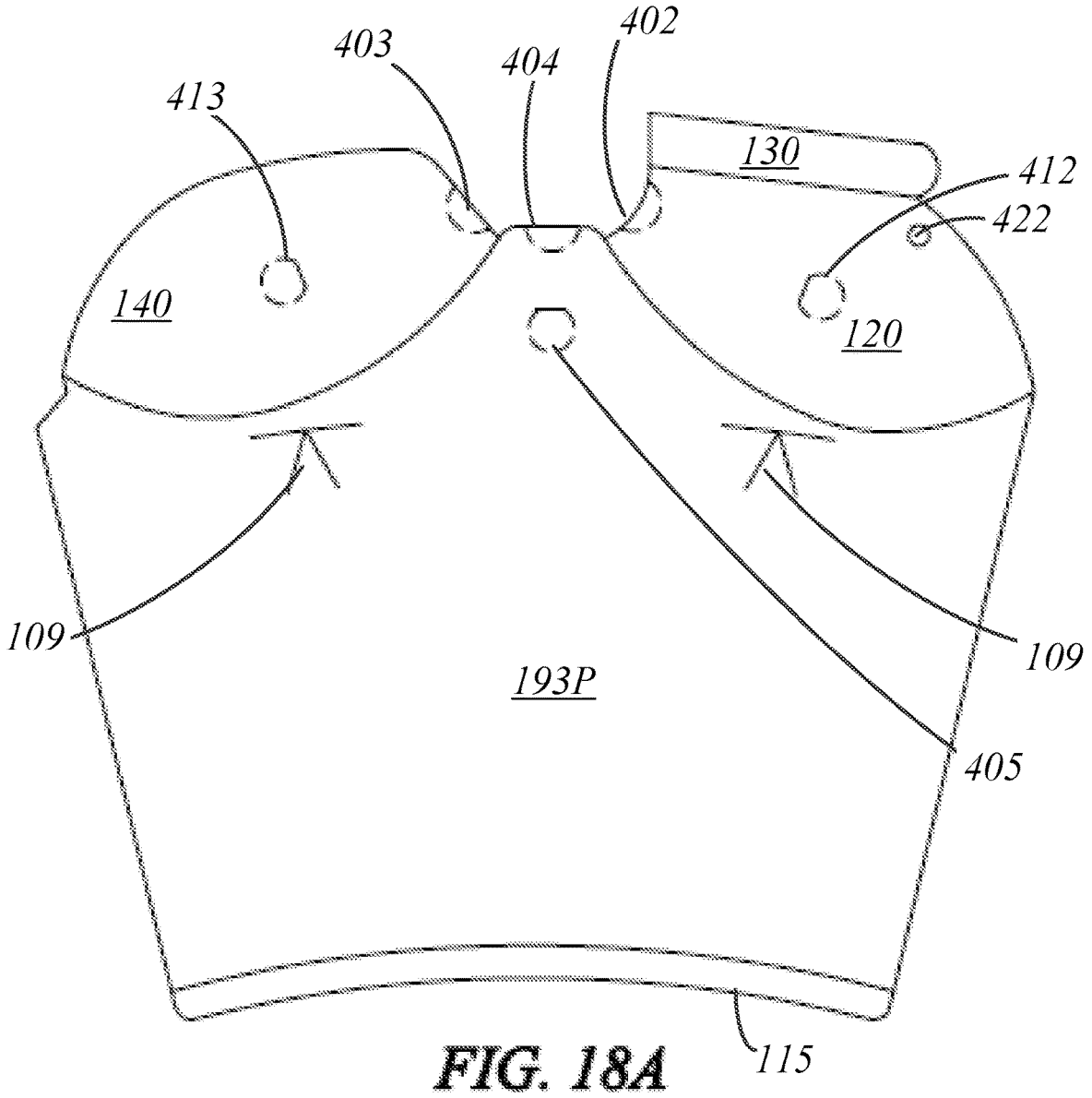
FIGS. 18A-18H schematically illustrate an alternate embodiment of a vessel.
Figure 18B:
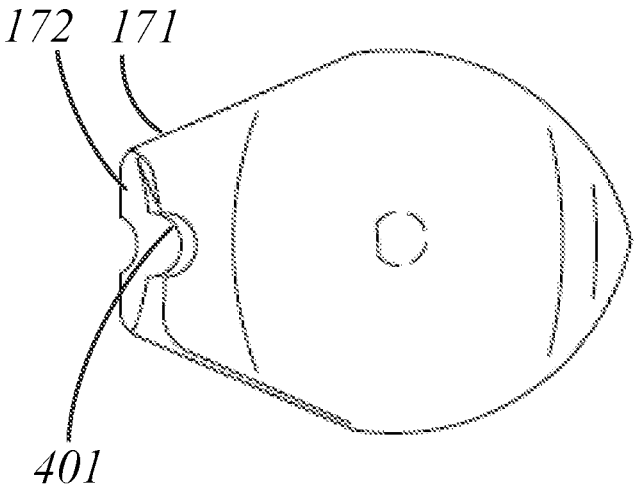
Figure 18C:
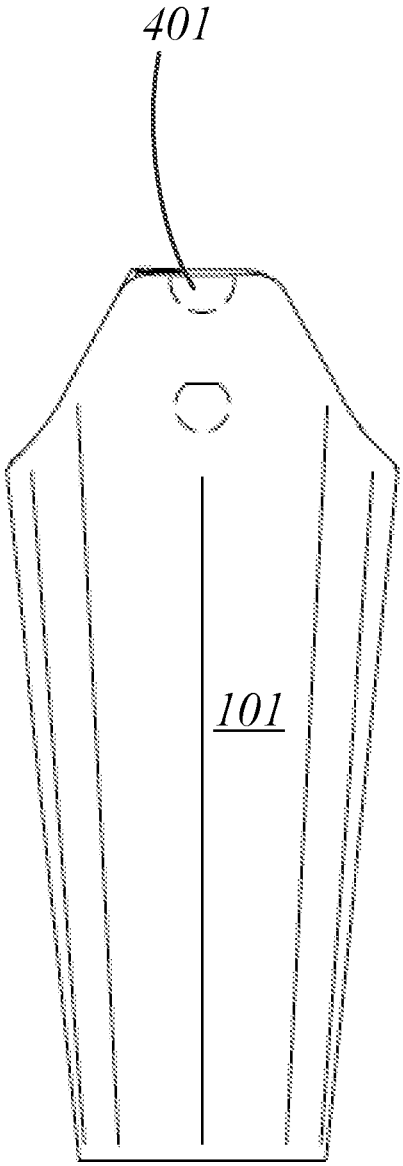
Figure 18D:
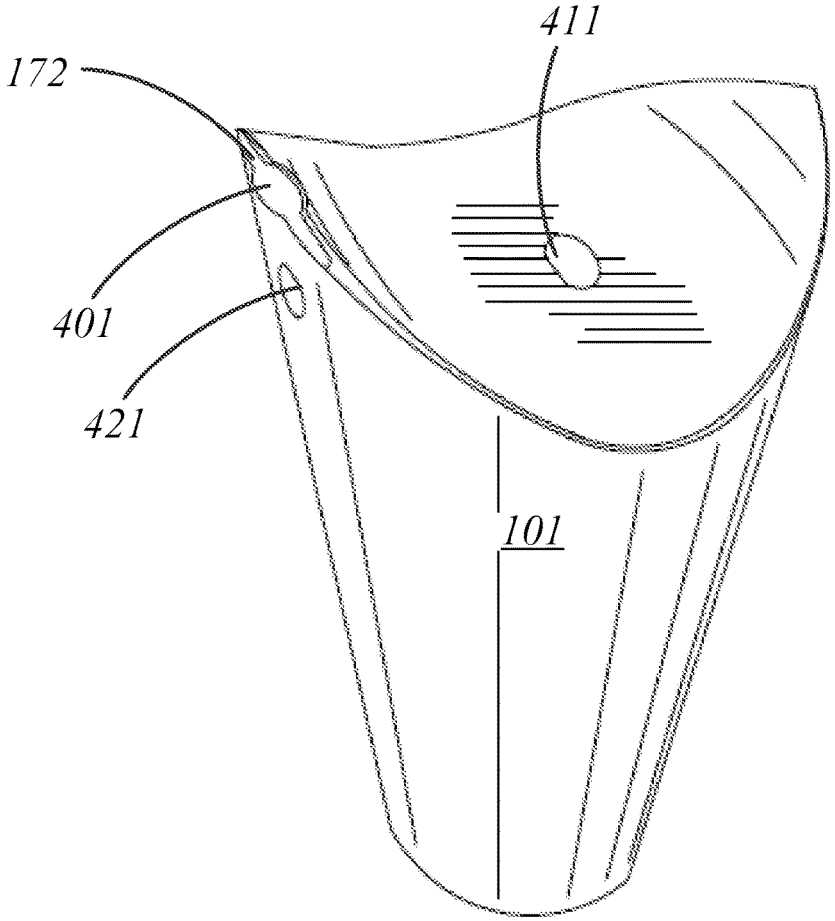
Figure 18E:
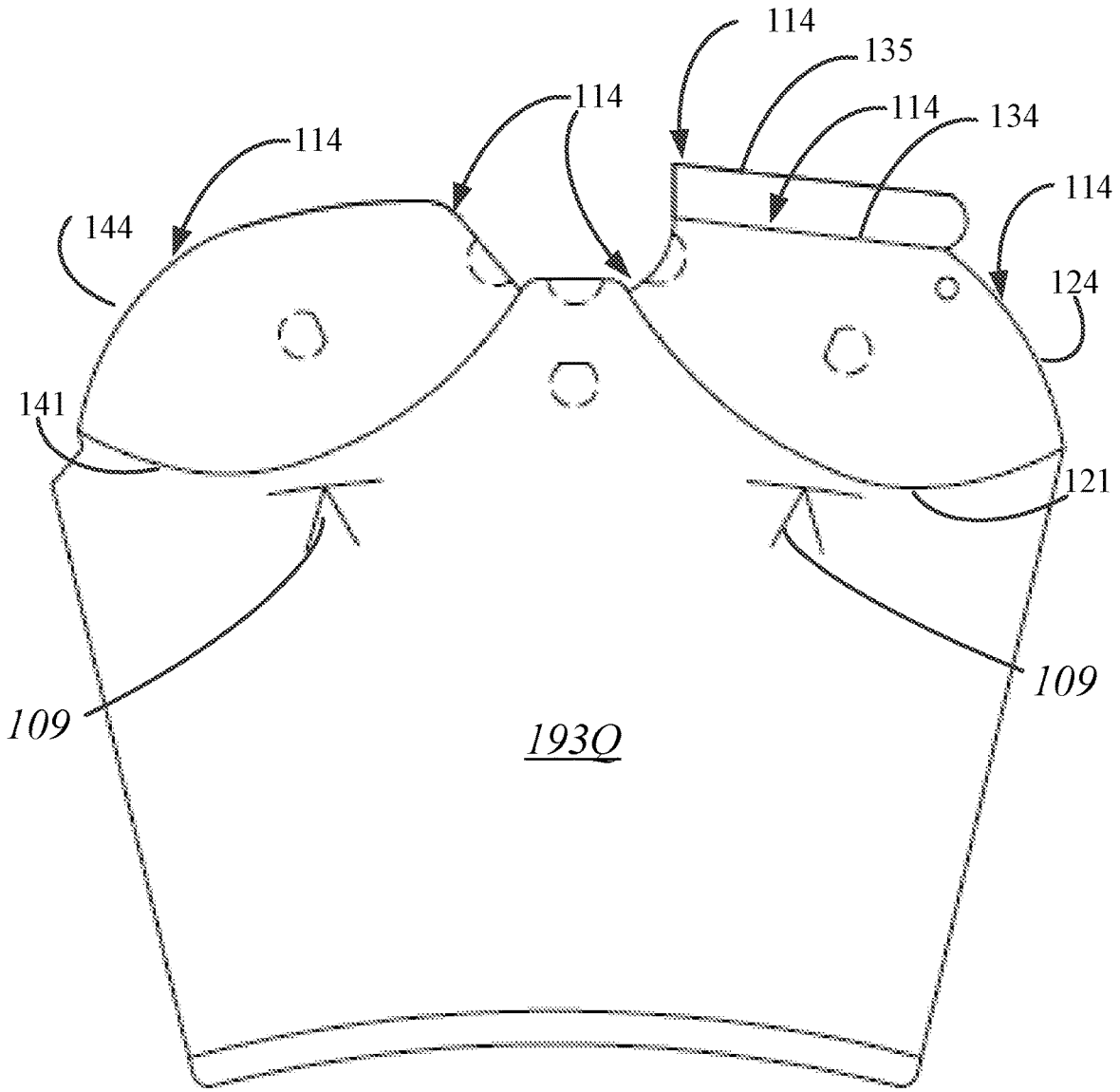
Figure 18F:
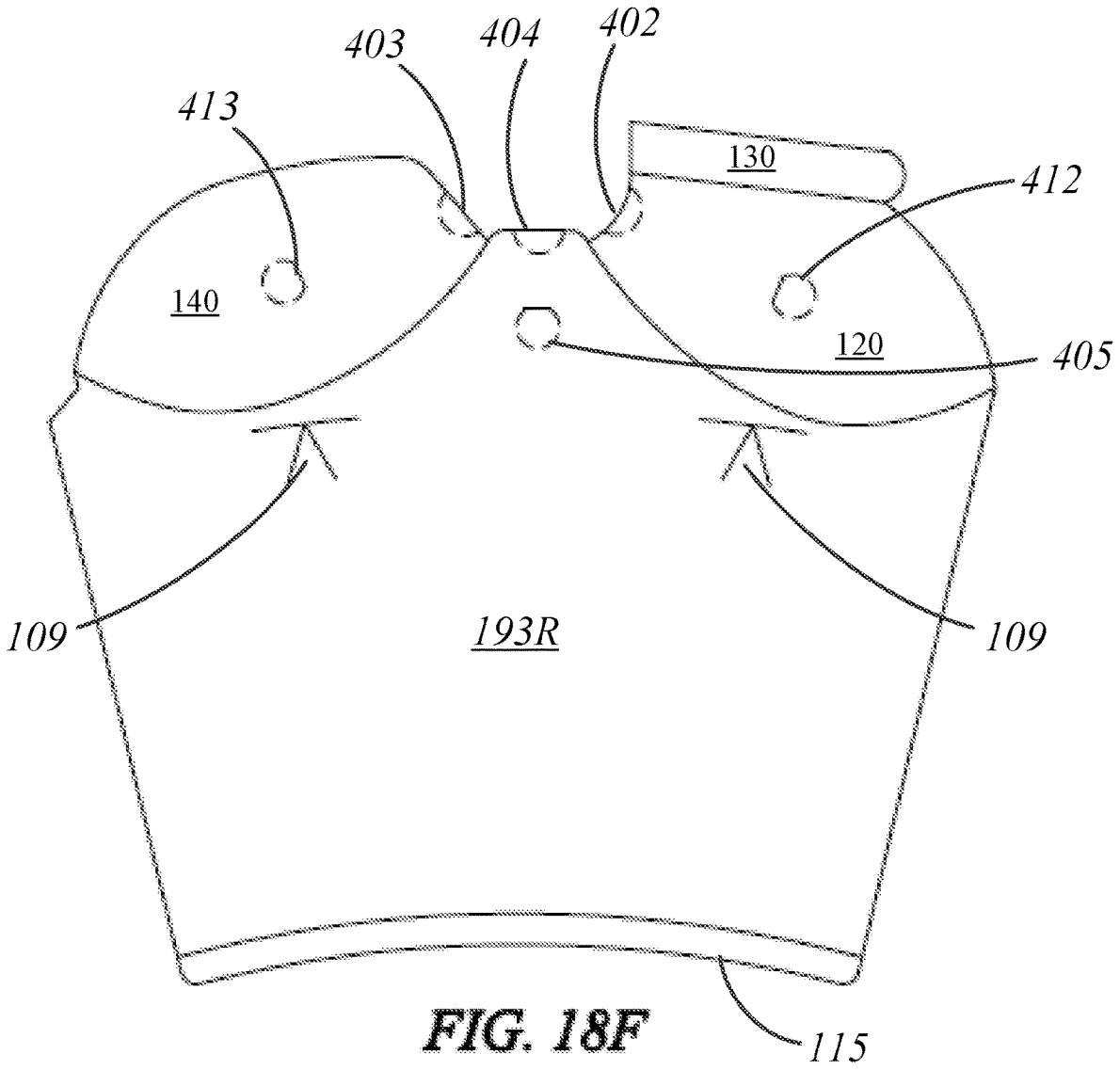
Figure 18G:
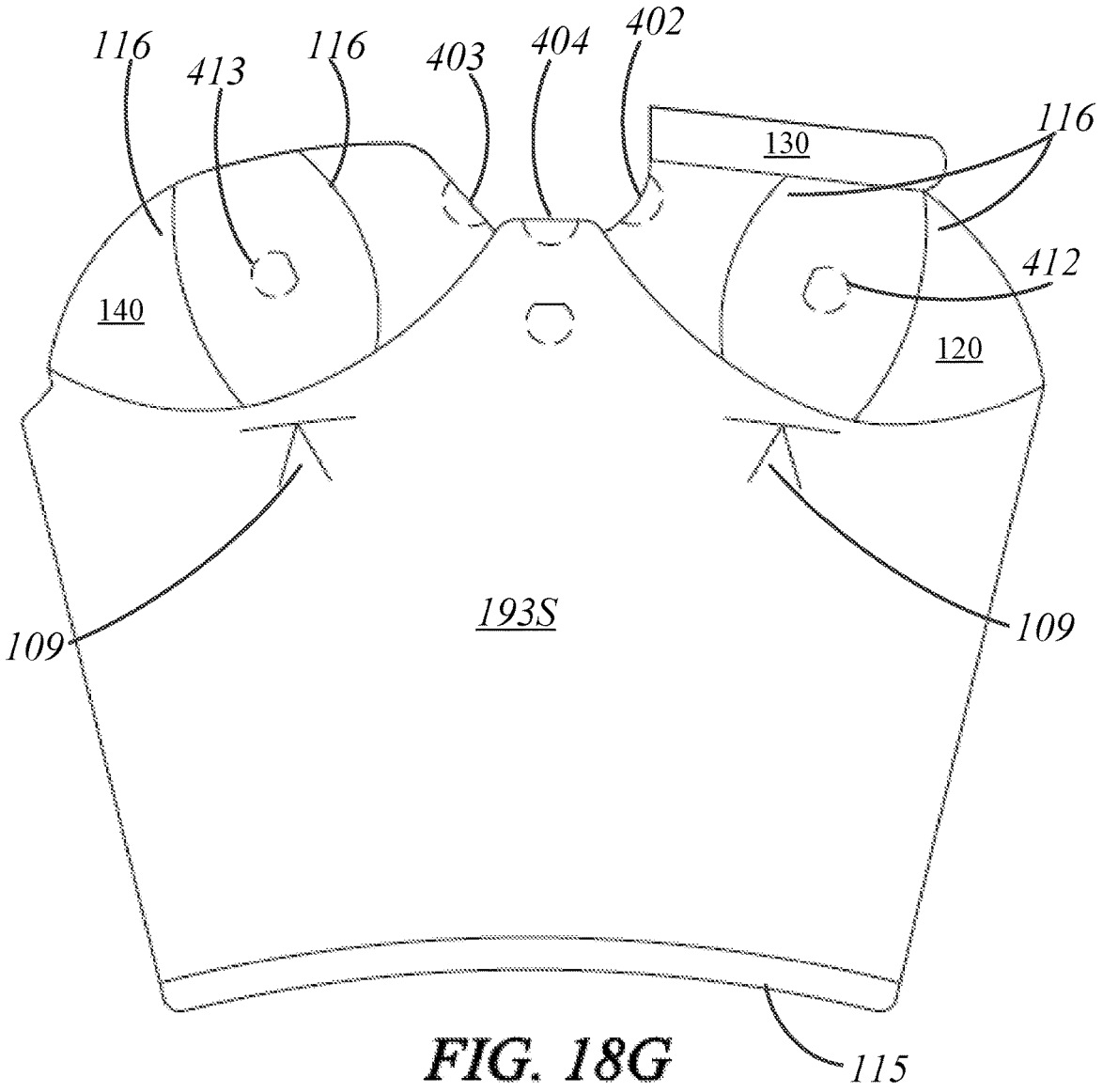
Figure 18H:
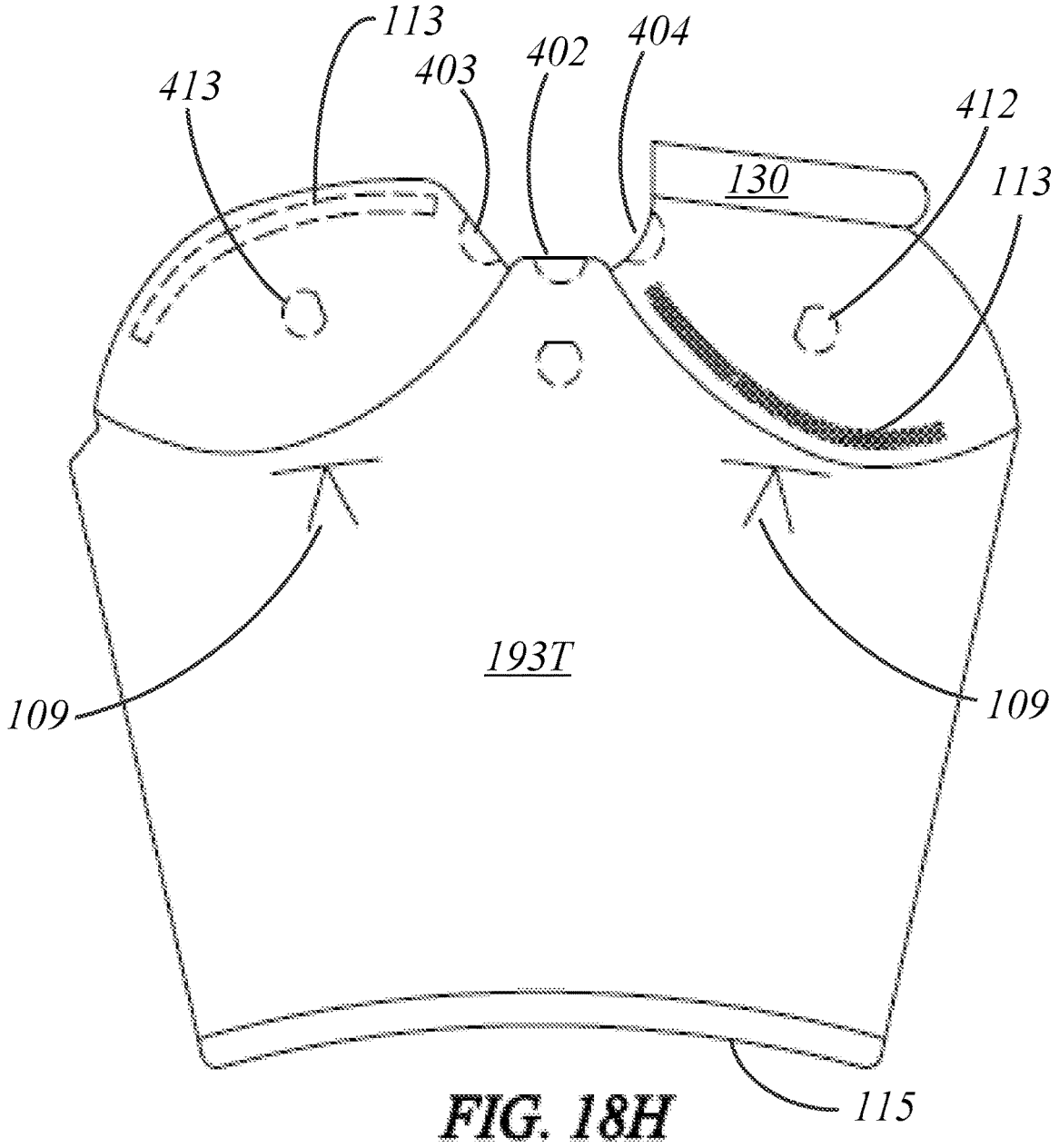

FIG. 16S schematically illustrates another embodiment of a blank 193J for forming a vessel 100, and having a lip tab 670. The lip tab 670 helps to prevent wicking of water on that edge of the spout, and may also improve the way that the spout feels in the mouth of a user. The lip tab 670 folds down and is attached to the spout 171 with adhesives, producing a folded edge along the bottom of the spout opening.

FIGS. 16H, 16I, 16J, 16K, 16L and 16M schematically illustrate the vessel 100 pursuant to this embodiment. FIG. 16H is a top view of the vessel 100, FIG. 16I is a front view of the vessel 100, FIG. 16J is a left-side view of the vessel 100, FIG. 16K is a back-view of the vessel 100, FIG. 16L is a right-side view of the vessel 100, and FIG. 16M is a bottom-view of the vessel 100.

FIGS. 17A-17K schematically illustrate an alternate embodiment having many of the same features of other embodiments described herein, as shown by common reference numbers. Various possible combinations of features are schematically illustrated in blanks 193K, 193L, 193N and 193O.

FIGS. 18A-18H schematically illustrate an alternate embodiment having many of the same features of other embodiments described herein, as shown by common reference numbers. Various possible combinations of features are schematically illustrated in blanks 193P, 193Q, 193R, 193S, and 193T.

Figure 19:
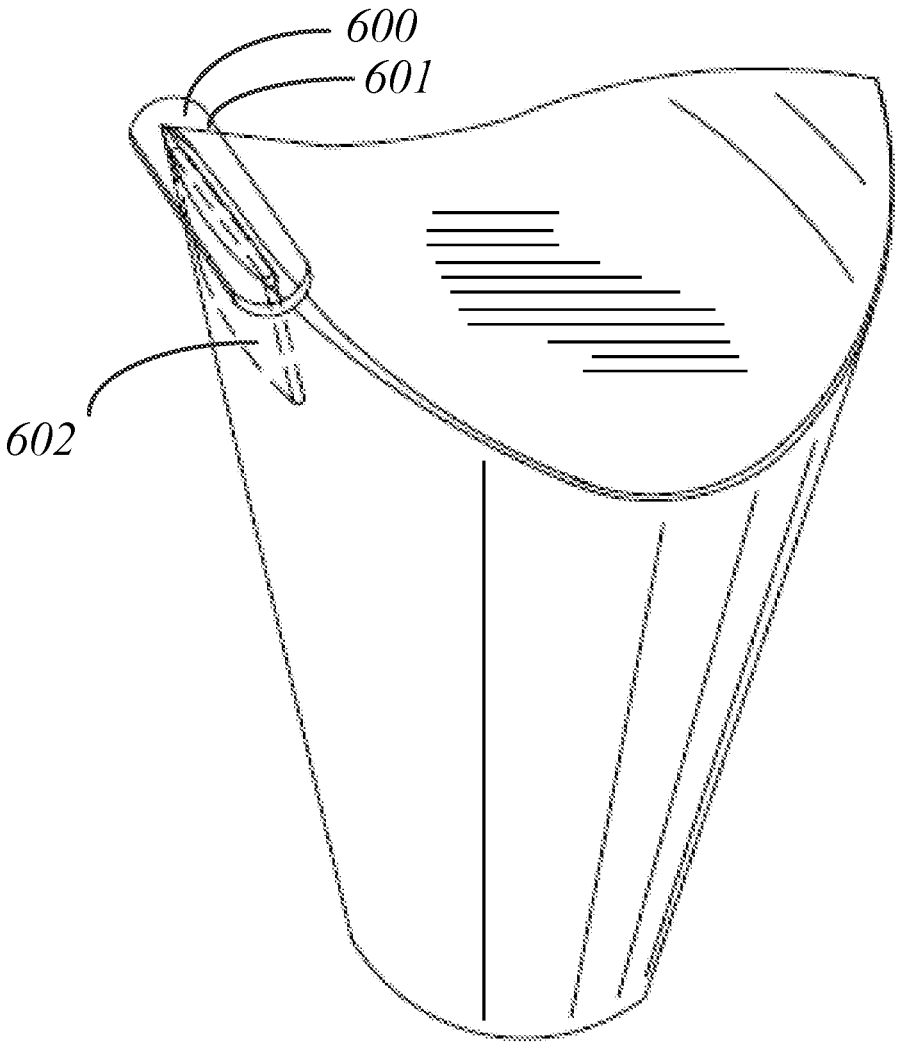
FIG. 19 schematically illustrates an embodiment of a vessel.

FIG. 19 schematically illustrates an embodiment of a vessel 100 having a plug closure 600 as previously described.

Figure 20:
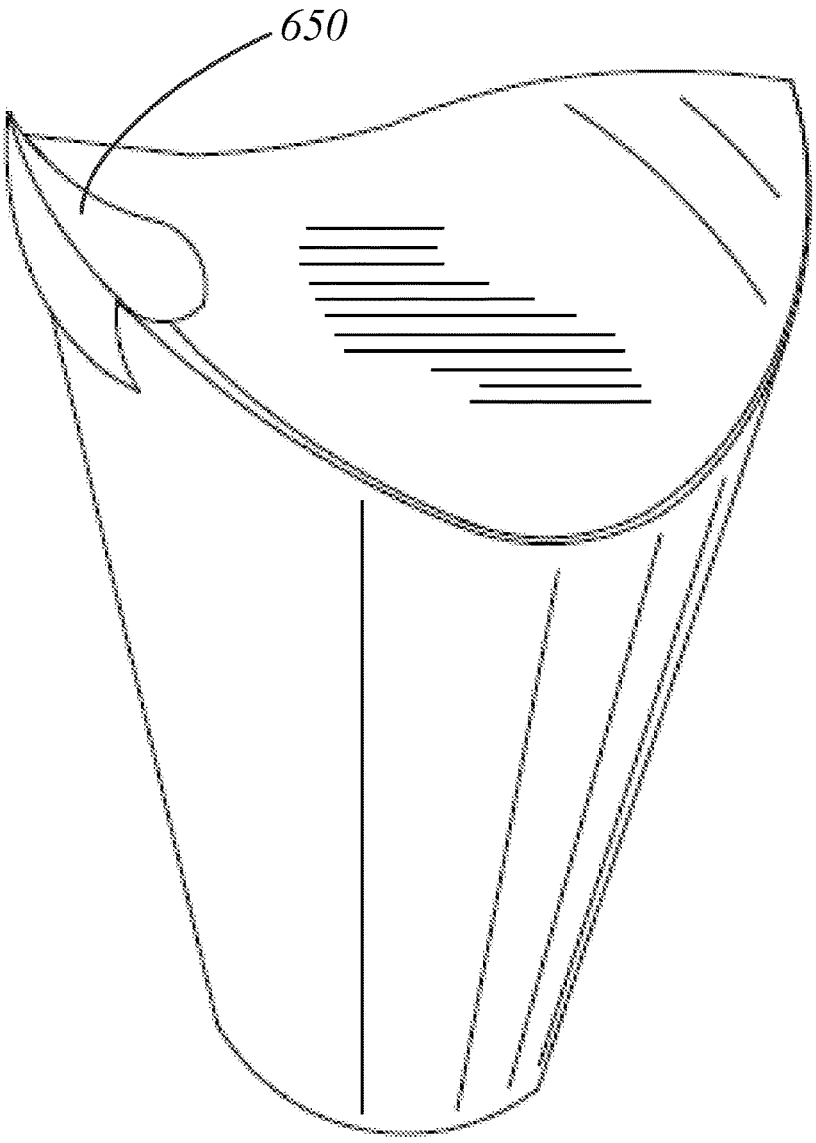
FIG. 20 schematically illustrates an embodiment of a vessel.

FIG. 20 schematically illustrates an embodiment of a vessel 100 having a cap closure 650 as previously described.

Figure 21:
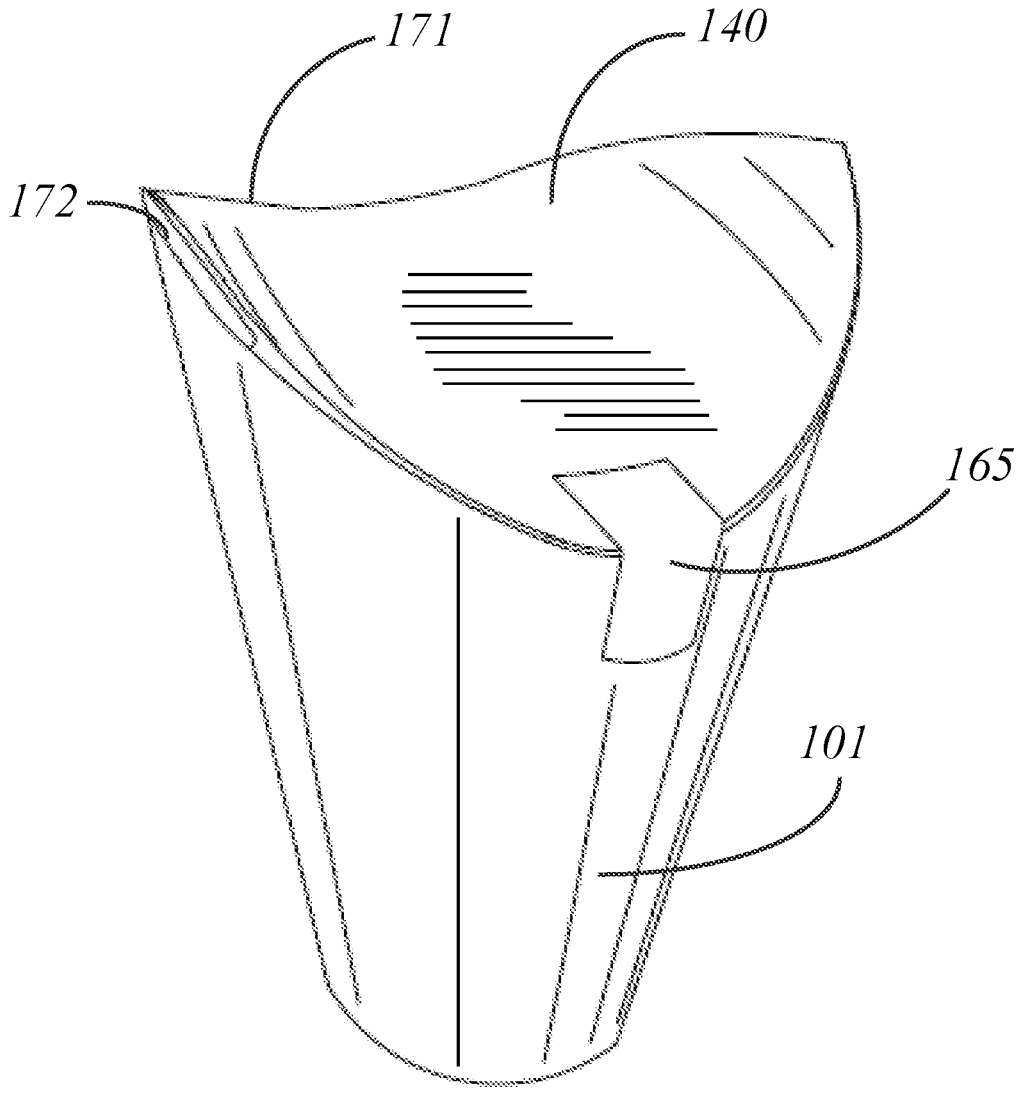
FIG. 21 schematically illustrates an embodiment of a vessel.

FIG. 21 schematically illustrate an alternate embodiment having many of the same features of other embodiments described herein, as shown by common reference numbers. Indeed, the embodiment of FIG. 21 represents a vessel of the embodiments described herein, and also includes an adhesive tape 165 physically coupled to the top 145 of the vessel (i.e., the outer surface of outer flap 140) and extending over the edge 144 of the outer flap 140 and attached to the base 101 of the vessel 100. The adhesive tape 165 secures the flaps 120 and 140 in a closed or folded position, as shown in FIG. 21.

Figure 22A:
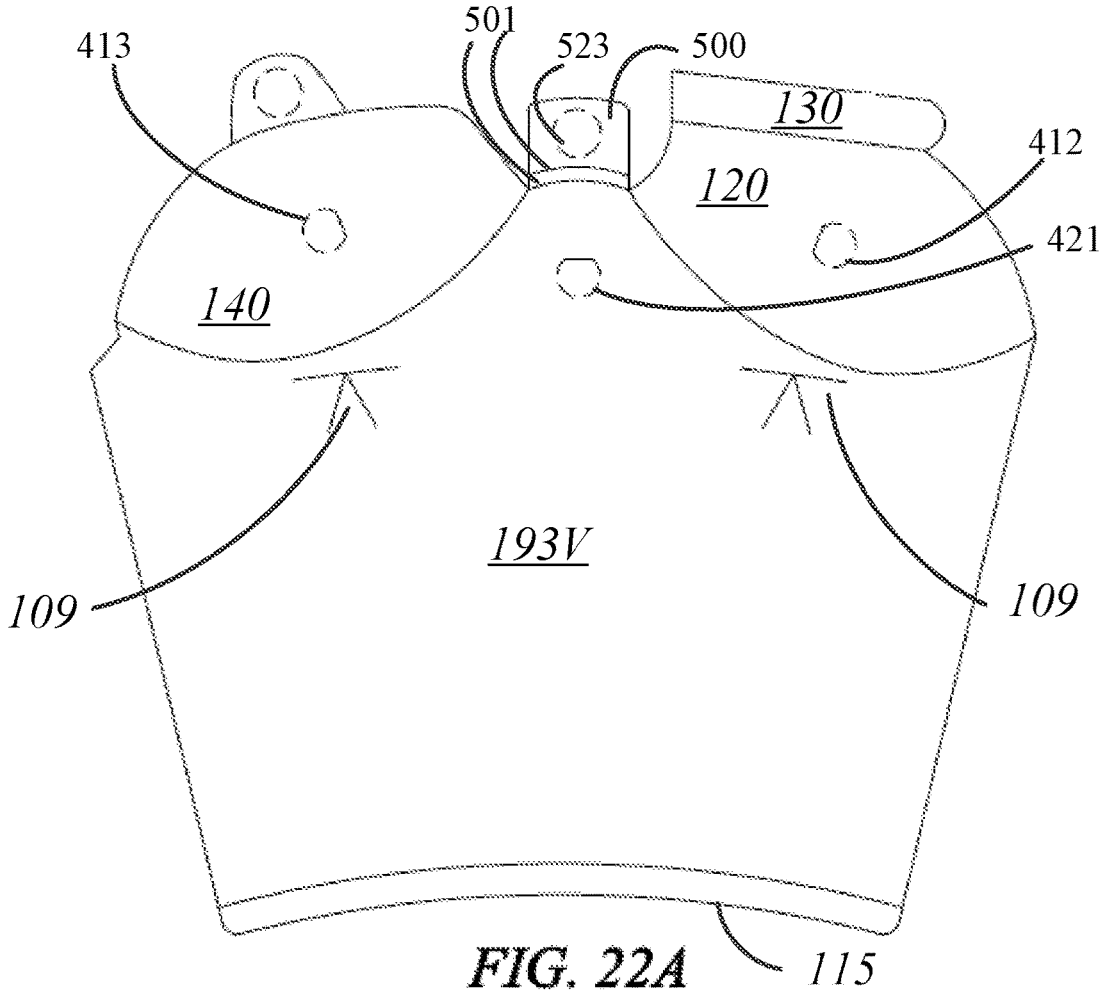
FIGS. 22A-22N schematically illustrate an alternate embodiment of a vessel.
Figure 22B:
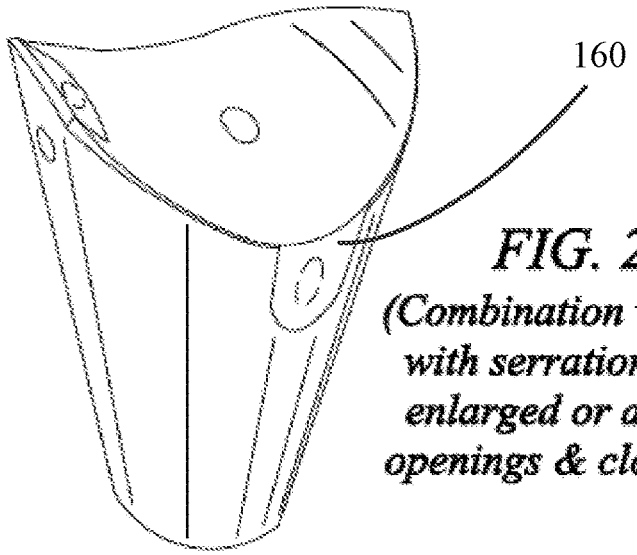
Figure 22C:
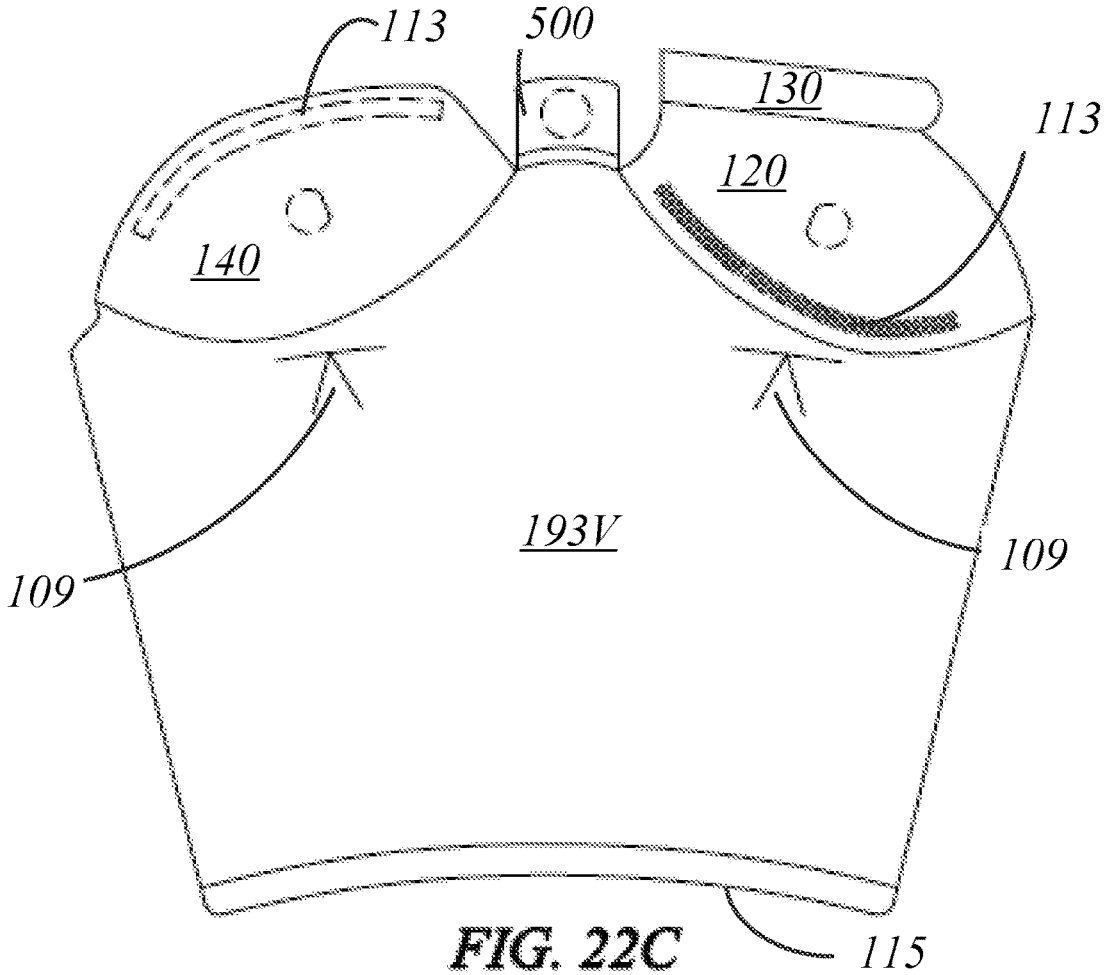
Figure 22D:
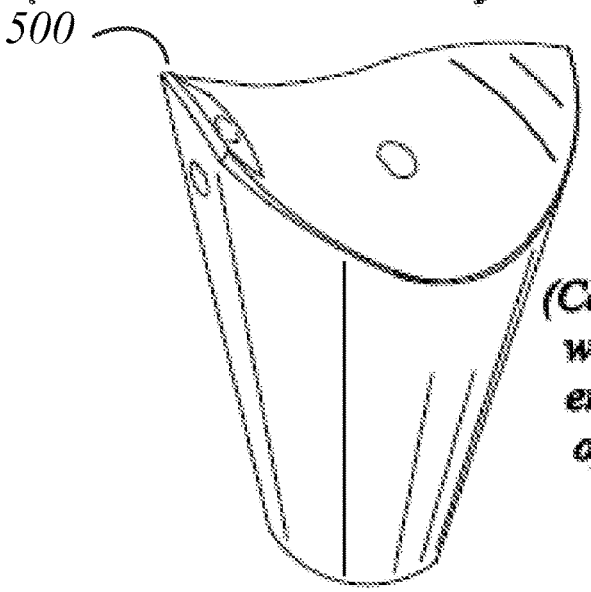
Figure 22E:
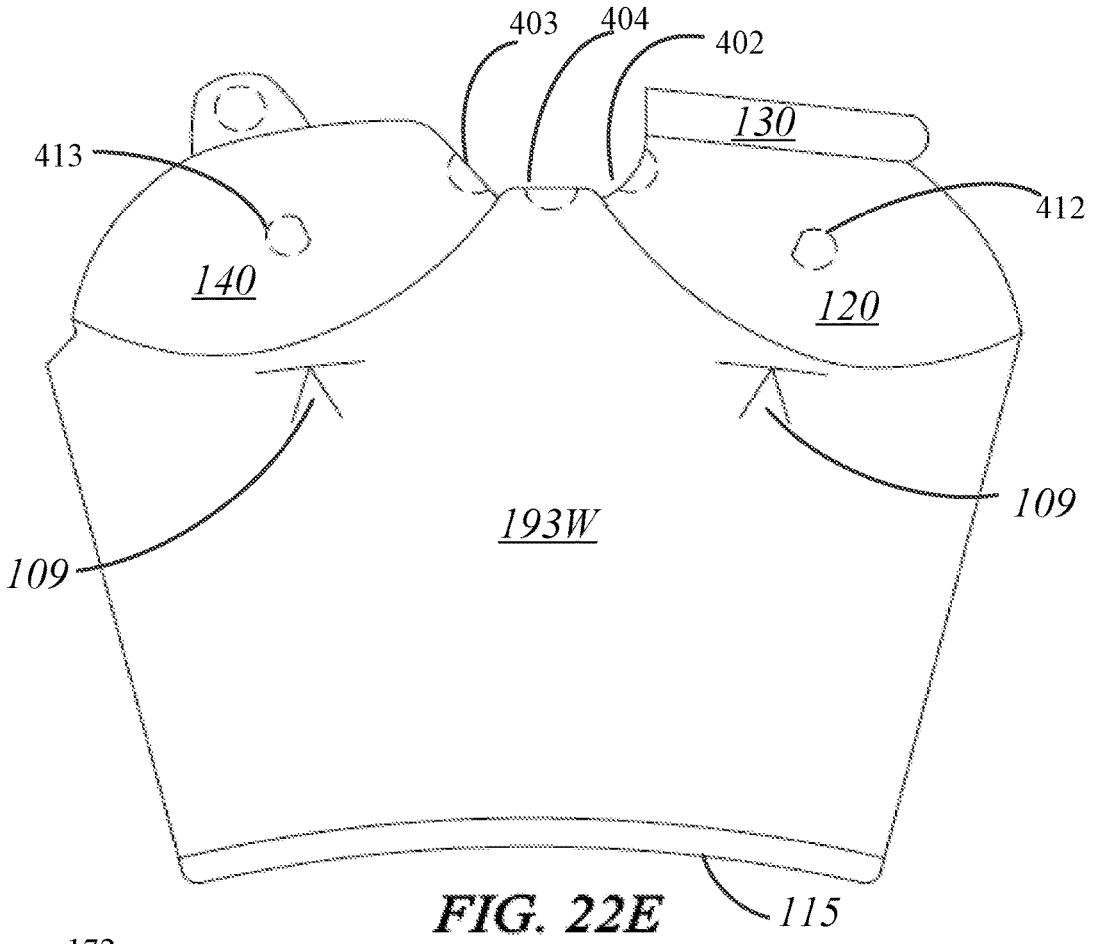
Figure 22F:
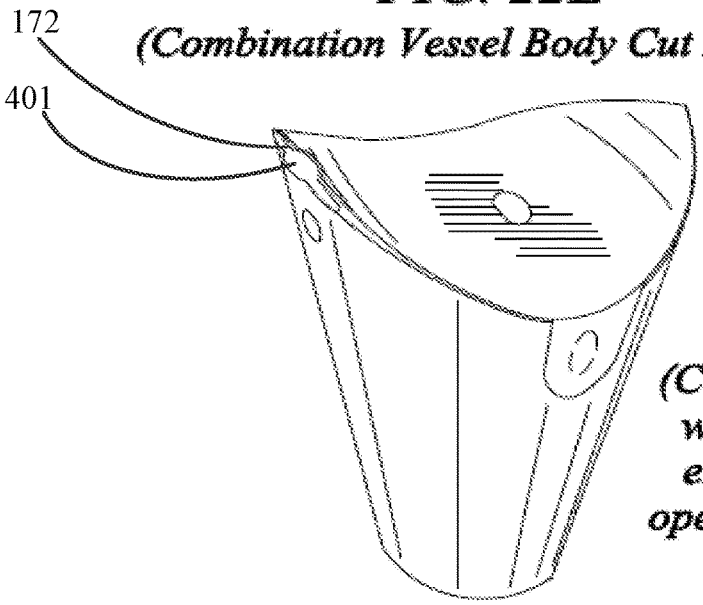
Figure 22G:
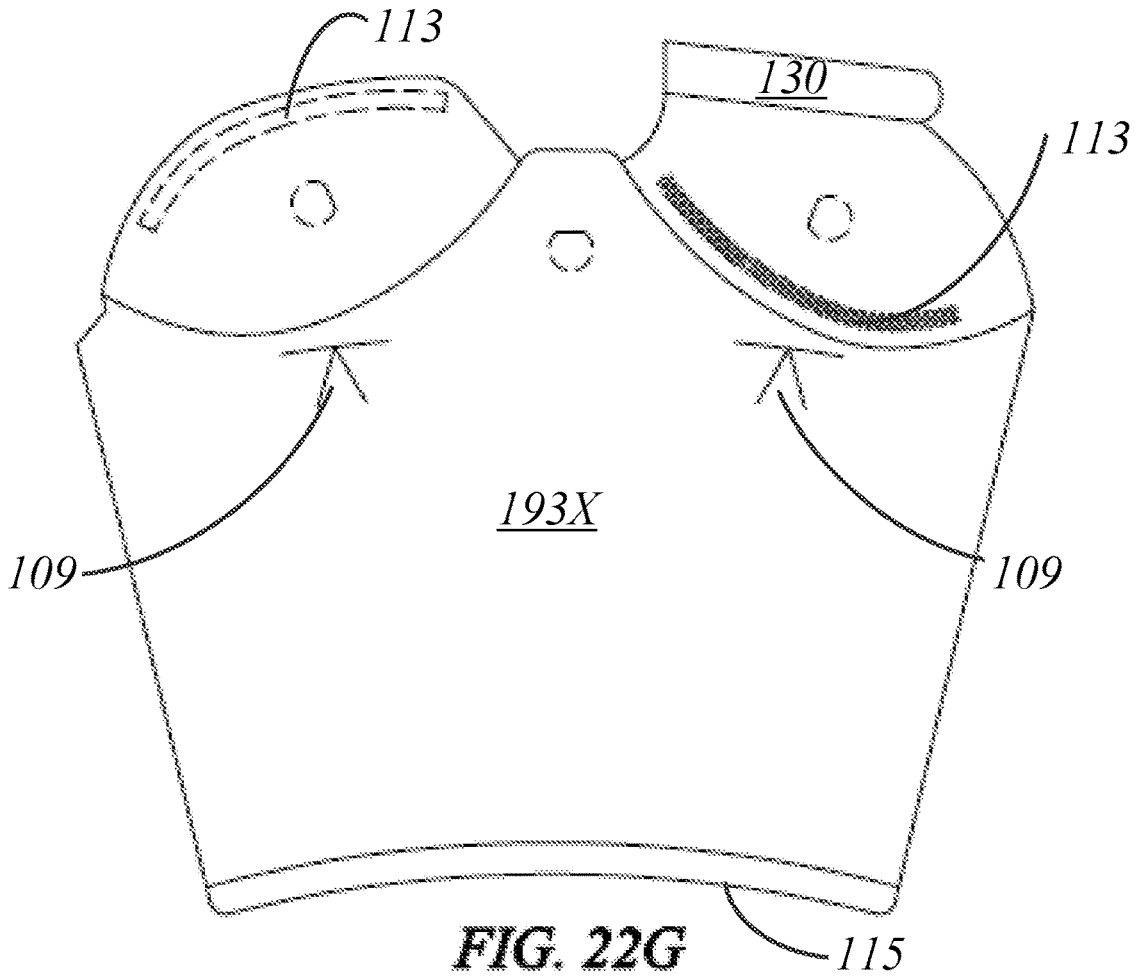
Figure 22H:
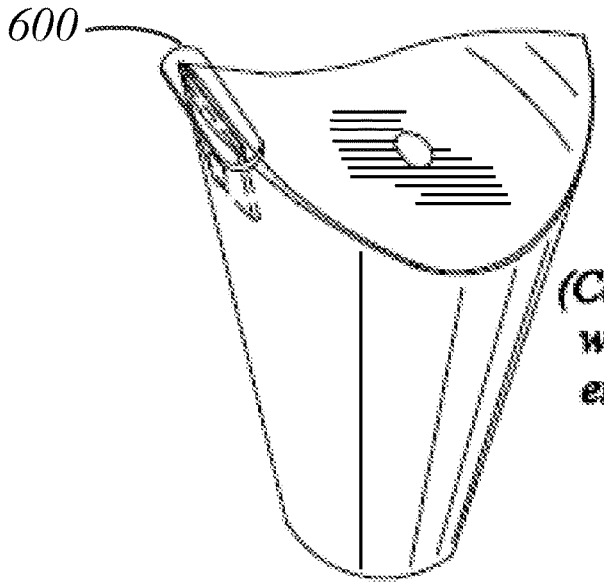
Figure 22I:
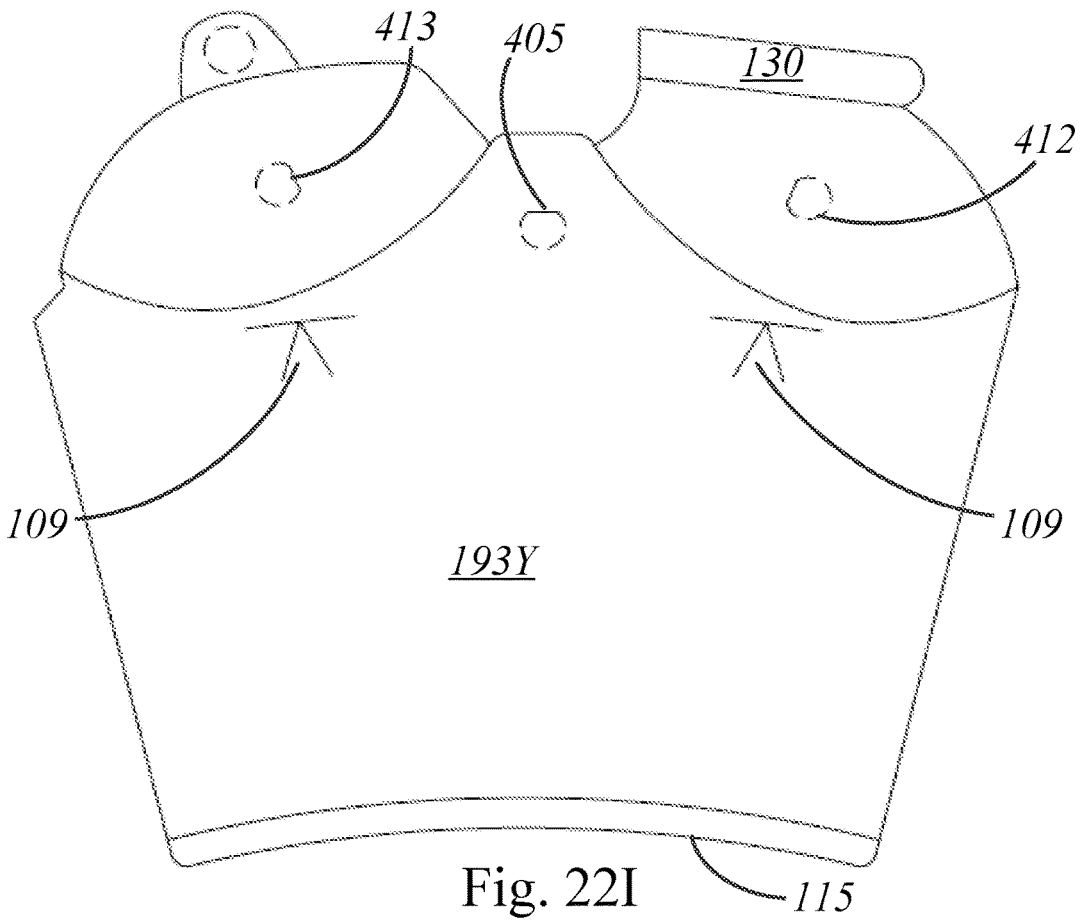
Figure 22J:
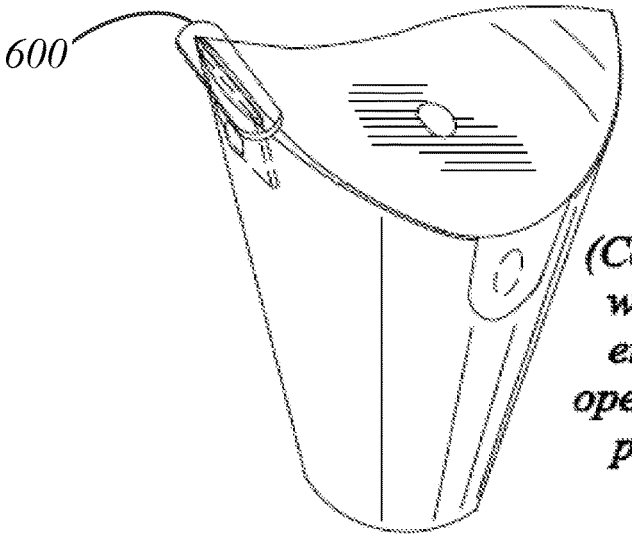
Figure 22K:
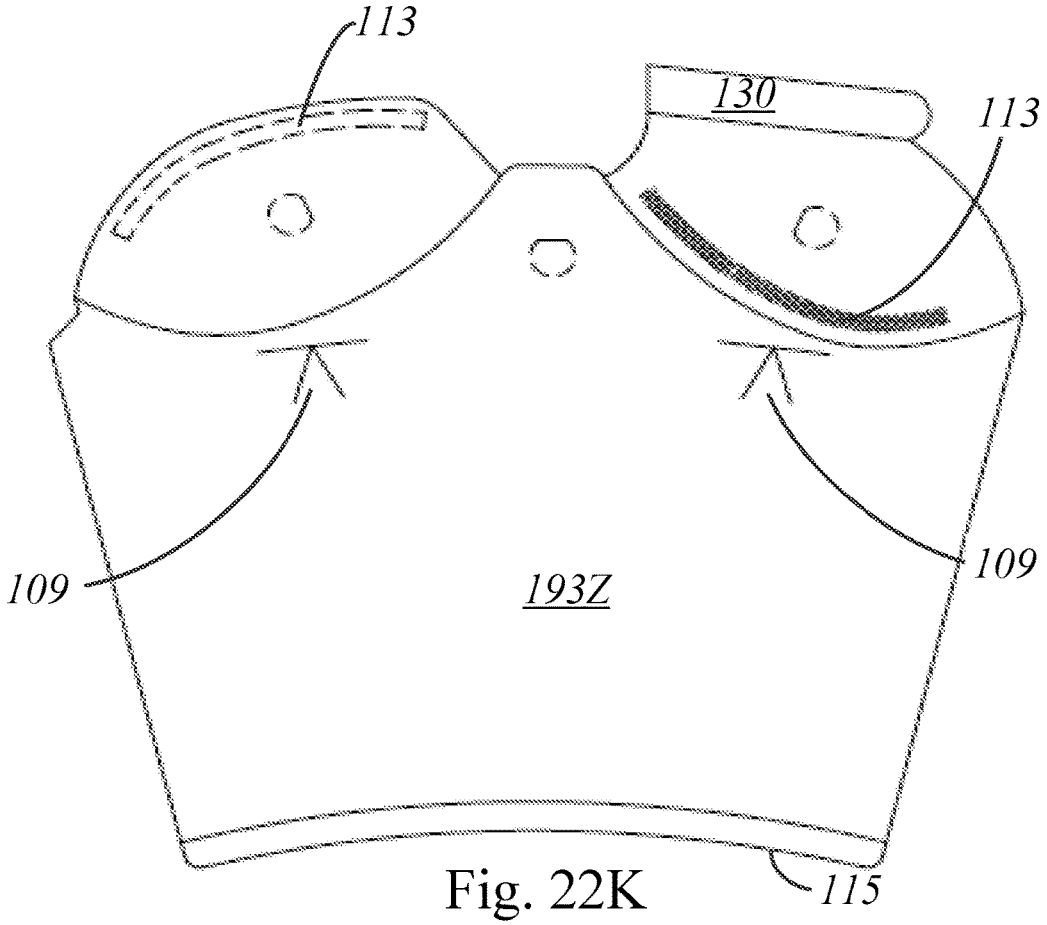
Figure 22L:
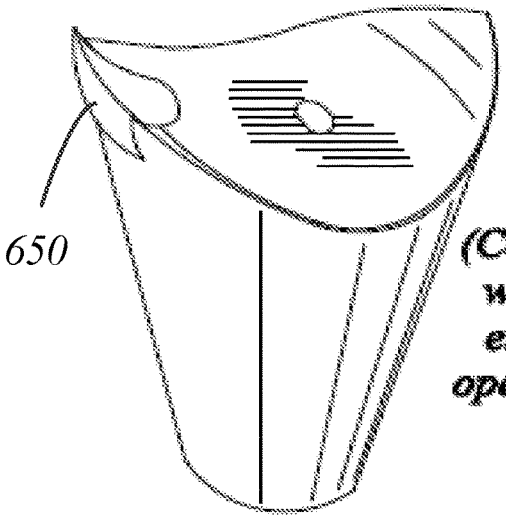
Figure 22M:
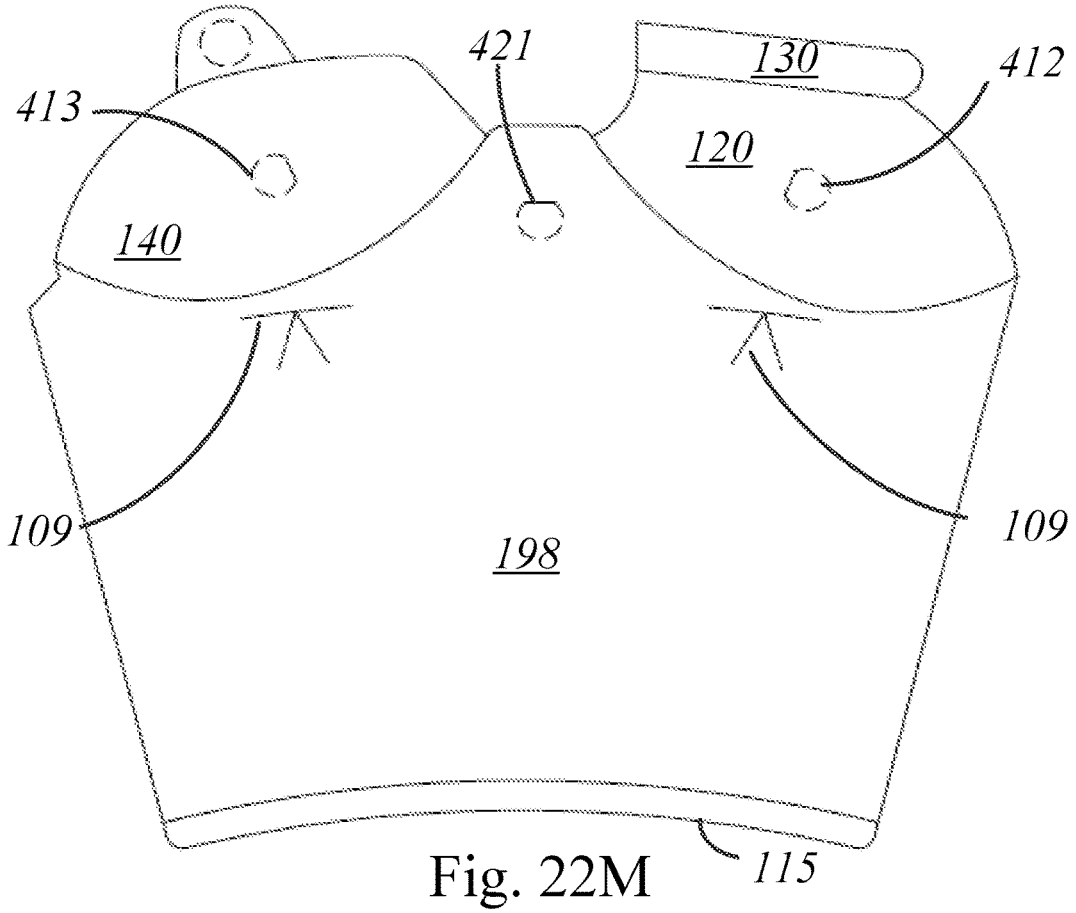
Figure 22N:
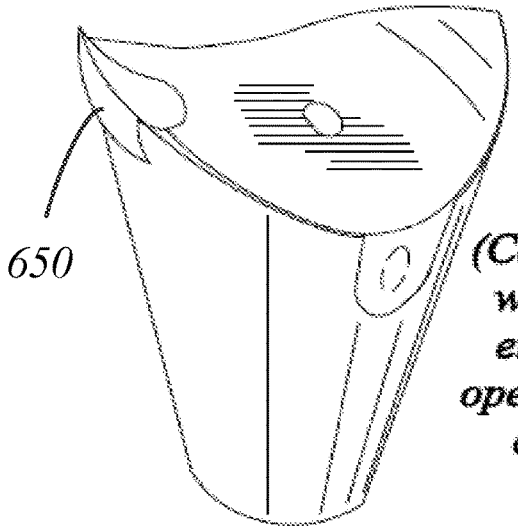

FIGS. 22A-22N schematically illustrate an alternate embodiment having many of the same features of other embodiments described herein, as shown by common reference numbers, and also schematically illustrate a spout cover tab 500 with a multi-stick adhesive 523, as previously described. The spout cover tab 500 is delineated by two fold lines, 501, as schematically illustrated in FIG. 22A, for example. In this embodiment, the two fold lines 501 are parallel to one another, so that folding both of the fold lines produces a narrow intervening surface 502. The intervening surface 502 has a width approximately equal to the width of the spout 171 at the spout aperture 172, so that the spout cover tab 500 may more easily fold around the spout 171 at that point. Various possible combinations of features are schematically illustrated in blanks 193U, 193V, 193W, 193X, 193Y, 193Z and 198.

Materials and Fabrication

The embodiments described herein may generally be made of a flexible material such as paper. However, other embodiments may be provided in which the vessel is composed of other flexible materials that are suitable for forming into a vessel that is capable of containing liquids and has a structure similar to vessel 100, such as treated paper and plastics including polyethylene terephthalate, polypropylene, polystyrene, polylactic-acid-based compounds, etc.

The vessel may be fabricated by injection modeling, by thermoforming, or by rolling, scoring and forming from a sheet (e.g., sheet 193). A vessel 100 may also be manufactured with an insulating material made from plastic or paper based products such as extruded polystyrene foam (XPS) or cardboard respectively, so that the contents can be better insulated from the outside.

In embodiments where the vessel is composed of a material such as paper, the vessel may be coated on one or both sides with a waterproofing coating, such as wax, a polylactic-acid-based compound, or a polyethylene-based compound. Furthermore, the coating may be applied before or after the vessel is formed from a blank.

The embodiments described in all sections above are intended to be merely exemplary; numerous variations and modifications will be apparent to those skilled in the art. All such variations and modifications are intended to be within the scope of the present disclosure as defined in any appended claims.

What is claimed is:

1. A vessel comprising:

a base region, the base region having a width and defining an inner side wall and an interior volume;

a top region comprising an opposing inner flap and an opposing outer flap, the two flaps delineated from the base region by two respective paths, the inner flap comprising a dam flap extending from a free edge, the flaps disposed so that, when folded along their respective paths, the opposing flaps define an elevated spout having a spout opening, and the dam flap forms a folded edge dam between the outer and inner flaps, wherein the folded edge dam extends up the spout towards the spout opening; and a lip tab disposed to fold down and produce a folded edge along a bottom of the spout to mitigate wicking of fluid at the bottom of the spout.

2. A vessel according to claim 1, wherein the top region further comprises three straw hole serrations disposed such that, when the flaps are folded along their respective paths, the three straw hole serrations cooperate to define a straw hole in the spout opening.

3. A vessel according to claim 1, wherein the outer flap comprises a plurality of central score lines that facilitate folding the flap into a closed configuration that accommodates the geometry of the vessel.

4. A vessel according to claim 3, wherein the plurality of central score lines delineate a relatively planar region therebetween, and delineate ascending regions outside of flat region.

5. A vessel according to claim 1 wherein the inner flap is wider than the width of the base region and has a scored outer edge defining the dam flap, so that when the inner flap is folded down, the dam flap contacts the side wall of the vessel and this action folds the dam flap upward along the score line, thus forming the folded edge dam.

6. A vessel according to claim 1 wherein the dam flap comprises two segments divided by a V-shaped gap, such that when the inner flap is folded down, the segments of the dam flap are raised upward and fit together in a fashion closing the V-shaped gap between the segments.

7. A vessel according to claim 1 wherein the spout comprises one or more serrations configured to enlarge the spout opening when the serrations are torn, compressed, stretched, or otherwise distorted.

8. A vessel according to claim 1, wherein the flaps comprise cooperating straw holes.

9. A vessel according to claim 8, wherein the flaps comprise one or more serrations configured to be pushed through to form the cooperating straw holes.

10. A vessel according to claim 1 wherein the vessel comprises an insulating material.

11. A vessel according to claim 1 wherein the vessel is manufactured by injection modeling, by thermoforming, or by rolling, scoring and forming from a sheet.

12. A vessel according to claim 1 further comprising:

an adhesive on at least one of an inner surface of the outer flap or an outer surface of the inner flap, to secure the outer flap to the inner flap.

13. A vessel according to claim 1 wherein the inner flap defines a drain aperture through the inner flap, the drain aperture disposed to allow fluid to flow from a space between the inner flap and the outer flap, when the flaps are folded, to the interior volume of the vessel.

14. A vessel according to claim 1, further comprising a spout closure tab extending from the spout and configured to fold over and cover the spout opening.

15. A vessel according to claim 14, further comprising an adhesive on the spout closure tab, the adhesive configured to releasably attach the spout closure tab to the spout when the closure tab is folded over the spout opening.

16. A vessel according to claim 1, further comprising a plug closure configured to removably fit within the spout opening.

17. A vessel according to claim 16, wherein the plug closure comprises a stopper portion and a base portion, the stopper portion extending from the base portion and configured to fit within the spout opening, and the base portion configured to remain outside of the spout opening when the stopper portion is within the spout opening.

18. A vessel according to claim 1, further comprising a cap closure molded over the spout to cover the spout opening.

19. A vessel according to claim 1, wherein the edges and/or fold paths comprise a waterproofing material.

20. A vessel comprising:

a base region, the base region having a width and defining an inner side wall and an interior volume;

a top region comprising an opposing inner flap having an inner flap edge, and an opposing outer flap having an outer flap edge, the two flaps delineated from the base region by two respective paths, the inner flap comprising a dam flap extending away from the base region, the dam flap having a free edge;

at least one of the inner flap edge and the outer flap edge having a waterproof coating, such as a polylactic-acid based compound or a polyethylene-based compound; and the flaps disposed so that, when folded along their respective paths, the opposing flaps define an elevated spout having a spout opening, and the dam flap forms a folded edge dam between the outer and inner flaps, wherein the folded edge dam extends up the spout towards the spout opening.

21. The vessel according to claim 20, wherein the top region further comprises three straw hole serrations disposed such that, when the flaps are folded along their respective paths, the three straw hole serrations cooperate to define a straw hole in the spout opening.

22. The vessel according to claim 20 wherein the outer flap comprises a plurality of central score lines that facilitate folding the flap into a closed configuration that accommodates the geometry of the vessel.

23. The vessel according to claim 22, wherein the plurality of central score lines delineate a relatively planar region therebetween, and delineate ascending regions outside of flat region.

24. The vessel according to claim 20 wherein the inner flap is wider than the width of the base region and has a scored outer edge defining the dam flap, so that when the inner flap is folded down, the dam flap contacts the side wall of the vessel and this action folds the dam flap upward along the score line, thus forming the folded edge dam.

25. The vessel according to claim 20 wherein the dam flap comprises two segments divided by a V-shaped gap, such that when the inner flap is folded down, the segments of the dam flap are raised upward and fit together in a fashion closing the V-shaped gap between the segments.

26. The vessel according to claim 20 wherein the spout comprises one or more serrations configured to enlarge the spout opening when the serrations are torn, compressed, stretched, or otherwise distorted.

27. The vessel according to claim 20, wherein the flaps comprise cooperating straw holes.

28. The vessel according to claim 27, wherein the flaps comprise one or more serrations configured to be pushed through to form the cooperating straw holes.

29. The vessel according to claim 20 wherein the vessel comprises an insulating material.

30. The vessel according to claim 20 wherein the vessel is manufactured by injection modeling, by thermoforming, or by rolling, scoring and forming from a sheet.

31. The vessel according to claim 20 further comprising:

an adhesive on at least one of an inner surface of the outer flap or an outer surface of the inner flap, to secure the outer flap to the inner flap.

32. The vessel according to claim 20 wherein the inner flap defines a drain aperture through the inner flap, the drain aperture disposed to allow fluid to flow from a space between the inner flap and the outer flap, when the flaps are folded, to the interior volume of the vessel.

33. The vessel according to claim 20, further comprising a spout closure tab extending from the spout and configured to fold over and cover the spout opening.

34. The vessel according to claim 33, further comprising an adhesive on the spout closure tab, the adhesive configured to releasably attach the spout closure tab to the spout when the closure tab is folded over the spout opening.

35. The vessel according to claim 20, further comprising a plug closure configured to removably fit within the spout opening.

36. The vessel according to claim 35, wherein the plug closure comprises a stopper portion and a base portion, the stopper portion extending from the base portion and configured to fit within the spout opening, and the base portion configured to remain outside of the spout opening when the stopper portion is within the spout opening.

37. The vessel according to claim 20, further comprising a cap closure molded over the spout to cover the spout opening.

38. The vessel according to claim 20, wherein the edges and/or fold paths comprise a waterproofing material.

* * * * *